US010639632B2

(12) United States Patent
Bransky et al.

(10) Patent No.: US 10,639,632 B2
(45) **Date of Patent: *May 5, 2020**

(54) DISPOSABLE CARTRIDGE FOR SAMPLE FLUID ANALYSIS

(71) Applicant: Pixcell Medical Technologies Ltd, Yokneam Ilit (IL)

(72) Inventors: Avishay Bransky, Kyriat Tivon (IL); Liron Shlomo, Kibbutz Shomrat (IL); Nir Rotem, Katzir (IL)

(73) Assignee: Pixcell Medical Technologies, Ltd., Yokneam Ilit (IL)

( * ) Notice: Subject to any disclaimer, the term of this patent is extended or adjusted under 35 U.S.C. 154(b) by 337 days.

This patent is subject to a terminal disclaimer.

(21) Appl. No.: 15/421,781

(22) Filed: Feb. 1, 2017

(65) Prior Publication Data

US 2017/0144153 A1 May 25, 2017

Related U.S. Application Data

(63) Continuation of application No. 14/994,820, filed on Jan. 13, 2016, now Pat. No. 9,592,504.

(Continued)

(51) Int. Cl.
*B01L 3/00* (2006.01)
*B01L 1/00* (2006.01)

(52) U.S. Cl.
CPC ... *B01L 3/502715* (2013.01); *B01L 2200/027* (2013.01); *B01L 2200/0689* (2013.01);

(Continued)

(58) Field of Classification Search
CPC ..... B01L 3/563; B01L 3/52; B01L 3/5027; B01L 3/502715
See application file for complete search history.

(56) References Cited

U.S. PATENT DOCUMENTS 4,673,657 A 6/1987 Christian
6,126,899 A 10/2000 Woudenberg et al.

(Continued)

FOREIGN PATENT DOCUMENTS

JP 2002-515351 5/2002
JP 2003-075444 3/2003

(Continued)

OTHER PUBLICATIONS

International Search Report from the European Patent Office for International Application No. PCT/IL2012/000120, dated Feb. 5, 2013.

(Continued)

*Primary Examiner* — Nathan A Bowers
(74) *Attorney, Agent, or Firm* — Finnegan, Henderson, Farabow, Garrett & Dunner, LLP

(57) ABSTRACT

A disposable cartridge may have a fluid analysis chip for receiving a fluid to be analyzed. The fluid analysis chip may be attached to a fluid preparation unit of the disposable cartridge and may include a base layer. The fluid analysis chip may also include a spacer layer disposed over the base layer, the spacer layer including a microchannel formed therein, the microchannel being configured to guide a flow of the fluid to be analyzed within the fluid analysis chip. The fluid analysis chip may also include a cap layer disposed over the spacer layer, the cap layer including an inlet and an outlet for establishing fluid communication with the microchannel included in the spacer layer, and an interface layer disposed over the cap layer, the interface layer being configured to attach the fluid analysis chip to the fluid preparation unit of the disposable cartridge.

24 Claims, 27 Drawing Sheets

Related U.S. Application Data

(60) Provisional application No. 62/103,221, filed on Jan. 14, 2015.

(52) U.S. Cl.
CPC ..... *B01L 2200/10* (2013.01); *B01L 2300/046* (2013.01); *B01L 2300/087* (2013.01); *B01L 2300/0816* (2013.01); *B01L 2300/0838* (2013.01); *B01L 2300/0877* (2013.01); *B01L 2300/0887* (2013.01); *B01L 2300/12* (2013.01); *B01L 2300/123* (2013.01); *B01L 2400/049* (2013.01); *B01L 2400/0683* (2013.01)

(56) References Cited

U.S. PATENT DOCUMENTS

| | | | | |
|---|---|---|---|---|
| 6,300,138 | B1 | 10/2001 | Gleason et al. | |
| 6,645,758 | B1 | 11/2003 | Schnipelsky et al. | |
| 9,903,843 | B2 | 2/2018 | Kanai et al. | |
| 2003/0214650 | A1* | 11/2003 | Dietz | B01L 3/5025 356/246 |
| 2005/0112583 | A1 | 5/2005 | Patno et al. | |
| 2005/0196855 | A1 | 9/2005 | Gau et al. | |
| 2006/0002827 | A1 | 1/2006 | Curcio et al. | |
| 2009/0074626 | A1 | 3/2009 | Kadel et al. | |
| 2009/0215072 | A1 | 8/2009 | McDevitt et al. | |
| 2010/0050749 | A1* | 3/2010 | Yuan | B01L 3/502715 73/61.55 |
| 2010/0304986 | A1 | 12/2010 | Chen et al. | |
| 2012/0187117 | A1 | 7/2012 | Weber et al. | |
| 2013/0149775 | A1* | 6/2013 | Williams | G01N 21/75 435/287.2 |
| 2013/0302787 | A1 | 11/2013 | Agarwal et al. | |
| 2014/0356941 | A1 | 12/2014 | Bransky et al. | |

FOREIGN PATENT DOCUMENTS

| | | |
|---|---|---|
| JP | 2003-114215 | 4/2003 |
| JP | 2003-202347 | 7/2003 |
| JP | 2005-525568 | 8/2005 |
| JP | 2006-349509 | 12/2006 |
| JP | 2007-500510 | 1/2007 |
| JP | 2008-544282 | 12/2008 |
| JP | 2011-177179 | 9/2011 |
| WO | WO 2003/098165 A1 | 11/2003 |
| WO | WO 2005 011867 | 2/2005 |
| WO | WO 2007/002237 A1 | 1/2007 |
| WO | WO 2013/136115 A1 | 9/2013 |
| WO | WO 2014/0611160 A1 | 4/2014 |

OTHER PUBLICATIONS

Written Opinion of the International Searching Authority for International Application No. PCT/IL2012/000120, dated Feb. 5, 2013.

Patko, Daniel, et al., "Microfluidic Channels Laser-Cut in Thin Double-Sided Tapes: Cost-Effective Biocompatible Fluidics in Minutes from Design to Final Integration with Optical Biochips," Sensors and Actuators B: Chemical, Feb. 2014,, 5 pages.

"Adhesives Research." Technology Overview Power Point Presentation, May 2014, 17 pages.

PCT International Search Report and Written Opinion from the International Search Authority for International Application No. PCT/IB16/00753, dated Aug. 5, 2016.

Office Action from Japan Patent Office regarding Patent Application No. JP 2017-537315, Dispatch Date Dec. 25, 2018, 3 pages.

Office Action from Japan Patent Office regarding Patent Application No. JP 2017-537315, Dispatch dated Oct. 15, 2019, 16 pages.

* cited by examiner

DISPOSABLE CARTRIDGE FOR SAMPLE FLUID ANALYSIS

PRIORITY

This application is continuation of U.S. application Ser. No. 14/994,820, filed Jan. 13, 2016, which is incorporated herein by reference. This application is also based on and claims priority to U.S. Provisional Application No. 62/103,221, filed on Jan. 14, 2015, which is incorporated herein by reference in its entirety.

TECHNICAL FIELD

The disclosure relates to the field of performing automatic analysis of fluids. More specifically, it relates to a cartridge for preparing a sample fluid that may contain cells for analysis. The cartridge may be introduced into a reader system that performs optical analysis of fluid flowing through a flow chamber (which may be referred to as a "chip") of the cartridge.

BACKGROUND

Point-of-care testing (POCT) is defined as medical testing at or near the site of patient care, for example at the doctor's office. Point of Care Testing systems enable expedited performance of tests, for example blood tests, eliminating a need for sending samples to laboratory. Expedited test results may also allow for immediate clinical management decisions to be made.

It is desirable that such POCT systems be simple to use and low maintenance. To that end, some systems use fully self-contained disposable cartridges or strips. In fully-automated systems, no preliminary sample preparation is required and the cartridges eliminate the risk of contamination.

U.S. Patent Publication No. 2014/0033809 describes a disposable cartridge for preparing a sample fluid containing cells for analysis. The described cartridge contains several chambers connected via channels and frangible seals. The sample is introduced via capillaries into the chambers and mixed by pressurizing the chambers.

The presently disclosed embodiments include several innovative aspects that have the potential for simplifying the cartridge design, improving manufacturability, and/or enhancing reliability and cartridge functions.

SUMMARY

In some embodiments, a cartridge configured for use in a blood analyzer is provided. The cartridge may include a substantially rigid frame, a flow path within the rigid frame, at least one opening in the substantially rigid frame configured to align and stabilize a capillary tube, and a seal within the flow path. The seal may be configured to temporarily obstruct flow through at least a portion of the flow path. Further the seal may be configured to open in response to a force exerted via a capillary tube inserted into the at least one opening.

A force exerted via the capillary tube may include an axial force exerted on the capillary tube. The cartridge may further include at least one capillary tube configured to obtain a blood sample from a patient through an orifice therein and to distribute the blood sample in the flow path within the rigid frame through the orifice. The seal may include a plug configured to allow for passage of air but blockage of fluid (e.g., a hydrophobic plug) contained in the capillary tube. The cartridge may be configured to retain the capillary tube in the at least one opening during blood analysis in a blood analyzer. When the capillary tube is in the at least one opening, a blood sample in the capillary tube may be sealed from contact with an outside environment. The at least one opening may include two openings in the substantially rigid frame. The cartridge may further include a flexible reservoir, and the flow path extends between the at least one opening and the flexible reservoir. The cartridge may be configured to cooperate with a blood analyzer such that after a capillary tube with a blood sample therein is placed into the at least one opening, and the blood analyzer may be configured to automatically inject the blood sample from the capillary tube into the flow path upon placement of the cartridge into the blood analyzer.

In some embodiments, a cartridge configured for use in a blood analyzer is provided. The cartridge may include a first blood sample inlet, a first reservoir containing at least one high molecular weight polymer, a buffer, and a sphering agent, a first channel connecting the first blood sample inlet and the first reservoir, a second reservoir, a second channel connecting the first reservoir to the second reservoir, a micro-channel flow connected to the second reservoir, a second blood sample inlet; a third reservoir containing a first stain, a third channel connecting the second blood sample inlet to the third reservoir, a fourth reservoir, a fourth channel connecting the third reservoir to the fourth reservoir; a fifth reservoir containing a second stain, a fifth channel connecting the fourth reservoir to the fifth reservoir, wherein the fifth reservoir is flow connected to the micro-channel, a viewing area associated with the micro-channel, the viewing area being configured to lie in an optical path of an imager when the cartridge is received by a blood analyzer, and a hemoglobin inspection area flow connected to the second reservoir, wherein the hemoglobin inspection area is configured to lie in an optical path of a light source when the cartridge is received by the blood analyzer.

The first stain may be an acidic stain and the second stain may be an alkaline stain. At least one of the first reservoir, second reservoir, third reservoir, fourth reservoir, and fifth reservoir may include a reagent including at least one high molecular weight polymer. The first blood sample inlet and the second blood sample inlet may be configured to mate with respective first and second capillary tubes. The cartridge may further include a first seal located in the first channel and a second seal located in the third channel.

According to other aspects of the disclosed embodiments, a cartridge may be configured for use in a blood analyzer, the cartridge may comprise a substantially rigid portion; a flexible sheet fixed to the rigid portion, wherein the flexible sheet includes a cap disposed over a depression formed in the rigid portion to form a first reservoir; a sample fluid inlet formed in the rigid portion; and at least one flow path formed in the rigid portion and configured to establish fluid communication between the sample fluid inlet and the first reservoir.

The cartridge may include a seal disposed in the at least one flow path, wherein the seal is configured to temporarily obstruct flow through at least a portion of the at least one flow path, and wherein the seal is configured to open in response to a force exerted via a capillary tube inserted into the sample fluid inlet. The seal may include a flap portion suspended by a first suspension portion of a first thickness and a second suspension portion of a second thickness, wherein the second thickness is greater than the first thickness, and wherein the first suspension portion is configured such that the three exerted via the capillary causes the first suspension portion to tear leaving the flap portion suspended primarily by the second suspension portion. The seal may include a flap portion configured to reside within the at least one flow path at substantially a 90 degree angle or at an angle other than 90 degrees relative to a longitudinal axis of the at least one flow path. The cartridge may further including at least one filling hole associated with the depression, the at least one filling hole configured provide fluid to the first reservoir. The flexible sheet of the cartridge may include a second cap disposed over a second depression formed in the rigid portion to form a second reservoir, the cartridge further including: a flow channel connecting the first reservoir to the second reservoir; a fluid outlet channel associated with the second reservoir; and a seal disposed within the fluid outlet channel and configured to control a flow of fluid through the fluid outlet channel. The seal may include a peelable bond between the rigid portion and the flexible sheet. Further, the cartridge may include a buffer compartment formed by a third depression in the rigid portion and a third cap in flexible sheet, wherein the buffer compartment is positioned along a flow path of the cartridge such that a prepared fluid to be analyzed collects in the buffer compartment prior to analysis of the prepared fluid.

The presently disclosed embodiments may include a fluid analysis chip for receiving a fluid to be analyzed from a fluid preparation unit of a disposable cartridge may include a base layer. The fluid analysis chip may also include a spacer layer disposed over the base layer, the spacer layer including a microchannel formed therein, the microchannel being configured to guide a flow of the fluid to be analyzed within the fluid analysis chip. The fluid analysis chip may also include a cap layer disposed over the spacer layer, the cap layer including an inlet and an outlet for establishing fluid communication with the microchannel included in the spacer layer, and an interface layer disposed over the cap layer, the interface layer being configured to attach the fluid analysis chip to the fluid preparation unit of the disposable cartridge.

The presently disclosed embodiments may also include a disposable fluid analysis cartridge. The disposable fluid analysis cartridge may include a preparation unit and a fluid analysis chip attached to the preparation unit. The preparation unit may include; a rigid base portion including at least one depression formed in a top surface of the rigid base portion; a flexible film fixed to the rigid base portion and extending over the at least one depression to form a reservoir; a reservoir inlet configured to receive into the reservoir a fluid to be analyzed; and a first flow path including at least one fluid conduit, the at least one fluid conduit of the first flow path being formed by the flexible film extending over one or more grooves formed in the top surface of the rigid base portion, and wherein the first flow path is configured to carry a sample fluid including at least the fluid to be analyzed from the reservoir to a preparation unit fluid outlet. The fluid analysis chip may include: a base layer; a spacer layer disposed over the base layer, the spacer layer including a microchannel formed therein, the microchannel being configured to guide a flow of the sample fluid within the fluid analysis chip; a cap layer disposed over the spacer layer, the cap layer including a cap layer inlet and a cap layer outlet for establishing fluid communication with the microchannel included in the spacer layer; and an interface layer disposed over the cap layer, the interface layer attaching the fluid analysis chip to the preparation unit; wherein the cap layer inlet is configured to receive the sample fluid from the preparation unit fluid outlet.

BRIEF DESCRIPTION OF THE DRAWINGS

In order to understand the present disclosure and to see how it may be carried out in practice, embodiments will now be described, by way of non-limiting example only, with reference to the accompanying drawings, in which.

DETAILED DESCRIPTION OF EXEMPLARY EMBODIMENTS

Figure 1:
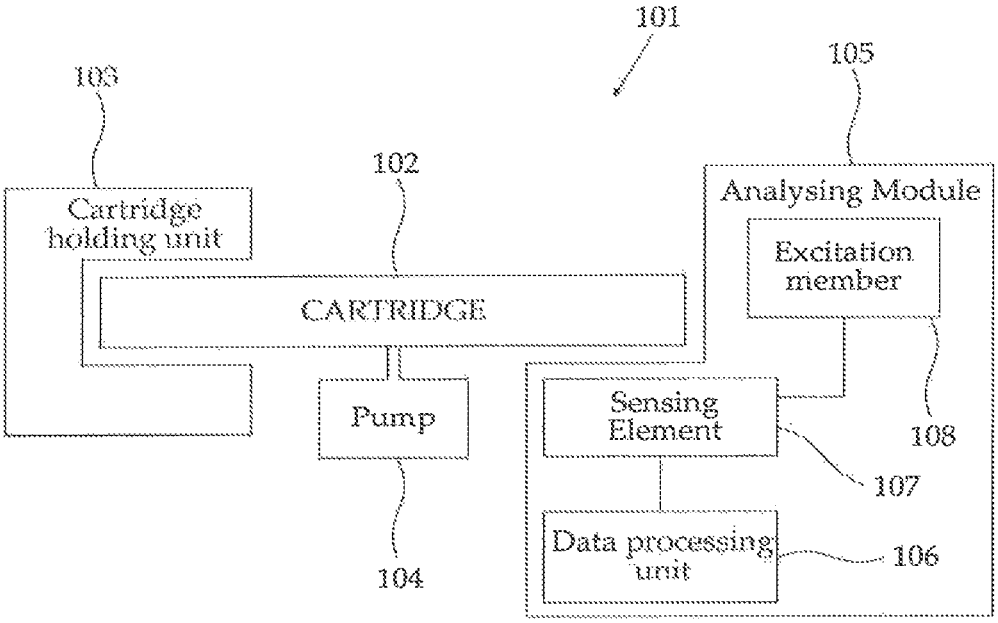
FIG. 1 diagrammatically illustrates a system for analysis of a sample fluid using the cartridge, according to some embodiments of the disclosure.

In the following description components that are common to more than one figure will be referenced by the same reference numerals.

In addition, unless specifically noted, embodiments described or referenced in the present description can be additional and/or alternative to any other embodiment described or referenced therein.

The disclosed embodiments may include a cartridge for preparing a sample fluid containing cells for analysis. The sample fluid may be a body fluid, for example: blood, cerebrospinal fluid (CSF), pericardial fluid, pleural fluid, or any other fluid that may contain cells. Cells may be any type of prokaryotic cells, including, for example: bacteria; eukaryotic cells, for example red blood cells; white blood cells (Leukocytes); epithelial cells; circulating tumor cells; cellular fragments, for example platelets; or others.

In the present disclosure, a cartridge for preparing a blood sample for optical analysis resulting in obtaining a Complete Blood Count (CBC) is referenced. It should be noted, however, that the disclosure is not limited to CBC. Disposable cartridges in accordance with the disclosure may be used for multiple applications where analysis of cells is desired, such as HIV monitoring (such as using CD4/CD8 ratio), detection of f-hemoglobin, Malaria antigen or other blood parasites, Paroxysmal Nocturnal Hemoglobinuria (PNH), diagnosis of Celiac disease using Intestinal Autoantibodies (EmA), Alzheimer's disease, or any other application for which cell-based diagnosis may be relevant.

FIG. 1 diagrammatically illustrates a system 101 for analysis of a sample fluid using a cartridge 102, according to certain embodiments of the disclosure. For example, the system 101 may be usable as a Point of Care Testing (POCT) system which enables quirk obtaining of laboratory results in a doctor's office. The system 101 comprises a cartridge holding unit 103, a pump 104, and an analyzing module 105 comprising a data processing unit 106. The analyzing module 105 may be configured to perform an analysis, e.g., optical analysis and/or electrical impedance analysis etc. Accordingly, the module may comprise a suitable sensing element 107 configured for detecting and measuring parameters used for analysis. For example, optical sensor (such as a CCD, CMOS or photo-multiplier) can be used in an analysis module configured for optical analysis. The module may also comprise an excitation member 108, such as a light source for emitting light of a pre-determined wave length suitable for the required type of analysis of the sample fluid. The excitation member 108 is possibly coupled to the sensor 107, e.g., in order to synchronize operations thereof. Also coupled to the sensor 107 is the data processing unit 106, that serves for processing and storing data acquired by a analysis module. The pump 104 may serve to generate a pressure gradient, such as vacuum, that drives a flow of a sample fluid inside the cartridge.

In some embodiments of the disclosure, the system may be configured to perform a complete blood count. In these embodiments, the sensor 107 may include a camera which takes images of cells flowing inside the cartridge (as explained in more detail below). Acquired images are then processed by the data processing unit using suitable software and/or hardware in order to determine number of cells corresponding to each blood cell type (e.g., neutrophils, lymphocytes, erythrocytes, etc.) present in an analyzed blood sample.

Figure 2:
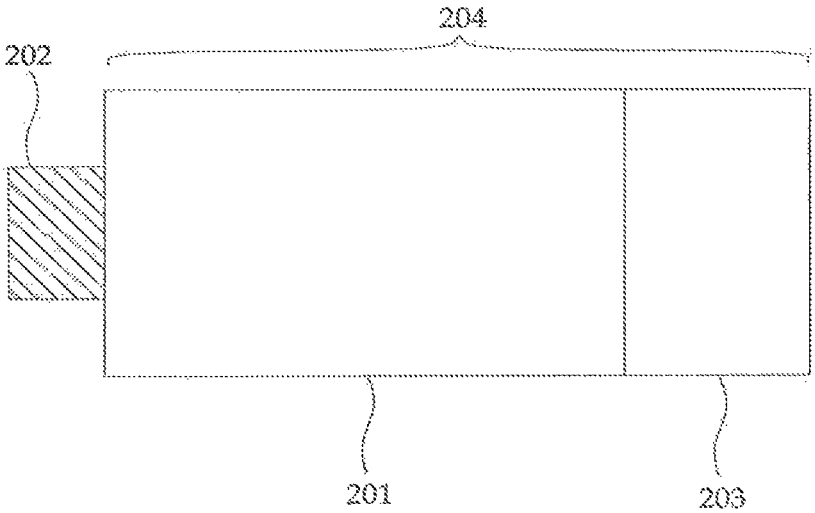
FIG. 2 diagrammatically illustrates a cartridge already containing the body fluid as inserted into cartridge holding unit, according to some embodiments of the disclosure.

FIG. 2 schematically illustrates a cartridge 204 according to certain embodiments of the disclosure. A sampler 202, which may function to introduce a sample fluid into the cartridge may be inserted into the cartridge 204, e.g., from one side. The sample fluid may be received by a preparation compartment 201 where one or more processes may be performed relative to the sample fluid to prepare the sample fluid for analysis. An analyzing compartment 203 may be coupled to the preparation compartment 201. The analyzing compartment may receive the prepared sample fluid from the preparation compartment 201 and may enable analysis of one or more aspects of the sample fluid. In some embodiments, the preparation compartment 201 and the analyzing compartment 203 may be separately formed and coupled together by one or more flow paths. In some embodiments, the cartridge preparation compartment 201 and the analyzing compartment 203 may be manufactured together and coupled during, or immediately after manufacturing, or they may be manufactured separately and become coupled prior to marketing the cartridge to its end user or even just prior to usage thereof, possibly even by a person performing the test or automatically inside system 101.

Although in FIG. 2 the preparation compartment 201 and the analyzing compartment 203 appear to be two separate compartments coupled together, this is non-limiting, and in other embodiments the preparation compartment 201 and analyzing compartment 203 may comprise integral parts of cartridge 204. For example, in some embodiments, preparation compartment 201 and analyzing compartment 203 may be integrally termed relative to a common substrate.

While in the embodiment illustrated in FIG. 2 the sampler 202 and the analyzing compartment 203 appear to be on both sides of the cartridge, this is non-limiting as well. According to other embodiments the sampler and the analyzing compartment may be positioned, with reference to the cartridge 204, in any suitable manner depending on the requirements of a particular application. For example, the analyzing compartment 203 may be positioned above or below the preparation compartment 201, on its side, on the side where the sampler 202 is positioned, or even in a gap, or a window, inside the cartridge 204.

Some embodiments of sampler 202 are described below relative to FIG. 14. In some embodiments, sampler 202 may be formed as an integral part of cartridge 204. In other embodiments, however, sampler 202 may be formed as a component separate from cartridge 204. In either case, however, sampler 202 may include a carrier for holding a sample fluid. The carrier may include, for example, a capillary. According to certain embodiments, system 101 may automatically couple the sampler 202 to the cartridge 204 in order to introduce the sample fluid thereto.

In certain embodiments, the sampler may be considered as part of the cartridge, e.g., by coupling the sampler to the cartridge using any suitable means such as a coupling-strip. In such cases, the carrier (e.g., the capillary) may be made detachable from sampler 202 to minimize a risk of breaking the carrier.

Figure 3:
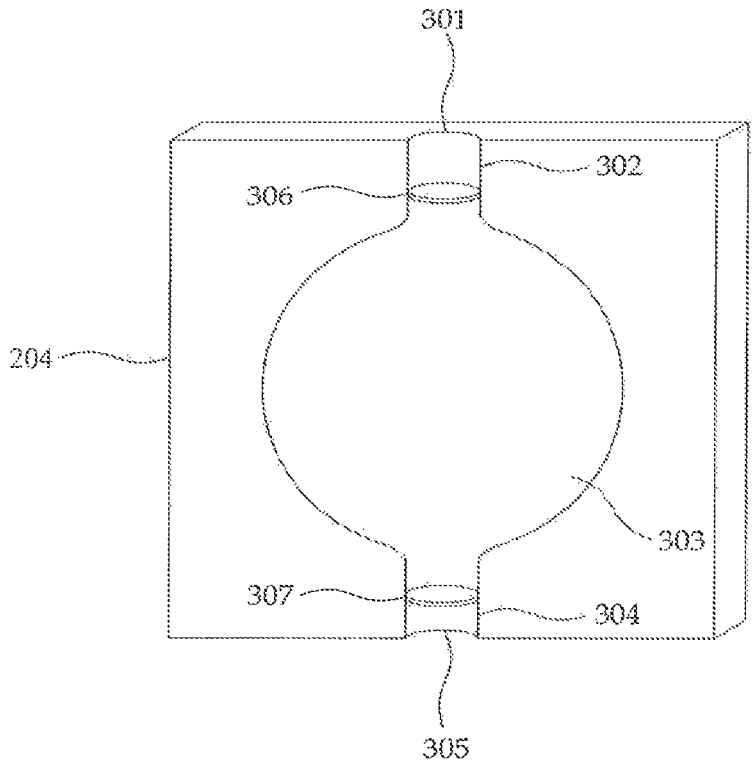
FIG. 3 shows aspects of a cartridge, according to some embodiments of the disclosure.

FIG. 3 provides a diagrammatic illustration of a cartridge 204, according to certain embodiments of the disclosure. In the cartridge 204, a first opening 301, may be located in one of the sides thereof and may be configured for receiving a carrier carrying a sample fluid. A first channel 302 is coupled to the first opening 301 and to a reservoir 303. The reservoir 303 is configured to receive the sample fluid and to perform a procedure affecting it, thereby forming an output fluid. Then, the reservoir is configured to release the output fluid into the second channel 304, and therefrom out of the cartridge via a second opening 305. A preceding seal 306, configured to prevent flow from the reservoir via the first opening is coupled to the first channel 302, and a succeeding seal 307, configured to prevent flow from the reservoir via the second opening is coupled to the second channel 304.

The term "output fluid" may include a fluid resulting from a procedure affecting the sample fluid. The fluid entering the reservoir, prior to the affecting procedure, may be referred to as an "input fluid." In some cases, the input fluid may correspond to a sample fluid introduced into reservoir 303, for example.

In FIG. 3 the first and second openings 301 and 305 are illustrated when they are positioned opposite one to the other. The two openings, however, may be located in other configurations. For example, the two openings may be perpendicularly positioned relative to one another or may be located on a same side of cartridge 204, for example.

The procedure affecting a sample fluid, performed inside a reservoir, such as reservoir 303, may include any procedure that may provide a change of a physical or a chemical state (or a change of at least one property or characteristic) of the sample fluid or of the cells contained within the sample fluid. Examples of possible affecting procedures may include heating, mixing, diluting, staining, permeabelization, lysis, etc. Some of the procedures will be described below with reference to the following figures.

In certain embodiments of the disclosure, the reservoir 303 may be pre-loaded with a substance. The pre-loaded substance may be a liquid substance, a solid substance or a combination thereof. The substance may consist of a single reagent or of several different reagents. An example of a liquid substance consisting of several reagents is PBS (Phosphate Buffered Saline), while examples of solid substances are lyophilized antibodies, different kinds of powdered stains dissolvable, e.g., in water or in ethanol, coated beads, etc. A substance may be lying free on the bottom of the reservoir or may be attached to an inner surface of the reservoir. Alternatively, a substance may be attached to structures or components, such as sponge or microfibers, the space of the reservoir. Such structures or components may enlarge an amount of surface area exposed to the sample fluid.

Furthermore, some possible procedures, such as heating, do not require having a pre-loaded substance in the reservoir. Therefore, in certain embodiments the reservoir is not pre-loaded with a substance, while it is possible that the reservoir holds instead (or in addition to a pre-loaded substance) a mechanism, such as a heating mechanism or part thereof. In addition, understanding that pre-loading the substance may be performed during manufacturing of the cartridge or at any time prior to the introduction of the sample fluid, it can be appreciated that according to alternative embodiments, the substance may be introduced into the reservoir together with or after introducing the sample fluid. In other cases, wherein the substance is composed of a combination of constituents or wherein the substance is the outcome of a chemical reaction between more than one constituents, it is possible that at least one constituent is pre-loaded while at least one other constituent is introduced with or after introduction of the sample fluid.

In case the reservoir 303 is loaded with a substance, whether pre-loaded or loaded with/after introduction of the sample fluid, the procedure affecting the sample fluid may include mixing of the sample fluid with the substance. In some cases, the sample fluid and the substance may be mixed thoroughly as a lack of homogeneity may impact subsequent analysis. According to certain embodiments of the disclosure, in order to enable mixing, at least part (a portion) of the surface of the reservoir, may include a pressable portion made of an elastic polymer, for example, polyurethane or silicone, or of a different elastic material. Due to deformation (such as constriction) of the reservoir, affected by pressing and/or releasing the pressable portion, fluid contained within the reservoir may form a jet flow inside the reservoir, which is a form of flow that may enhance mixing. Hence, according to embodiments of the disclosure, it may be possible to achieve mixing by alternatively pressing and releasing the pressable portion of the reservoir. When the pressable portion is pressed, the fluid may flow away from the pressed area, and when it is released, the fluid may flow back, such that the fluid flows back and forth.

In certain embodiments of the disclosure, a pressable portion may constitute a part of a reservoir's surface, for example, an upper surface of a reservoir or a certain percentage of its surface. In other embodiments of the disclosure, the entire reservoir may be pressable.

Apart from or in addition to mixing, procedures affecting the sample fluid performed in the reservoir may include reactions that may occur between the substance and the sample fluid. The reaction may include a chemical reaction, for example oxidation/reduction, or a biochemical reaction such as binding antibodies to ligands. The procedure may lead to changes in physical and/or chemical states of the sample fluid or of cells contained within the sample fluid. For example, it may affect changes in viscoelastic properties or in pH of the sample fluid. A concentration of cells contained in a sample fluid may decrease due to dilution. A cellular membrane may become permeable enabling binding of coloring agents or antibodies contained within the substance to cellular components, such as cytoplasmic granules. An oxidation or reduction of different cellular components may happen, such as oxidation of hemoglobin contained in the red blood cells into methemoglobin, etc.

After the procedure has been completed (or at least partially completed), the resulting output fluid may be released from the reservoir. The releasing may be affected by positive pressure or "pushing" the fluid out of the reservoir. For example, fluid may be pushed out of the reservoir by pressing. Additionally or alternatively, the fluid may be affected by negative pressure, for example if fluid is driven out of the reservoir by physical forces the "pull" it out, such as gravitational force or due to application of external forces such as a vacuum. In certain embodiments of the disclosure, the flow of the output fluid from the reservoir via the second opening into the analyzing compartment may be caused by a suction force generated by the vacuum pump 104 coupled to the analyzing compartment, as shown in FIG. 1.

Reservoir 303 may be enclosed between two seals, wherein the preceding seal 306 prevents fluid from flowing out of the reservoir via the first opening 301 and the succeeding seal 307 prevents fluid from flowing out of the reservoir via the second opening. Prior to introduction of the sample fluid into reservoir 303, the two seals 306 and 307 may prevent release of substances from the reservoir. These seals may also prevent release of the substance and/or the sample fluid during an affecting procedure. And, the seals may prevent unintentional release of the output fluid.

Regarding seal 307, breaking or breaching of seal 307 may allow output fluid to flow out of the reservoir towards the second opening. In some embodiments, after breaching the seal, it may be left open. In some embodiments, the second seal 307 may constitute a breakable or "frangible seal." It is possible to form the seal, e.g., of adhesive configured to be to be broken by application of pressure exceeding a certain threshold. Applying pressure on the pressable part of a reservoir may result in a pressure at the position of the seal that exceeds the breaking threshold of the seal, which causes the seal to breach. The output fluid may then be released into the second channel 304, through the second opening 305 and into the analyzing compartment. In other words, the output flow may be conveyed to the analyzing compartment via the second channel 304 and the second opening 305.

Mixing of the sample fluid with the substance by intermittently pressing the pressable portion of the reservoir may not result in super-threshold pressure at the position of the seal. Thus, during mixing, the seal 307 may remain intact. In some embodiments, a structure or obstacle may be formed in a flow path prior to seal 307 to protect the seal from being affected by any super-threshold pressure that may be caused during mixing. For example, pressure may be applied on a channel between the reservoir and the seal, hence obtaining a physical obstacle preventing pressure arising in the reservoir to reach the seal. In other embodiments, super-threshold pressure may be allowed to reach the seal and breach it, however, a physical obstacle located on the channel may prevent fluid from flowing until the obstacle is removed.

Referring back to preceding seal 306, his seal may have two different roles. In a first role, seal 306 may prevent the release of the substance from the reservoir prior to the introduction of the sample fluid. However, when introducing the sample fluid, the preceding seal must be broken, in order to allow such introduction. In some embodiments, in order to allow mixing using pressure provided to the pressable portion of the reservoir, the reservoir should be sealed from both sides. Therefore, the preceding seal 306 may also be resealable after introduction of the sample fluid. Re-sealing of the seal 306 may allow mixing while avoiding an unintentional release of the output fluid from the reservoir, e.g., via channel 302.

As noted, the sample fluid may be introduced via the first opening using a carrier. In embodiments wherein the carrier is left in the cartridge after introduction of the sample fluid, re-sealing may prevent passage of fluid via any gap existing between the carrier and the first channel's internal surface.

Figure 4B:
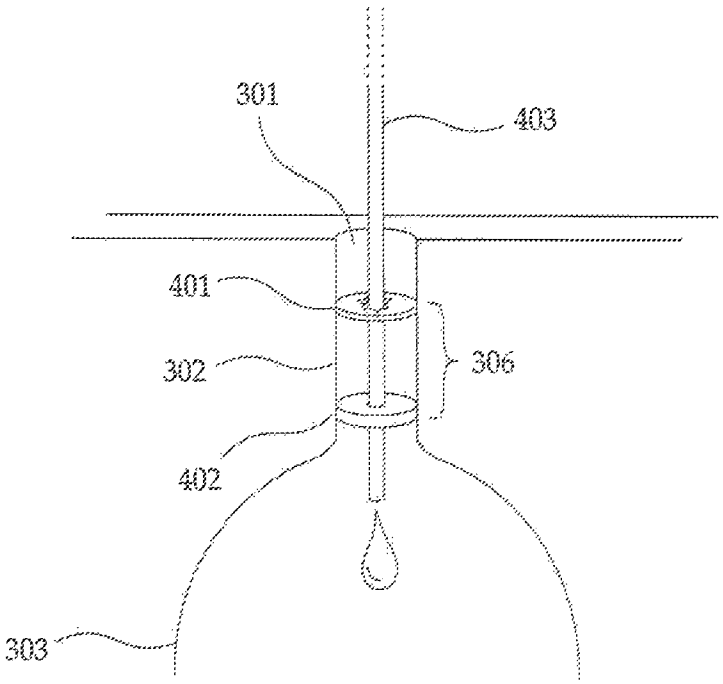
FIGS. 4A and 4B depict seals, according to some embodiments of the disclosure.
Figure 4A:
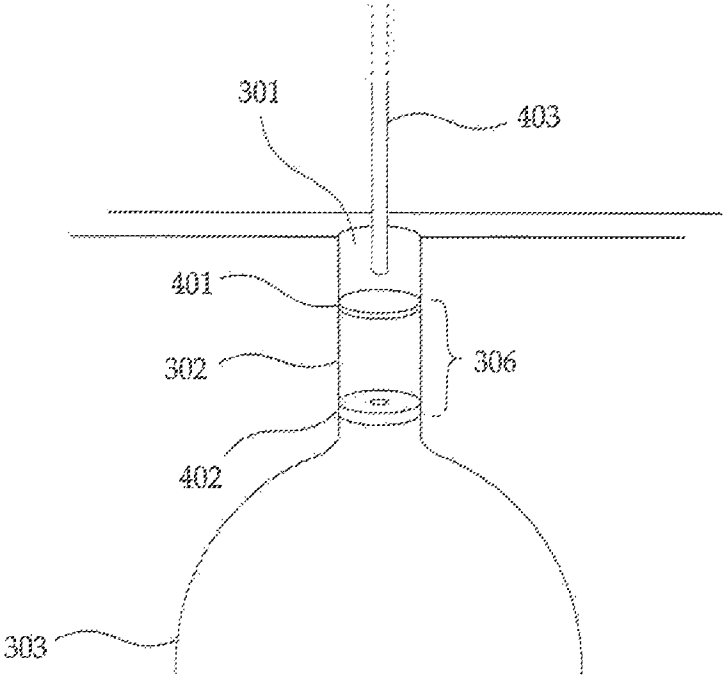

FIGS. 4A and 4B depict a preceding seal 306, according to certain embodiments of the disclosure. The embodiments shown FIGS. 4A and 4B are adapted for a carrier that remains inside the first channel subsequent to the delivery or introduction of the sample fluid.

In accordance with the illustrated embodiments, the depicted preceding seal 306 may be comprised of two separate seals, namely, a first seal 401 and a second seal 402. FIG. 4A depicts the preceding seal prior to introduction of the sample fluid using a carrier 403, while FIG. 4B depicts the seal when the carrier is inserted, penetrating the preceding seal 306.

The first seal 401 is configured to prevent flow from the reservoir via the first opening prior to introduction of the sample fluid (the first role mentioned above). Hence, similar to the succeeding seal, the first seal 401 may be a frangible seal, formed of adhesive or a plug. Upon insertion of the carrier 403 into the reservoir via the first opening, the carrier 403 breaks seal 401, as illustrated in FIG. 4B.

The second seal 402 may operate to re-seal the reservoir after the insertion of the carrier. The second seal is configured to prevent the leakage through the interface between the carrier, more accurately, the outer surface of the carrier, and the inner surface of the channel. According to certain embodiments, the seal 402 may be comprised of a flexible ring mounted inside the channel (e.g., an o-ring). The inner diameter of the ring is smaller than the diameter of the carrier. Thus, while the seal 402 allows the carrier to pass through, it may close tight around the carrier to prevent leakage. According to alternative embodiments, the first seal 401 and the second seal 402 may be swapped, that is, seal 402 may appear prior to the first seal 401.

Carrier 403 may be hollow. Thus, after the insertion thereof, flow or leakage out of the reservoir may occur into or through the hollow, inner space of the carrier. According to certain embodiments, illustrated and described, e.g., with reference to FIG. 14 below, this leakage may be prevented by a hydrophobic membrane located inside the carrier.

Figure 5B:
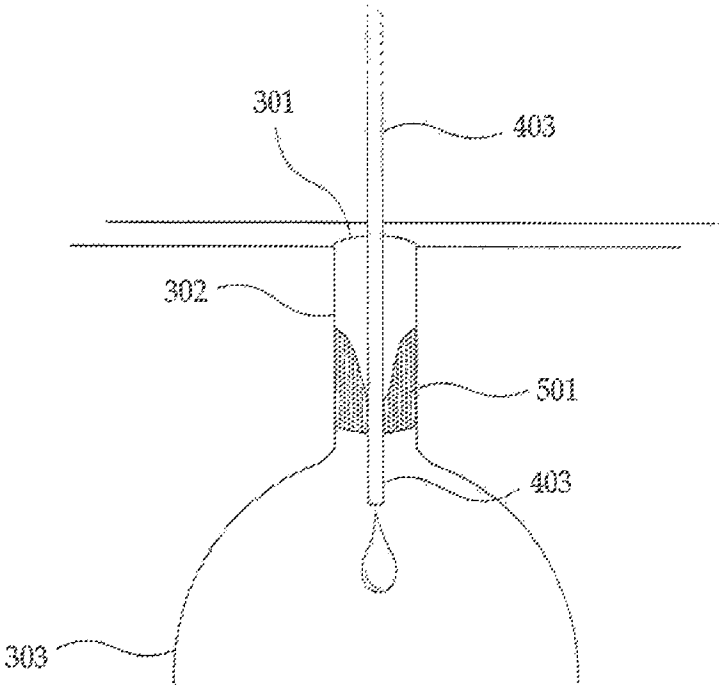
FIGS. 5A and 5B depict seals, according to some embodiments of the disclosure.
Figure 5A:
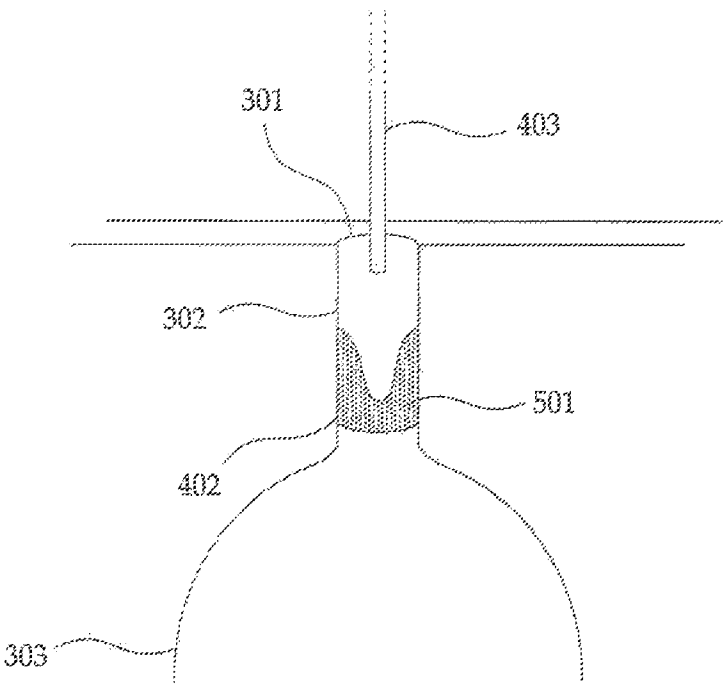

FIGS. 5A and 5B depict another preceding seal, according to certain embodiments of the disclosure. The seals shown in FIGS. 5A and 5B include a single member whose functionality is similar to the functionality of seals 401 and 402 in combination. For example, in FIG. 5A, a stopper 501 with centering shoulders is molded inside the first channel 302. Stopper 501 prevents flow from the reservoir via the first opening 301, prior to the introduction of the sample fluid. Upon insertion of a carrier 403, as illustrated by FIG. 5B, the center of the stopper 501 is breached, while the shoulders of the stopper block the interface between the outer surface of the carrier and the inner surface of the channel, preventing leakage further to the sample fluid introduction. According to certain embodiments, stopper 501 may be formed of a soft adhesive elastomer. Other materials may also be used to form stopper 501, however.

Figure 6B:
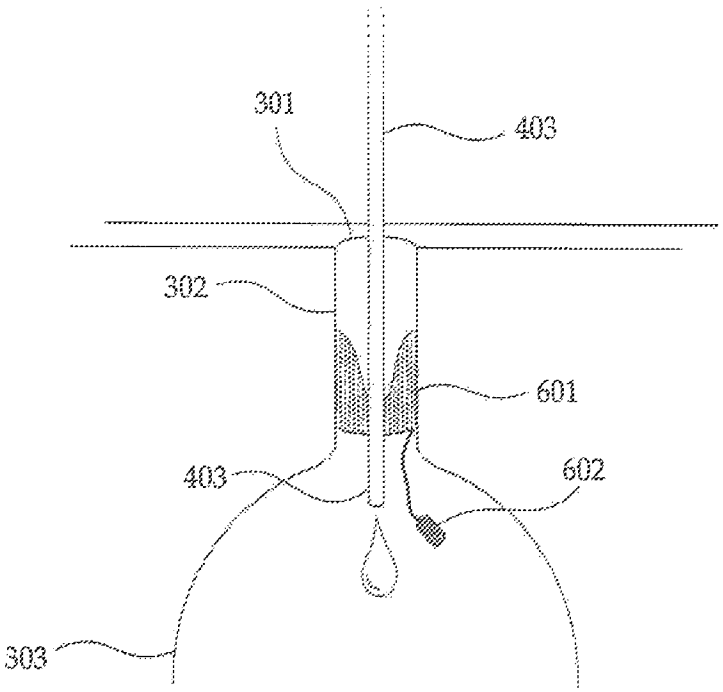
FIGS. 6A and 6B depict seals, according to some embodiments of the disclosure.
Figure 6A:
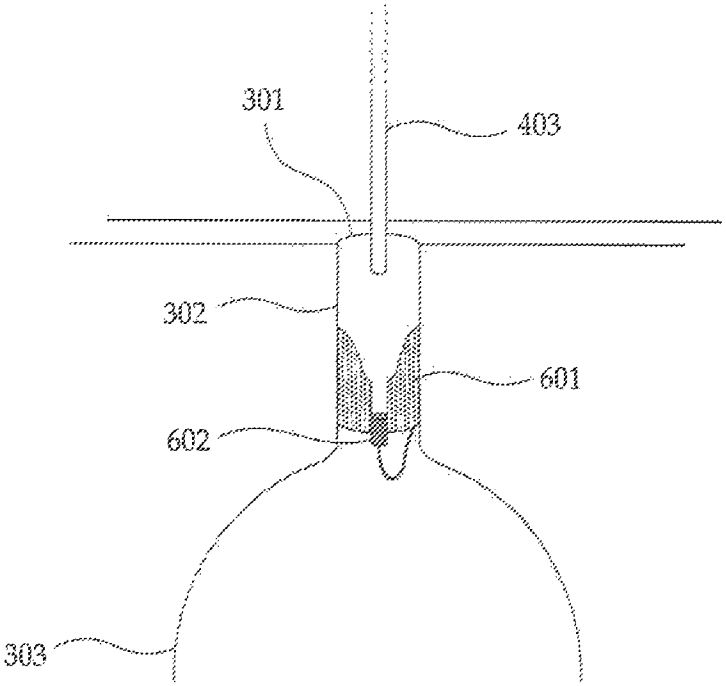

FIGS. 6A and 6B depict another alternative seal, according to certain embodiments of the disclosure. Seal 601 includes a single seal combining the functionality of the first and second seals (401 and 402) illustrated in FIGS. 4A and 4B. Unlike the stopper 501 (of FIG. 5) that is configured for being breached by the carrier, seal 601 includes an enjected eyelet with an integrated plug 602, configured for being fitted into the eyelet and pushed by the carrier upon insertion of carrier 403 into the eyelet. The eyelet of seal 601 and the plug 602 may comprise different units or may be integrally formed or otherwise coupled to form a single unit. As illustrated in FIG. 6A, the plug is coupled to the eyelet via a tether. In other embodiments, however, plug 602 may be coupled, e.g., to the reservoir or to the channel, or it may have no coupling mechanism.

According to FIG. 6A, prior to the introduction of the sample fluid, the plug is closed, and flow from, the reservoir via the first opening may be prevented. FIG. 6B illustrates introduction of sample fluid to the reservoir while using a carrier such as a capillary. Upon insertion of the carrier, the plug is pushed inwards, thus opening the channel, however the eyelet of seal 601 seals the interface between the outer surface of the carrier and the inner surface of the channel, preventing leakage thereby.

Still other configurations or seal arrangements may enable delivery of a sample fluid into the reservoir while unintended flow or leakage is avoided, e.g., after a carrier is withdrawn from the first channel. For example, a carrier such as a needle attached to a syringe may be used to deliver the sample fluid into the first reservoir. In such cases, the preceding seal may re-seal once the needle of the carrier is withdrawn. Such a seal may be referred to as a per se septum.

Certain embodiments may include a process of preparation of a sample fluid for analysis. For example, a carrier 403 of a sample fluid may be inserted via the first opening 301 into the first channel 302. The carrier breaches the preceding seal 306 coupled to the first channel and delivers the sample fluid into the reservoir 303. Inside the reservoir a procedure may be performed relative to the sample fluid, such as mixing the delivered sample fluid with a substance pre-loaded into the reservoir, thus obtaining an output fluid. Mixing may be enabled by applying an intermittent pressure on a pressable portion of the reservoir. Upon completion of the procedure, the succeeding seal 307 may be broken by pressing the reservoir in a manner that creates a super-threshold pressure at the position of the succeeding seal. The super-threshold pressure may result in opening of the seal 307 and a release of the obtained output fluid from the reservoir. The released output fluid may then flow via the second channel 304 and the second opening 305 into the analyzing compartment 203, wherein it can be subjected to analysis.

Figure 7:
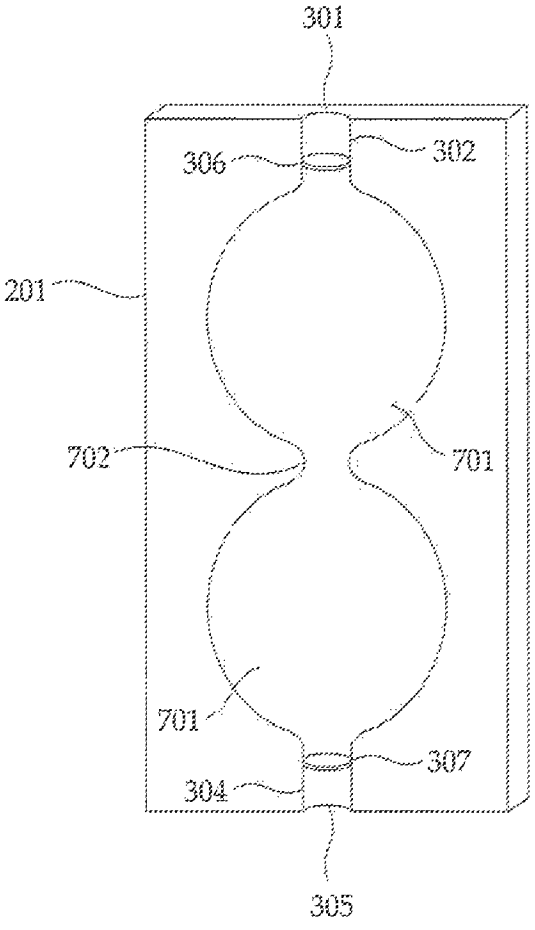
FIG. 7 shows a cartridge comprising a reservoir containing two compartments, according to some embodiments of the disclosure.

FIG. 7 shows a cartridge comprising a reservoir containing two compartments, according to certain embodiments of the disclosure. The two compartments 701, either or both of which may be pre-loaded with a substance, are interconnected by a flow path 702. The first compartment is coupled to the first opening 301 via a first channel 302, while the second compartment is coupled to the second opening 305 via a second channel 304. Either or both of the two of the compartments may include a pressable portion.

Where both compartments include pressable portions, it is possible to achieve mixing by alternating pressure applied to the two pressable portions (e.g., one compartment and then the other). The flow path 702 between the compartments 701 may cause jet flow to occur, which may enhance mixing. Breaking the succeeding seal 307 may be caused, e.g., by simultaneously pressing both compartments and/or by applying stronger pressure than a pressure applied for mixing.

In case that there is only one pressable portion, on one of the compartments, it may be possible to achieve mixing by intermittently pressing this portion. Breaking the succeeding seal 307 may be caused by applying a super-threshold pressure on the pressable portion.

Other embodiments may also be used. For example, instead of the two compartments illustrated in FIG. 7, some embodiments may include a single reservoir (e.g., similar to the reservoir illustrated in FIG. 3), which may include a partitioning member inside. An opening or even a valve in the partitioning member may function similarly to the flow path 702 shown in FIG. 7.

While some embodiments may include a single reservoir, other embodiments may include more than one reservoir. For example, in some embodiments, the cartridge may contain more than one reservoir, wherein the reservoirs are connected in series or in any other suitable configuration. In some instances, one or more reservoirs separated by frangible seals and connected together (e.g., in series) may constitute a "preparation unit." With respect to the embodiment of FIG. 3, the cartridge containing a single reservoir may provide one preparation unit. Similarly, the cartridge of FIG. 7 comprises one preparation unit containing a single reservoir.

Figure 8:
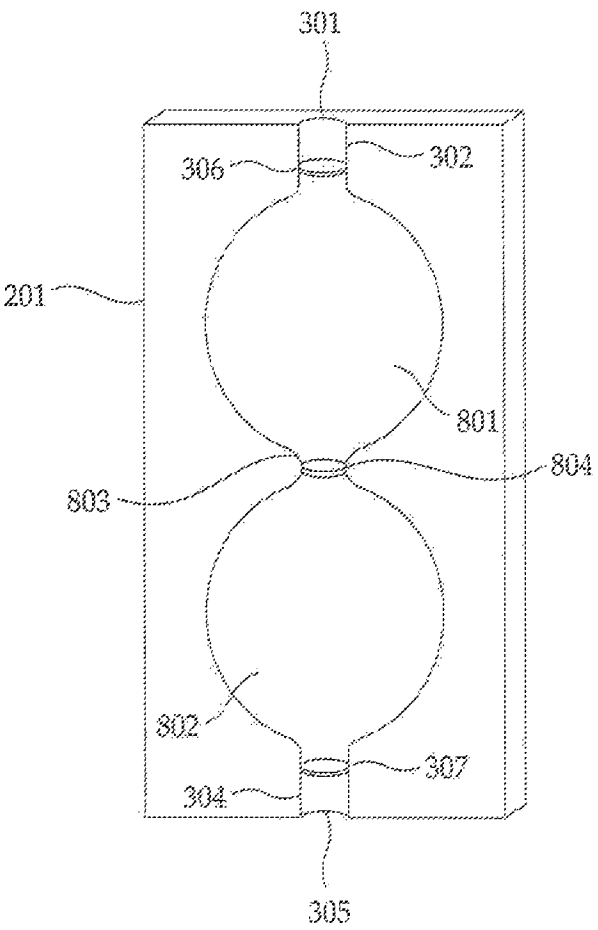
FIG. 8 shows a cartridge comprising a preparation unit composed of two reservoirs, according to some embodiments of the disclosure.

FIG. 8 shows a cartridge comprising a preparation unit composed of two reservoirs, according to certain embodiments of the disclosure. A first reservoir 801 coupled to a first opening 301 may comprise a pressable reservoir, while a second reservoir 802 coupled to a second opening 305, may comprise either a pressable or non-pressable reservoir. The two reservoirs may be connected by a connecting channel 803, which, in turn may be sealed by a seal 804. The two reservoirs may be located between seals 306 and 307, the first reservoir 801 being preceded by seal 306 and the second reservoir 802 being succeeded by a seal 307.

While each reservoir may be associated with a respective input fluid and a respective output fluid, the input fluid of the first reservoir 801, introduced thereto via the first opening, may include a sample fluid. Inside the first reservoir a procedure affecting the fluid may be performed. This procedure may be referred to as a "first procedure". Where the procedure includes mixing, it may be performed as described above with reference to FIG. 3. By affecting appropriate pressure on seal 804 (e.g., a super-threshold pressure associated with seal 804), it may be breached resulting in release of the output fluid from the first reservoir 801 such that the output fluid is conveyed to the second reservoir 802. The output fluid of the first reservoir may serve as an input fluid of the second reservoir.

Where seal 804 is a frangible seal, once the seal has been breached the channel 803 between the two reservoirs 801 and 802 may remain open, and fluid flow may be possible in both directions between reservoirs 801 and 802 (i.e., from 801 to 802 and from 802 to 801). Where seal 804 includes a frangible seal, once that seal is breached, the two reservoirs may form, in effect, two compartments of a single reservoir. Therefore, in embodiments having a frangible seal in the connecting channel 803, after breaching this seal, the output fluid of the first reservoir 801 can flow back and forth between the two former reservoirs and may be affected by any procedure associated with reservoir 801 or reservoir 802 when the fluid resides in those compartments. Further, after breaching a frangible seal 804 to effectively form a single reservoir with two compartments, the channel 803 connecting the two compartments of the single reservoir may be referred to as coupling "compartment" 801 with "compartment" 802 and, therefore, with opening 305.

In other embodiments, for example, where seal 804 is re-sealable, after conveying the output fluid of reservoir 801 to reservoir 802, seal 804 may be re-sealed such that fluid may be precluded from traveling back to reservoir 801. An example of a re-sealable seal may include a valve. Alternatively or additionally, certain embodiments may include a re-sealable connecting channel 803, where re-sealing may be performed, for example, by reintroducing pressure to the connecting channel 803 to physically block the opening of channel 803 and prevent fluid from flowing through channel 803.

Inside the second reservoir 802, a "second procedure" may be performed. By causing an appropriate pressure level on seal 307, that seal may be breached, thus resulting in release of the output fluid from the second reservoir 802 towards the second opening 305. The output fluid of the second reservoir may constitute an output fluid of the preparation unit formed based on reservoirs 801 and 802. The output fluid of the preparation unit may flow via the second opening 305 into an analyzing compartment (such as analyzing compartment 203 of FIG. 2), wherein it may be subjected to analysis.

The embodiments described above are non-limiting. A preparation unit may be comprised of one reservoir, two reservoirs, or more than two reservoirs. A preparation unit may be comprised of one or more reservoirs connected in series, each reservoir being separated by frangible seals. Each reservoir may be configured for receiving an input fluid, performing a procedure affecting the fluid thereby generating an output fluid, and releasing the output fluid. A first reservoir of the one or more reservoirs may be coupled to a first opening, while a second or last reservoir may coupled to a second or last opening. A first reservoir may include a pressable reservoir. The preparation unit may include additional pressable reservoirs. The input fluid of the first reservoir may include a sample fluid while the input fluid of any of the other reservoirs may include the output fluid of a different reservoir (e.g., a preceding reservoir). The output fluid of the last reservoir may comprise the output fluid of the preparation unit to be subjected to analysis.

It is noted that according to certain embodiments in a preparation unit including, e.g., two reservoirs, it is possible to apply pressure on the first reservoir in order to breach the seal in between. Alternatively, the seal may be breached by applying pressure on the second reservoir or by applying pressure to both reservoirs. Any or all seals included in a preparation unit may be frangible or re-sealable depending on the requirements of a particular application.

Each reservoir in a preparation unit may be configured to perform or otherwise associated with a particular procedure. For example, if a first reservoir obtains the sample fluid, the procedure associated with the first reservoir may affects this sample fluid, yielding a derivative of the sample fluid. The derivative may include a change having occurred in either or both of the sample fluid or in cells or components contained within the sample fluid. The change may include a chemical change, a biochemical change, a physical change, etc. Examples of a chemical change may include a change in pH, oxidation/reduction of cellular components or hinging of chemical agents, such as dyes thereto; examples of a biochemical change may include binding of antibodies to ligands; and examples of physical changes may include changes in viscoelastic properties, in temperature or in concentration of diluents. In some embodiments, the sample fluid may be considered as a derivative of itself, i.e., a derivative of the sample fluid. Hence, a procedure may obtain as input a derivative of the sample fluid and yield an output which is a derivative of the derivative. In such embodiments, an input to the reservoir may be referred to a first derivative of the sample fluid, and the output of the reservoir may be referred to as a second derivative of the sample fluid. The same reference scheme may be used to refer to all reservoirs in a preparation unit: each reservoir may obtain an input fluid which is a derivative of the sample fluid. A first process performed on the sample fluid may provide a first derivative of the sample fluid, a second process performed to the first derivative of the sample fluid may provide a second derivative of the sample fluid, and so on for each process associated with the reservoirs of a preparation unit.

Because the reservoirs may be consecutively arranged, the procedures may also occur consecutively. For example, the procedure of a certain reservoir in a series may yield a second derivative of the sample fluid, which becomes the output of the reservoir. The next reservoir may obtain the second derivative as an input from the preceding reservoir and provide a third derivative of the sample fluid. This chain may last, until the final reservoir conveys its respective derivative of the sample fluid towards the final opening. In some cases, the output of one reservoir is not merely passed in series to a following reservoir. Rather, in some cases, a seal, such as a frangible seal, between two reservoirs may be opened, and any fluid in the two reservoirs may mix to create a new derivative of the sample fluid. Notably, however, the new derivative may be shared across both of the two reservoirs (e.g., through a back and forth mixing process) such that at least some of the new derivative fluid resides in both reservoirs.

An example for consecutive procedures may include an immune-labeling of cells: labeling with a primary antibody may be performed in a first reservoir followed by a consecutive labeling with a secondary antibody, performed in a second reservoir. Another example may include differential staining of white blood cells of a blood sample, with two staining reagents, that must be separated during storage. A procedure of staining with a first reagent, performed in a first reservoir, may be followed by staining with a second reagent, performed in a consecutive, possibly last reservoir.

It should be appreciated that in accordance with embodiments of the present disclosure the procedure may be performed inside the reservoirs, wherein each reservoir adds a stage in the preparation of the output fluid, all together resulting in a cumulative continuous process. This process may result in efficient and complete mixing of the fluid and the reagents.

Figure 9A:
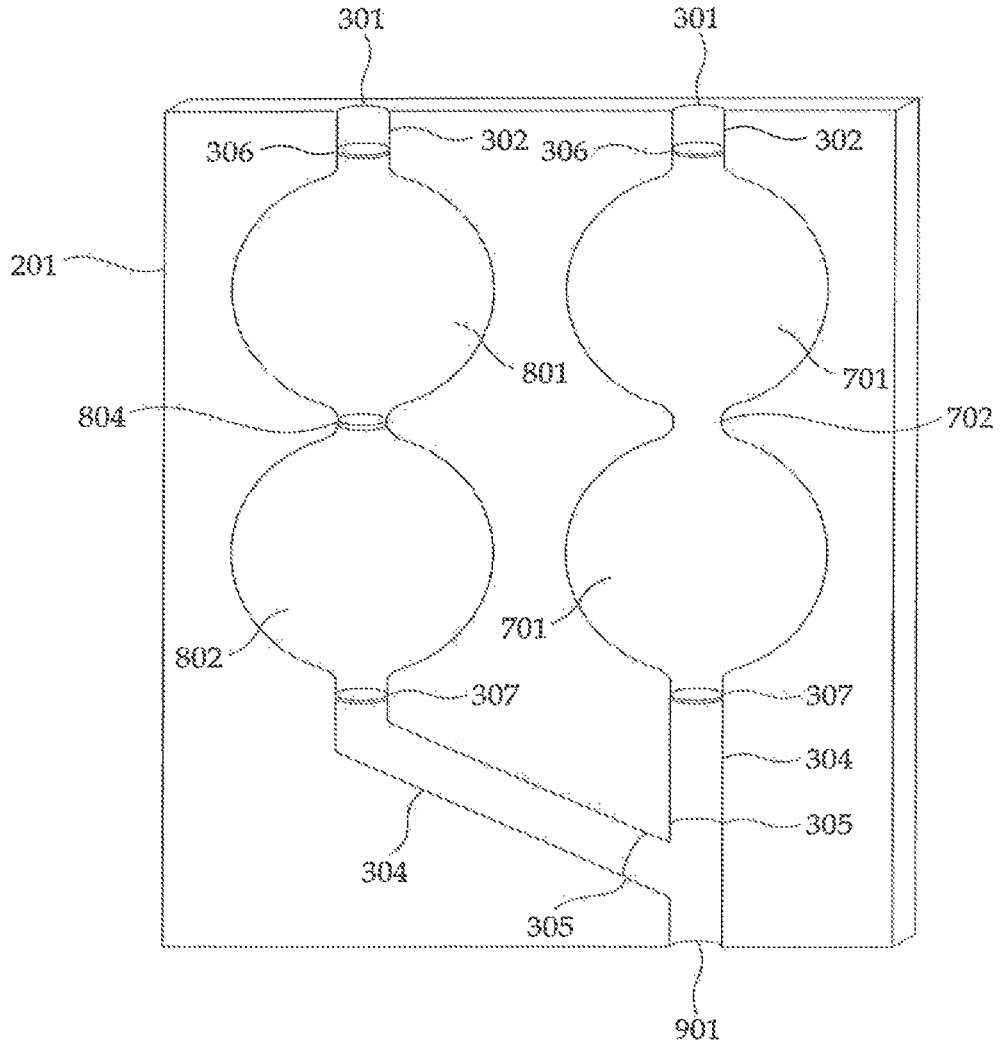
FIGS. 9A and 9B present two configurations of a cartridge comprising more than one preparation unit, according to some embodiments of the disclosure.
Figure 9B:
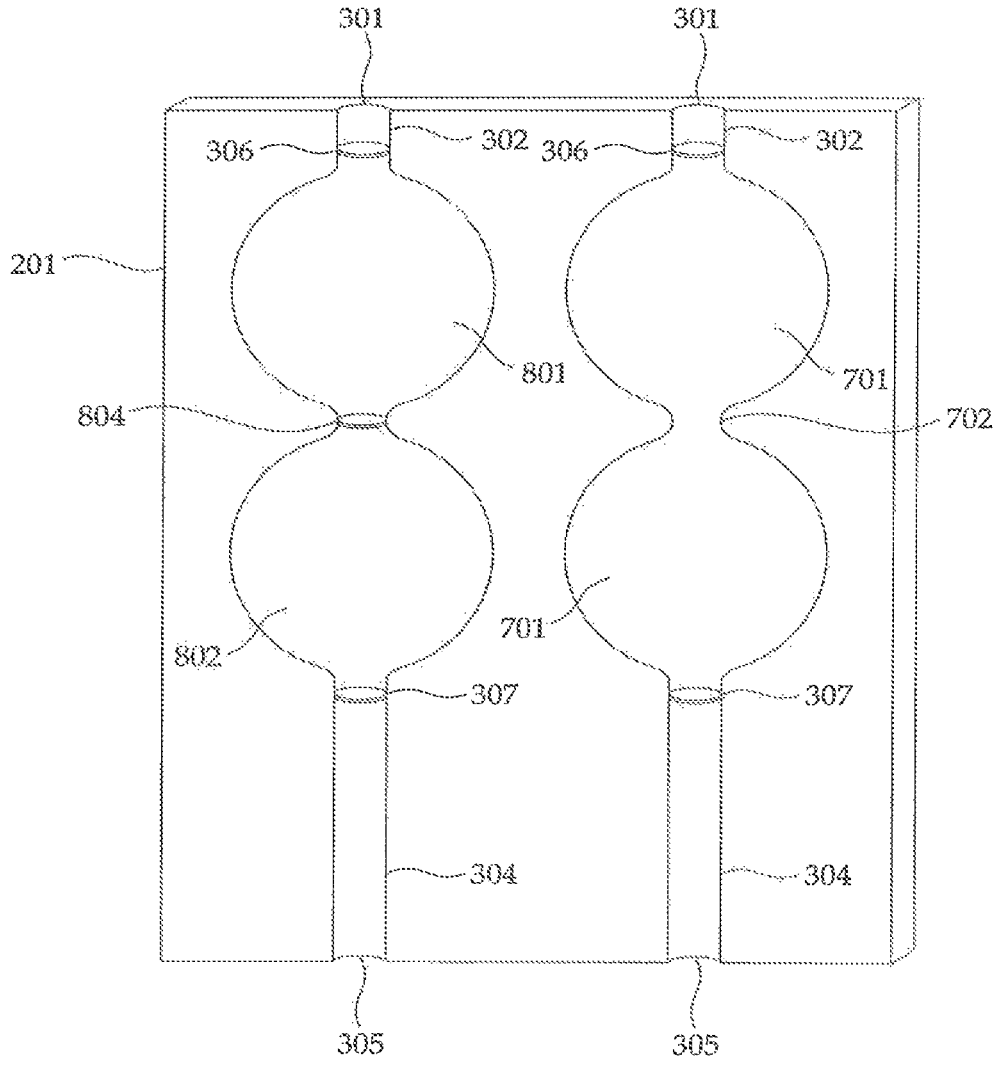

FIGS. 9A and 9B illustrate two configurations of a cartridge each comprising two preparation units, according to certain embodiments of the disclosure. One of the preparation units, as shown in both FIG. 9A and FIG. 9B, comprises a single reservoir containing two interconnected compartments 701. Such a preparation unit has been described above with reference to FIG. 7. The other preparation unit shown in both FIG. 9A and FIG. 9B comprises two reservoirs 801 and 802 connected by a channel 803 and sealed by a seal 804. Such a preparation unit has been described above with reference to FIG. 8. Each preparation unit has a respective first opening 301 and a respective second opening 305. The first openings of both preparation units may constitute the first openings of the cartridge.

The two configurations of the cartridge, depicted by FIGS. 9A and 9B, differ relative to the second opening provided as an outlet to the combination of preparation units. For example, in one embodiment, the cartridge depicted at FIG. 9A may include a single cartridge second opening 901 which is in fluid communication with the second openings 305 of the respective preparation units. In another embodiment, the cartridge depicted by FIG. 9B may include a second opening 305 associated with each preparation unit, where each of the second openings 305 also constitute outlets of the preparation compartment 201.

In the described embodiments, each preparation unit of a cartridge may be configured for receiving of a sample fluid from a respective carrier. In other embodiments, however, a single carrier may be structured such that the single carrier may introduce a sample fluid into a plurality of preparation units of a cartridge. The sample fluid may be introduced into the preparation units of a cartridge simultaneously or at different times.

The output fluid of each preparation unit may flow into the analyzing compartment at different times. Further, the output fluid of each preparation unit may be subjected to separate analysis processes.

Embodiments including two parallel preparation units may enable performance of two separate independent procedures relative to the sample fluid. For example, in certain embodiments, the cartridge may be configured for performing a complete blood count. In such embodiments, the cartridge may comprise two parallel preparation units, where one preparation unit is configured for preparation of red blood cells for analysis, and the other preparation unit is configured for preparation of white blood cells for analysis.

Although the cartridges depicted by FIGS. 9A and 9B comprise two preparation units, other configurations may also be used depending on the requirements of a particular application. The number of preparation units included in a cartridge, as well as the number of reservoirs included in each preparation unit, and the number of reservoirs containing more than one compartment may differ, as the configuration of a cartridge may be tailored for performance of desired procedures and/or for purpose of preparing the sample fluid for certain analysis procedures.

Figure 10:
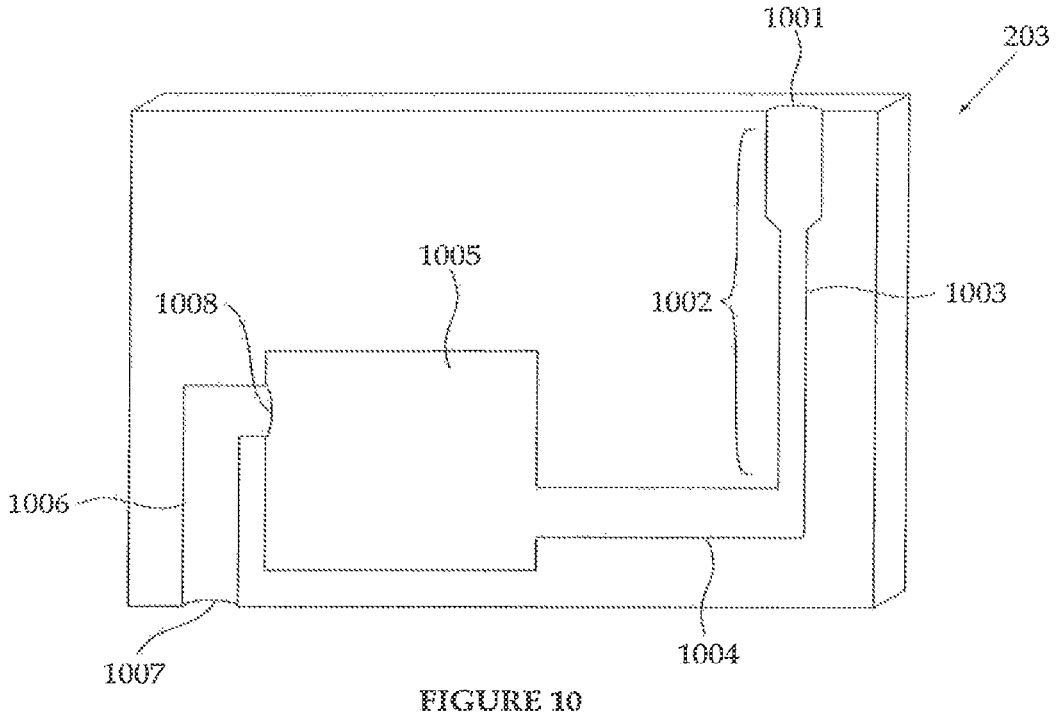
FIG. 10 diagrammatically illustrates an analyzing compartment, according to some embodiments of the disclosure.

FIG. 10 diagrammatically illustrates an analyzing compartment 203, according to certain embodiments of the disclosure. The analyzing compartment 203 may include an analysis vessel 1002, configured for receiving the output fluid conveyed by a preparation unit or units and for presenting the output fluid in a manner that allows analysis of the output fluid. A third channel 1004 may be coupled to the analysis vessel 1002 and may be configured for emptying disposable output fluid therefrom. In some embodiments, the analysis vessel and the third channel together may comprise an analyzing unit. A waste container 1005 configured for storing disposed output fluid may be coupled to the analysis unit via the third channel 1004. The waste container 1005 may also coupled to a vacuum pump, such as vacuum pump 104 via a fourth channel 1006 and opening 1007.

An output fluid may flow from a preparation unit into the analyzing unit 203 via a third opening 1001. Inside the analysis vessel 1002, the output fluid may be presented to an analyzing system 101. After being subjected to analysis, the output fluid may be disposed via the third channel 1004 into the waste container 1005 and stored therein.

The flow of the output fluid inside the analyzing unit may be driven by a suction force generated by the vacuum pump 104, which may be included as part of the analyzing system 101. The vacuum pump may be coupleable to the analyzing unit through opening 1007, fourth channel 1006, opening 1008, and waste container 1005. Although the suction force may be applied to the waste container 1005, the stored output fluid may not flow out therefrom. Instead, the waste container may be designed as a liquid trap. Opening 1008 may be located above the level of the stored output fluid in container 1005 in order to provide a liquid trap.

In some embodiments, analysis vessel 1002 may a micro channel 1003 configured to align cells contained in the output fluid into a pattern facilitating analysis. For example, in some embodiments, micro channel 1003 may align flowing cells in the output fluid into a single plane, which may facilitate acquisition of images of the flowing cells by a camera 107. In other embodiments, such cells may be probed by a focused light beam/laser beam, in a cytometer for example. The aligning of the cells may be performed by a method known as viscoelastic focusing. Viscoelastic focusing is described in PCT Publication No. WO2008/149365 entitled "Systems and Methods for Focusing Particles", while a microchannel configured for viscoelastic focusing is further described in PCT Publication WO2010/013238, entitled "Microfluidic System and Method for Manufacturing the Same", both of which are incorporated herein by reference. The aligned cells may then be optically analyzed, through a transparent or translucent surface (e.g., viewing area) of the microchannel 1003.

Figure 11:
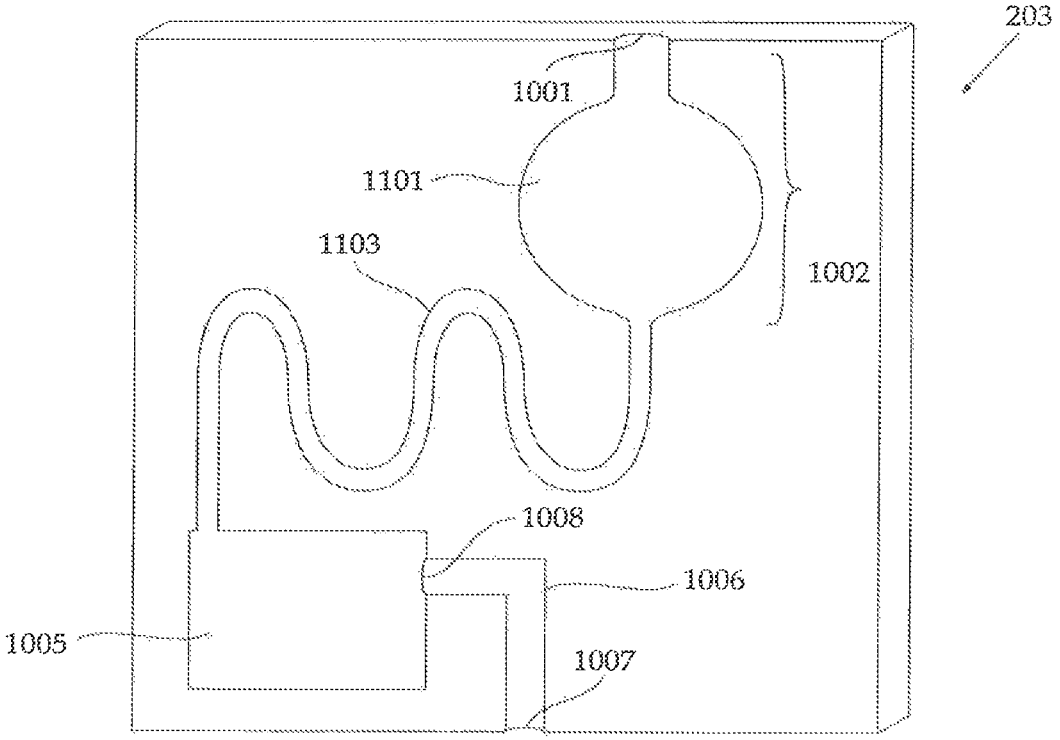
FIG. 11 diagrammatically illustrates an analyzing compartment, according to some embodiments of the disclosure.

FIG. 11 schematically illustrates another analyzing compartment 203, according to certain embodiments of the disclosure. The analyzing compartment 203 of FIG. 11 may be configured for determination of blood hemoglobin level. This compartment may include an analysis vessel 1002 which may include an analyzing reservoir 1101 coupled to a third channel 1103. Channel 1103 may include a small cross section and a long length relative to analyzing reservoir 1101, for example.

The analyzing reservoir 1101 may contain a powdered oxidizing agent and/or a lysing agent. The agent may be Soduim Dodecyl Sulfate (SDS), TritonX or another suitable oxidizing/lysing agent. When the reservoir 1101 is filled with the output fluid, which may include a derivative of a blood sample, the oxidizing agent may be dissolved. The dissolved oxidizing agent lyses the red blood cells of the derivative of the blood sample, which may lead to release of hemoglobin. The released hemoglobin may then be oxidized by the oxidizing agent to form methemoglobin (which is a form of hemoglobin which cannot release bound oxygen). Concentration of methemoglobin may then be determined using a spectrometer, by measuring an absorption of one or more wavelengths. Thus, in some embodiments, the analyzing module 105 of system 101 (see FIG. 1) may include a spectrometer.

According to certain embodiments, a powdered agent may freely reside inside reservoir 1101. Alternatively, the powdered agent may coat the inner surface of the reservoir 1101. To enlarge the contact area between the agent and the derivative of the blood sample, according to certain embodiments, the inner surface of the reservoir may contain projections such as pillars, baffles, or other structures, coated with the agent. Alternatively or additionally, a powdered oxidizing agent may be attached to a carrier, such as sponge, that resides in (e.g., fills) the reservoir. In addition to powdered agents, other agents, such as gels, for example, may be used.

Hemoglobin oxidation and absorption measurements may require a certain amount of time for each. Accordingly, the derivative of the blood sample may be retained inside the analyzing reservoir for a suitable period of time. In some embodiments, it may be possible to achieve retention of the sample fluid in the analyzing reservoir by applying resistance to the flow, hence slowing it down. One way for applying such resistance may be by means of a long third channel 1003 having a small cross section coupled to the analyzing reservoir 1101. When the channel is empty, no resistance or a low resistance to flow may be provided. Under such conditions, the derivative of the blood sample may flow freely into the analysis vessel 1002 and the analyzing reservoir 1101 via the third opening 1001. However, filling the third channel with a derivative of the blood sample may cause the resistance to increase, which may slow or halt flow in the analyzing reservoir 1101.

Figure 12:
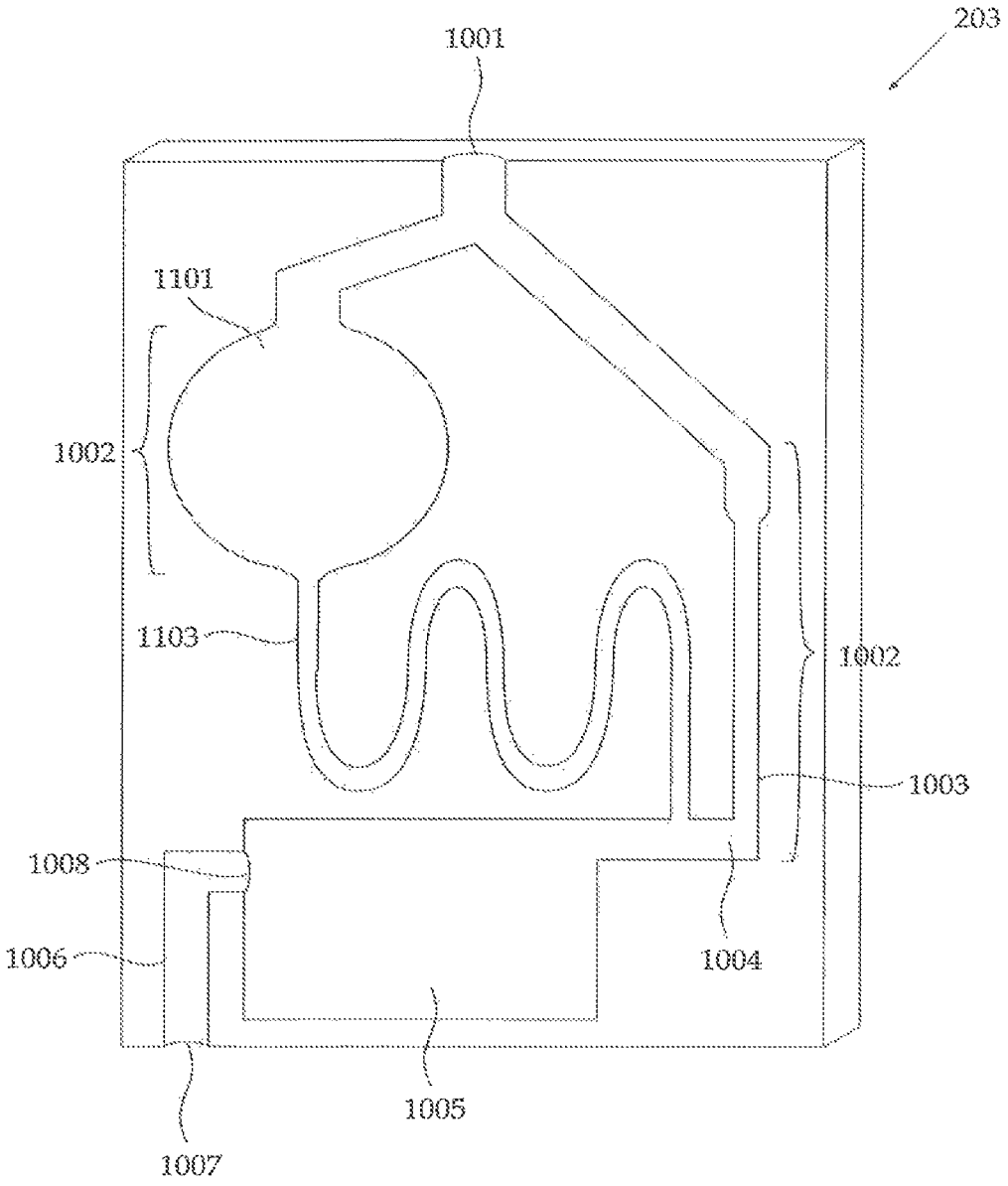
FIG. 12 diagrammatically illustrates an analyzing compartment, comprising two analyzing units, according to some embodiments of the disclosure.

FIG. 12 diagrammatically illustrates an analyzing compartment 203, comprising two analyzing units, according to certain embodiments of the disclosure. One of the analytical units comprises a microchannel 1003, similar to the analyzing unit depicted in FIG. 10. The other analyzing unit comprises an analyzing reservoir 1101, similar to the analyzing unit depicted in FIG. 11. In some embodiments, the two analyzing units may be coupled on one side to a third opening 1001 for purposes of obtaining the output fluid from one or more preparation units. On the other side the analyzing units may be coupled to the waste container 1005, wherein disposable fluid may be disposed. In some embodiments, the two analyzing units may be configured in parallel, as shown in FIG. 12.

It is noted that such parallel arranged analyzing units within an analyzing compartment may enable performance in parallel of two separate types of analysis of the output fluid. For example, using the analytical compartment depicted by FIG. 12, cell counting and measuring of hemoglobin level of a derivative of a blood sample may be performed. The two types of analysis may be performed using different analyzing modules 105 in system 101 (see FIG. 1), e.g., a camera, a spectrometer, etc.

Figure 13A:
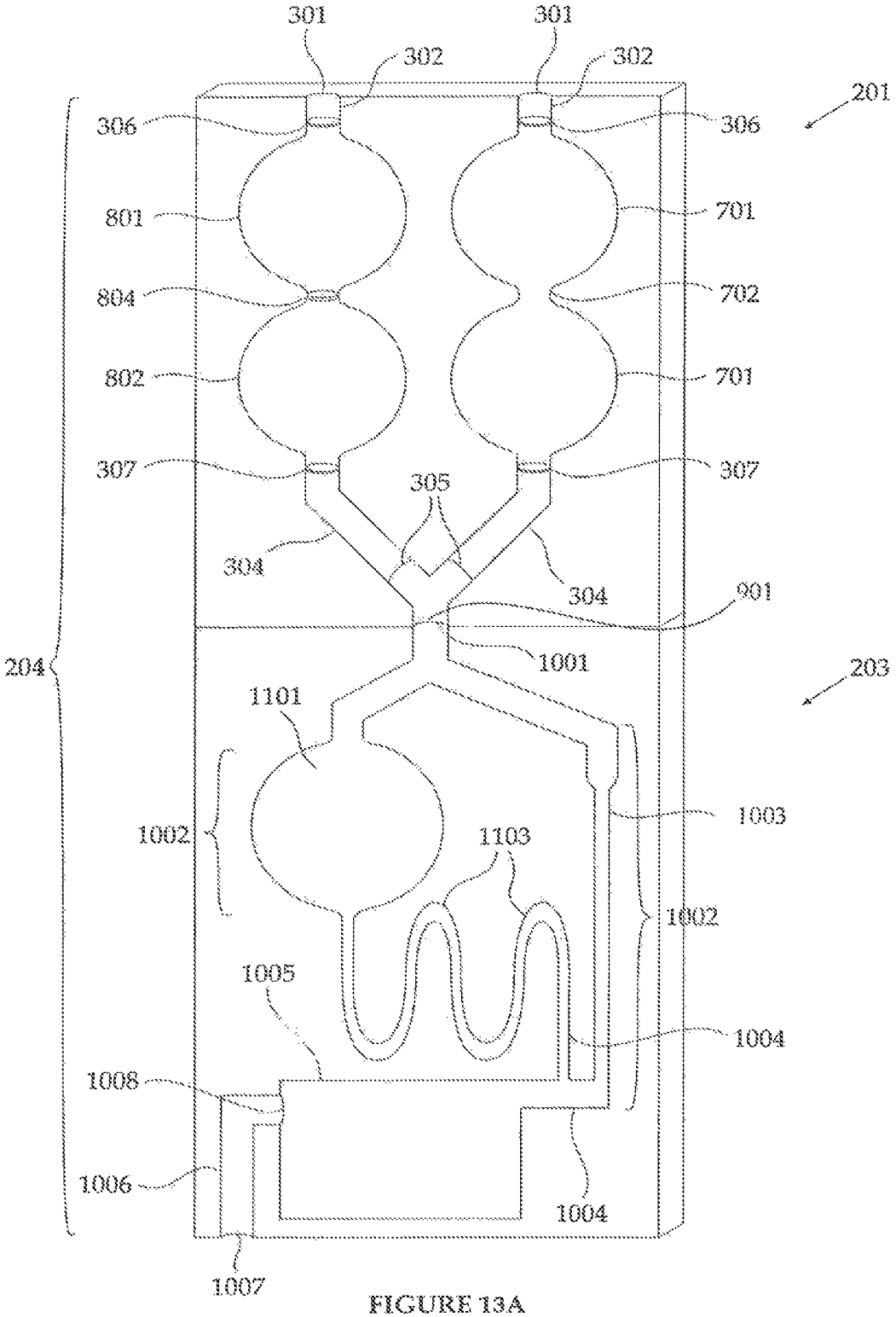
FIGS. 13A and 13B diagrammatically illustrate a cartridge comprising a preparation compartment and an analyzing compartment, according to some embodiments of the disclosure.
Figure 13B:
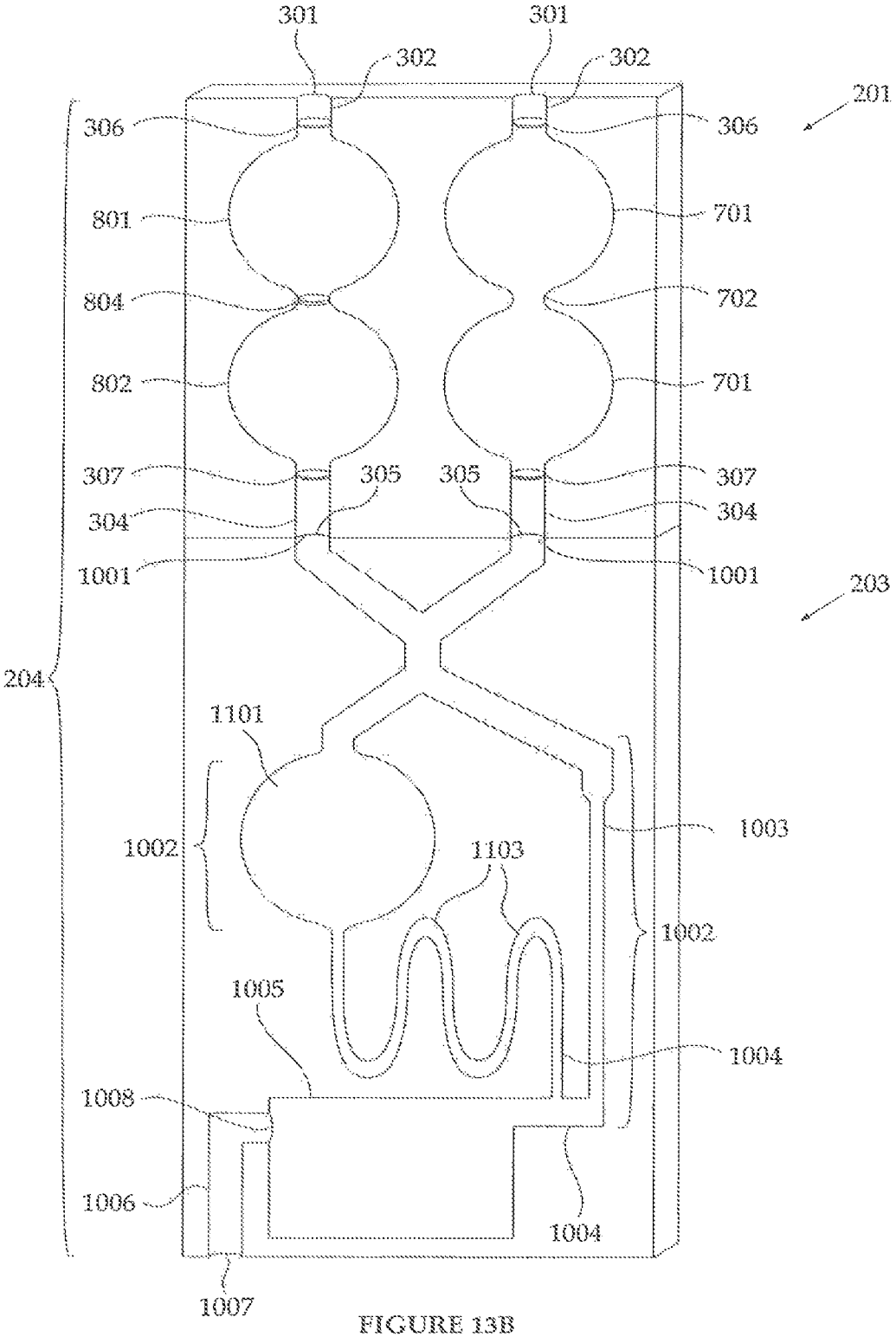

FIGS. 13A and 13B show a cartridge comprising a preparation compartment 201 and an analyzing compartment 203, according to certain embodiments of the disclosure. Preparation compartment 201 of the cartridge 204 has been described above, with reference to FIGS. 9A and 9B. In the example presented in FIGS. 13A and 13B, the preparation compartment may include two preparation units, the first unit and the second unit. The first preparation unit, which may include a single reservoir containing two interconnected compartments 701, has been described above relative to FIG. 7. The second preparation unit, comprising two reservoirs 801 and 802, has been described in detail above, with reference to FIG. 8.

The analyzing compartment 203 of a cartridge 204 has been described in detail above, with reference to FIG. 12. The analyzing compartment may contain two analyzing units. One of the analyzing units, comprising a microchannel 1003, may be configured to align cells contained in the output fluid into a single plane allowing taking images of the flowing cells using a camera, or probed by a focused light beam/laser beam as done in a cytometer. This analysing unit has been described in detail above, with reference to FIG. 10. The other analyzing unit, comprising an analyzing reservoir 1101 coupled to a long small cross-sectioned third channel 1004, may be configured for determination of hemoglobin level, e.g., using a spectrometer. This analyzing unit has been described in detail above, with reference to FIG. 11.

To allow flow of the output fluid prepared for analysis from the preparation compartment 201 to the analysis compartment 203, the two compartments may be interconnected by means of the opening 901 of the preparation compartment coupled to opening 1001 of the analyzing compartment.

According to certain embodiments, cartridge 204 may be configured to receive a blood sample and may enable performance of a blood count. A blood count performed by the cartridge 204 may include determination of number of red blood cells, white blood cells (total count) and platelets present in the sample, as well as determination of number of each of the white blood cell types (differential count). The white blood cell types may be neutrophils, lymphocytes, monocytes, eosinophils and monocytes or part thereof. Additional types and sub-types of white blood cells may also be counted. Furthermore, the disclosed embodiments may be applicable to any type of cells circulating in the blood, including, e.g., circulating tumor cells, platelets aggregates and others.

In the described embodiments, cell counting may be performed by means of acquiring images of flowing cells by a camera or by probing by a focused light beam/laser beam as done in a cytometer. In order to allow reliable counting, the cells may be brought into a focal place of the analyzing optics. Hence, the cells should be aligned in a single plane, e.g., by viscoelastic focusing. The method is based on suspending cells in a focusing medium of certain viscoelastic properties causing the cells suspended therein to align into a single plane if being flowed in a microchannel of a certain geometry (e.g., having a length of greater than 100 microns and at least one cross-sectional dimension less than 100 microns, e.g., between 5 microns and 100 microns). Preparation of a sample fluid for counting, performed in preparation compartment 201 of a cartridge 204, may include adding focusing media to the sample fluid, thus yielding a derivative of the sample fluid.

The first preparation unit may be configured for preparing a blood sample for determination of number of red blood cells, white blood cells (total count) and platelets present therewithin. A substance contained in reservoir 701 comprises focusing medium with added surfactants. The focusing medium may include a buffer containing, for example, soluble high molecular weight polymers. The buffer may include any isotonic buffer suitable for managing living cells, including, for example, Phosphate Buffered Saline (PBS). Examples of soluble polymers suitable for providing the blood sample with viscoelastic properties include polyacrylamide (PAA), polyethylene glycol (PEG), Propylene Glycol, etc. The surfactants added to a focusing media may act as sphering agents that may cause the shape of red blood cells to change from biconcave discs into spheres, which may facilitate acquisition of higher quality images of the cells. Examples of surfactants include SDS (Sodium Dodecyl Sylphate) and DDAPS (dodecyldimethylammoniopropanesulfonate). The composition of the focusing medium is disclosed, e.g., in PCT Publication No. WO2008/149365 entitled "Systems and Methods for Focusing Particles", which is incorporated herein by reference.

The procedure performed by reservoir 701 may include mixing of the delivered blood sample with a focusing medium. After mixing has been completed, the succeeding seal 307 may be breached by pressure, allowing the generated output fluid to flow into the analytical compartment 203

The second preparation unit may be configured for preparing a blood sample for differential count of white blood cell types. In certain embodiments, the preparation may include chemical staining of cells, where two consecutive staining procedures may be performed in reservoirs 801 and 802 of the preparation unit.

The substance contained in reservoir 801 may comprise cell staining reagents dissolved in a focusing medium. Examples of cell staining reagents include Phloxine B, Biebrich Scarlet and Basic Orange 21. As a fixation of cells may be needed in some cases, fixating reagents, including, for example, formaldehyde or formalin, may also be included. Following mixing of the blood sample with the substance, an incubation may be performed, allowing staining. Upon expiration of a predetermined incubation time, a seal 804 separating reservoir 801 from reservoir 802 may be breached by pressure, resulting in release of the generated output fluid towards the reservoir 802.

The substance contained in reservoir 802 may comprise other cell staining reagents dissolved in a focusing medium.

Examples of cell staining reagents included in reservoir 802 may include Methyl Green, Methylene Blue and Barrel's Blue. Following mixing of an input fluid (which constitutes the output fluid of reservoir 801) with a substance, a second incubation may be performed, allowing the second staining process to occur. Upon expiration of a second predetermined incubation time the seal 307 of the second preparation unit may be breached by pressure allowing the generated output fluid to flow into the analytical compartment 203.

In some embodiments, preparation of cells for analysis may include immuno-based staining of the cells. In these embodiments, one or both reservoirs of a preparation unit may contain reagents suitable for immune-staining, where the reagents and the focusing medium may be contained within a single reservoir or in different reservoirs. Examples of reagents suitable for immune-staining include antibody-coated micro beads of different colors, such as CD14/CD15 and a combination of stains.

The output fluids flowing out of the second openings 305 of both preparation units may be conveyed to a single channel that is coupled to the analysis vessels of both analyzing units. Analysis of the output fluids may be performed sequentially or simultaneously. The sequential analysis may be enabled by temporally separating flows of the two output fluids, a separation that may be controlled in the preparation compartment. As described above, the preparation process performed by a first preparation unit may include mixing in a single reservoir without incubation, while the preparation process performed by a second preparation unit may include, in addition to mixing in two different reservoirs, two staining procedures that may require incubation time. Hence, the output fluid of the first preparation unit may be ready to flow into the analyzing compartment before the output fluid of the second preparation unit is ready to flow into the analyzing compartment.

Upon flowing into the analyzing compartment 203, the output fluid of the first preparation unit may be divided between the two illustrated analyzing units. Part of the fluid may enter the microchannel 1003, wherein the cells within the output fluid may become aligned into a single plane via viscoelastic focusing, for example. The aligned cells may then be optically analyzed, through a transparent or translucent surface or window associated with microchannel 1003. The output fluid then flows into waste container 1005, wherein it may be stored.

The other part of the output fluid may enter the analyzing reservoir 1101, wherein the cells within the output fluid become lyzed and their hemoglobin content quantified in a way described with reference to FIG. 11.

The flow of the output fluid of the first preparation unit into the analyzing compartment may be aborted prior to breaching the seal 307 of the second preparation unit in order to minimize or prevent mixing of the output fluids, which could hinder the analysis. This is enabled due the second channel 304 of the first preparation unit being re-sealable. The re-sealing of the channel may be performed, for example, by pressure applied to the succeeding seal or to another area of the second channel 304 of the first preparation unit.

As described above, the length and cross-sectional shape of the third channel 1103 coupled to reservoir 1101, may provide resistance to flow at the reservoir, especially under certain conditions. Hence, upon breaching seal 307 of the second preparation unit, substantially all the output fluid may flow into the analyzing compartment 203 and may be conveyed to the microchannel 1003 instead of being split between the two analysis units. Inside the microchannel 1003, the cells within the output fluid of the second preparation unit may become aligned into a single plane hence allowing optical analysis. The output fluid may then flows into the waste container 1005, wherein it is stored.

Figure 14A:
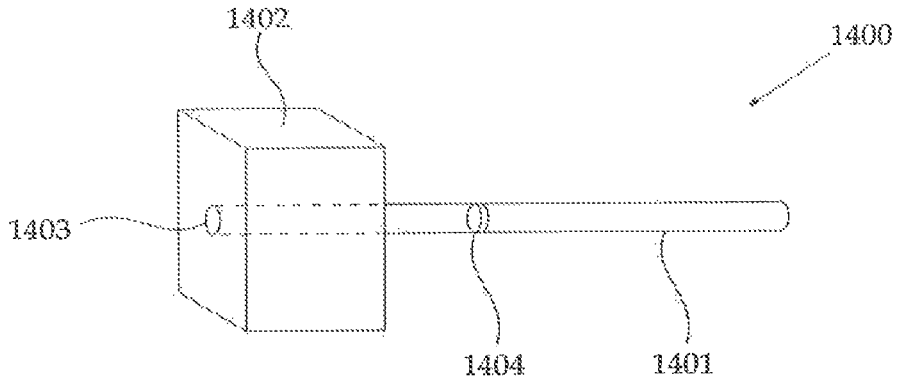
FIGS. 14A, 14B and 14C diagrammatically depict samplers, according to some embodiments of the disclosure.
Figure 14B:
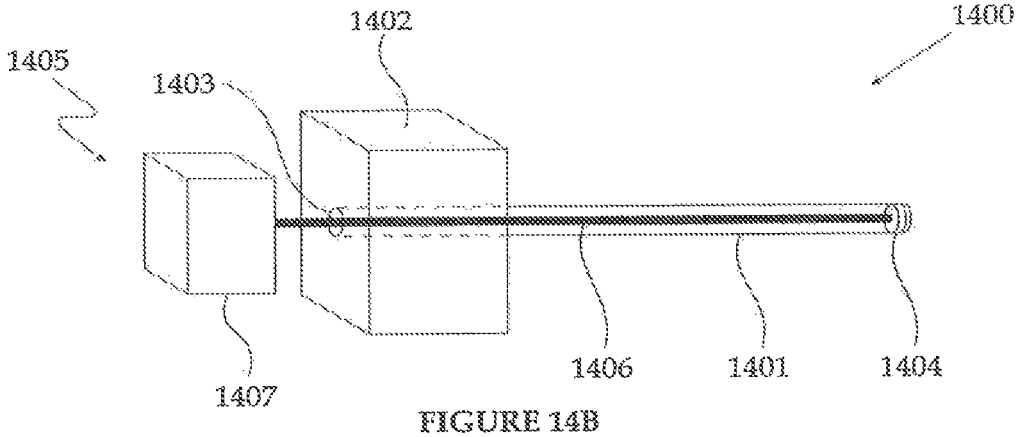
Figure 14C:
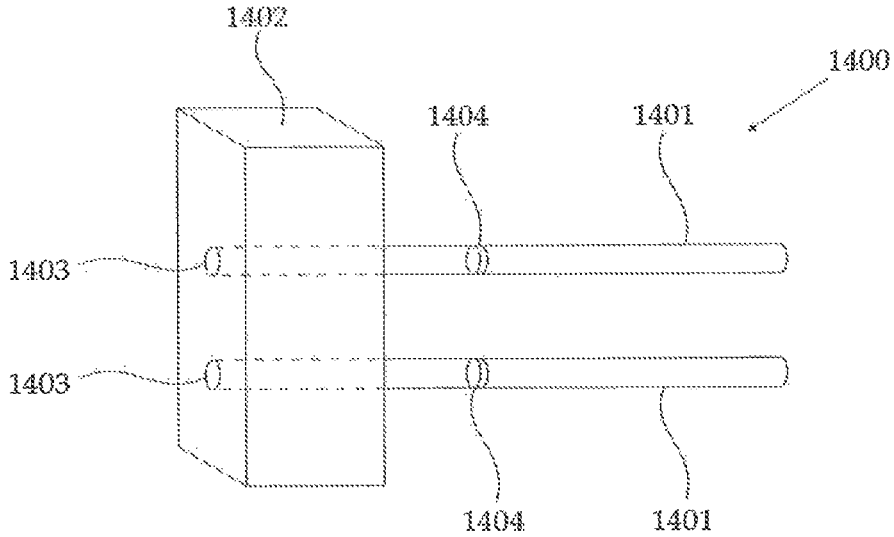

FIGS. 14A, 14B and 14C, diagrammatically depict samplers, according to the presently described embodiments. A sampler 1400 may be configured to sample fluid and to introduce it into the cartridge 204, e.g., in precise amounts. The sampler depicted by FIG. 14A may include a carrier 1401 attached to a handle 1402. In some embodiments, the carrier may include a capillary. Inside the capillary, a seal/plug may be formed, and the seal or plug may include any type of material or configuration that allows at least some air to flow, but blocks liquid flow. For example, in some embodiments a hydrophobic membrane 1404 may be affixed at a pre-determined distance from the capillary outlet. The capillary 1401 may include any type of capillary with a hydrophobic membrane affixed inside and suitable for a particular application. For example, capillaries manufactured by DRUMMOND Aqua-Cap™ Microdispenser may be used in the presently disclosed embodiments.

Fluid sampling may be performed by immersing the outlet of the capillary 1401 in the fluid. The sample fluid may be driven into the capillary by capillary force. The hydrophobic membrane 1404 affixed inside the capillary 1401 may facilitate the process, as it allows the air displaced by the sample fluid to flow out. The fluid fills the capillary until reaching the hydrophobic membrane. It should be appreciated that due to the hydrophobic nature of membrane 1404, the fluid does not come into contact with the membrane. Therefore, there may be no sample fluid absorbance in the membrane, or in other words, no loss of fluid volume occurs to the membrane. Thus, the final volume of a sampled fluid may be determined based on a distance of the hydrophobic membrane 1404 from the capillary outlet and by the capillary's inner diameter.

Once the fluid has been sampled, it may be delivered or introduced into the cartridge 204 by inserting the capillary 1401 through the first opening 301 thereof. At this stage only a limited leakage of a sample fluid from the capillary into a reservoir 303 may occur, as the fluid may be held inside by capillary forces. A plunger 1405 may be used to push the sample fluid out of the capillary into the reservoir 303. The plunger 1405, depicted in FIG. 14B may include a plunging member 1406 attached to a holding member 1407. The plunging member 1406 may be configured for insertion into the capillary 1401 through a capillary inlet 1403 located in the handle 1402. The plunger pushes the hydrophobic membrane 1404 until it reaches the capillary outlet, optionally resulting in the delivery of the entire sample fluid into the reservoir 303. It should be considered though that if the plunging member 1406 is not long enough for reaching the capillary outlet, a certain dose of fluid may remain in the capillary. Hence, the volume of the sample fluid delivered into the reservoir may depend on a length of plunging member 1406 relative to a length of capillary 1401. The capillary's diameter may be known in advance along with the length of the capillary and the length of the plunger. Hence, the volume of the fluid transferrable by the sampler can be predetermined.

Sampling and plunging as described above may enable delivery into the reservoir of a fixed volume of sample fluid. The ability to deliver a fixed volume of a fluid may be important, as deviations in the delivered volume from sample to sample may affect the reliability of the sequential analysis. There may be no need to flush the blood out of the sampler (in this case the capillary) because the hydrophobic membrane may help to ensure that all of the sample fluid, e.g., blood, is dispensed into the first reservoir.

With reference to certain embodiments, the plunger 1405 may be included as a part of analyzing system 101, such that the plunger is inserted into the cartridge 204 upon placement thereof inside the cartridge holding unit 103 of an analyzing system 101. However, in different embodiments the plunger may constitute a separate device, whereas the insertion of a plunger into the cartridge may be performed prior to placement thereof into the cartridge holding unit 103.

As illustrated by FIG. 14C, the sampler may include two carriers 1401, wherein sampling of the fluid by the carriers is performed simultaneously or sequentially.

The sampler of FIG. 14C comprising two carriers may be used, for example, for sampling and delivery of blood into a cartridge configured to allow performance of blood count, such as the cartridge described above with reference to FIG. 13. In some embodiments, the two carriers of the sampler may comprise anticoagulant-coated capillaries with a hydrophobic membrane. An anticoagulant, coating the capillaries, may serve to prevent clotting of sampled blood. An example of an anticoagulant includes EDT A (Ethylenediaminetetraacetic acid).

A fluid volume sampled by each carrier 1401 of the sampler 1400 and delivered into the cartridge 204 may be as small as 2.0 μl or even less. Therefore, performance of a blood count using the sampler 1400, the cartridge 204 and the analyzing system 101 may require obtaining of as little as a single drop of blood from an individual. Such a small volume of blood may be obtained by pricking the fingertip or forearm in a way performed for example by home blood glucose monitoring devices, thus sparing drawing blood from a vein, which is less convenient for patients, especially children.

Figure 15:
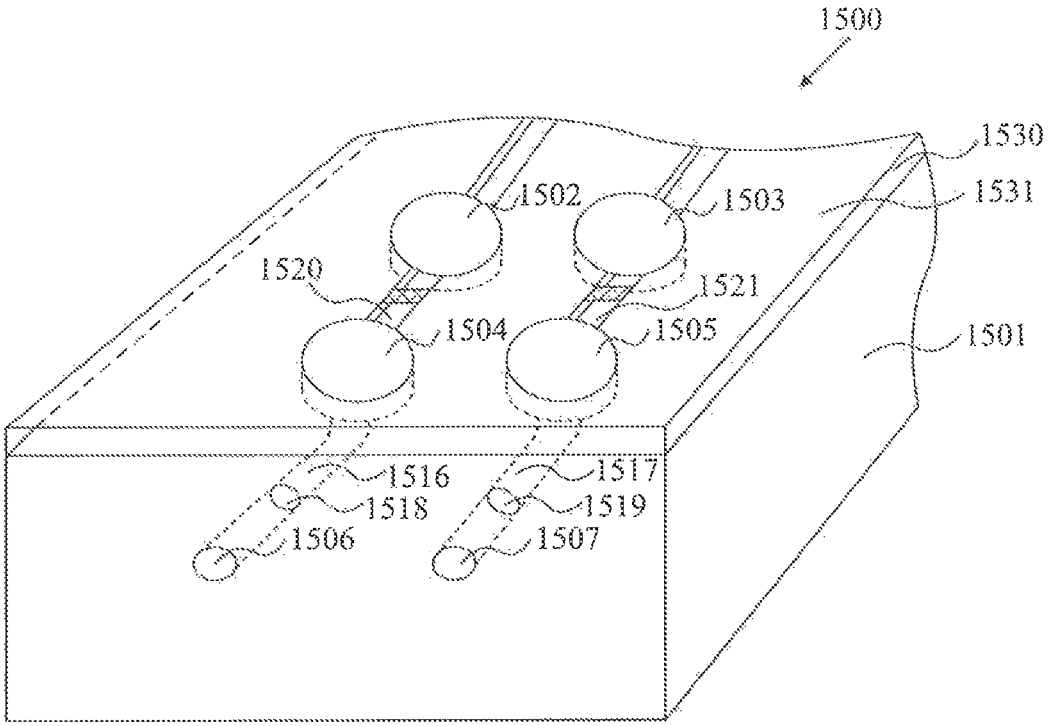
FIG. 15 diagrammatically illustrates a portion of a cartridge, according to some embodiments of the disclosure.

In some embodiments, cartridge 204 may include a substantially rigid frame at least partially housing the reservoirs of one or more preparation units. FIG. 15 shows a portion of a cartridge 1500 including rigid frame 1501. Rigid frame 1501 may comprise any rigid or semi-rigid material. For example, in some embodiments, rigid frame 1501 may be fabricated from any of PMMA, COP (Cyclic olefin copolymer), Polyethylene, polycarbonate, polypropylene, polythene, etc., or combinations thereof.

Rigid frame 1501 may be fabricated to include one or more structures associated with the preparation units described above. For example, in some embodiments, rigid frame 1501 may be made by injection molding and may include various flow paths, inlets, outlets, and/or reservoir elements (e.g., depressions formed in a surface of the rigid frame that provide reservoirs when covered with a cap or cover layer). Rigid frame 1501 may be provided as a substantially monolithic substrate, as shown in FIG. 15, for example. Alternatively, rigid frame 1501 may include one or more structural components associated with cartridge 204/1500 and that provide support to one or more elements of the cartridge 204/1500.

In some embodiments, rigid frame 1501 may include openings 1506 and 1507 which lead to flow channels 1516 and 1517, respectively. Opening 1506 and/or opening 1507 may be sized to accept a sampler containing a quantity of sample fluid. For example, either or both of openings 1506 and 1507 may be sized to accept a capillary 1401 associated with sampler 1400. In some embodiments, a spacing between openings 1506 and 1507 may be provided to match a spacing between capillaries 1401 provided on a dual capillary sampler, as shown in FIG. 14C.

Further channel 1516 and/or 1517 formed in the rigid frame or otherwise associated with the rigid frame may be configured to align and stabilize a capillary tube of a sampler. Such a configuration may facilitate alignment and insertion of a capillary 1401 into cartridge 1500. Further, these channels may help guide the capillary tubes to a desired location within the rigid frame or cartridge 204 and may protect the capillary tubes from breaking while inserted into rigid frame 1501.

In some embodiments, openings 1506 and 1507 and channels 1516 and 1517 may provide fluid flow paths to one or more reservoirs associated with cartridge 1500. For example, as shown in FIG. 15, channel 1516 may lead to reservoir 1504, and channel 1517 may lead to reservoir 1505. Thus, sample fluid provided to channel 1516 may flow to reservoir 1504, and sample fluid provided to channel 1517 may flow to reservoir 1505. It should be understood that although FIG. 15 shows two openings in the substantially rigid frame, the substantially rigid frame may include any number of openings without departing from the scope of the present disclosure. One or more of the openings in the substantially rigid frame may be configured to align and stabilize a capillary tube.

Reservoirs 1504 and 1505 may be included as part of preparation units (as described above) of cartridge 1500. For example, reservoir 1504 may be coupled to another reservoir 1502 via a channel 1520 and a seal 1507. Similarly, reservoir 1505 may be coupled to another reservoir 1503 via a channel 1521 and a seal 1508.

In some embodiments, cartridge 1500 and its associated preparation units may be formed based upon a two-part construction. For example, a first part of the cartridge 1500 may include rigid frame 1501, including molded components for providing at least a part of the structures associated with the preparation units of cartridge 1500. A second part of the cartridge may include a film 1530 disposed on the rigid frame 1501. Disposing film 1530 upon rigid frame 1501 may complete at least a portion of the structures or components of the preparation units. For example, reservoir 1504 (and the other reservoirs shown in FIG. 15) may include a first portion comprising a depression formed in rigid frame 1501. When film 1530 is placed over rigid frame, a portion of the film will cover the depression associated with reservoir 1504. Further, forming film 1530 from an elastic material may also enable one or more of the reservoirs associated with cartridge 1500 to be pressable, as described above.

Film 1530 may be formed from any suitable material. In some embodiments, film 1530 may be formed from PVC, Polypropylene, polyethylene, polyurethane and laminates containing aluminum and PE, or combinations thereof.

In some embodiments, one or more of the rigid frame 1501 and the film 1530 may be formed of materials that may bond together when exposed to heat. During construction of the two-part structure of cartridge 1500, as shown in FIG. 15, varying levels of heat may be applied to achieve desired results. For example, where high temperatures (e.g., 140 C-180 C) are applied, film 1530 may be caused to permanently weld to the material of rigid frame 1501. In other areas, where little or no heat is applied, film 1530 may remain unbonded to the underlying rigid frame. And, in areas where heat is provided at a level below a welding threshold for the materials (e.g., 100 C-130 C), the material of film 1530 may bond together with the material of rigid frame 1501, but the bond may be non-permanent. That is, in these areas, the bonded materials may be later pulled apart from one another. In some embodiments, the selective bonding described above may be achieved, for example, using a film 1530 having a multi-layer structure. A first sub-film of the multi-layer structure (e.g., the lowest layer that first contacts rigid frame 1501) may include a material that forms a relatively weak bond with the material of rigid frame 1501. Thus, subsequent force on an area where the first sub-film has been bonded to rigid frame 1501 may result in separation (e.g, peeling) of the sub-film and, therefore, the entire film 1530 away from rigid frame 1501.

In some embodiments, a multi-layer structure of film 1530 may include a second sub-film disposed above the first sub-film. The second sub-film may form a more permanent bond with the material of rigid frame 1501 through the application of a higher temperature. For example, in some embodiments, the higher temperature may cause the first sub-film to melt and flow away from the bonding area, which may enable the second sub-film to bond directly to the rigid frame material (either permanently or semi-permanently).

This type of bonding may facilitate construction of components associated with the preparation units of cartridge 1500. For example, in areas such as region 1531 away from the structures of the preparation units, a high temperature may be applied to permanently weld the material of film 1530 to rigid frame 1501. In areas associated with reservoirs 1502, 1503, 1504, 1505 and associated with channels 1520 and 1521, heat application may be avoided such that film 1530 remains free of rigid frame 1501 in these regions. In regions associated with seals 1507 and 1508 a sub-welding heating level may be used such that film 1530 is tacked or temporarily bonded to rigid frame 1501. These seals may be referred to as "peel seals," as pressure placed on the seal, for example by a fluid within reservoir 1504 pressing on seal 1507, may cause film 1530 to peel away from frame 1501. Under such circumstances, fluid may be allowed to flow through the seal. While these peel seals may be frangible, fluid flow through a broken seal 1507 or 1508 may be halted by, for example, applying pressure to film 1530 in the regions of the seals in order to close the fluid pathway at the seals.

Cartridge 1500 may also include seals 1518 and 1519 disposed within channels 1516 and 1517, respectively. Seals 1518 and 1519 may prevent fluids or other materials preloaded into reservoirs 1504 and 1505, for example, from escaping from the cartridge or from becoming contaminated from the surrounding environment.

Figure 16A:
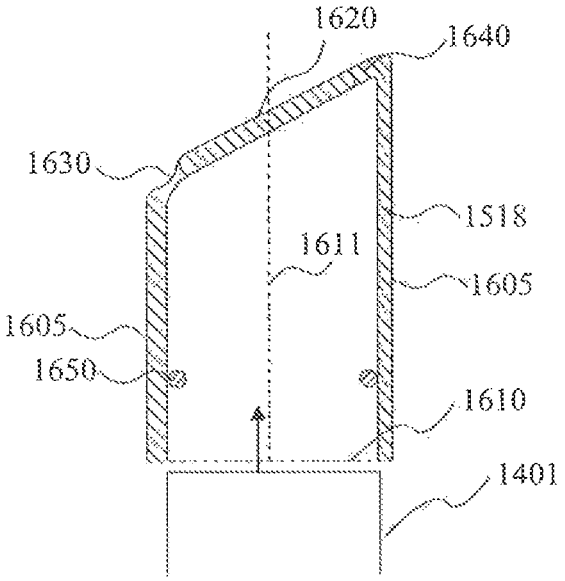
FIGS. 16A and 16B diagrammatically show a seal according to exemplary disclosed embodiments.
Figure 16B:
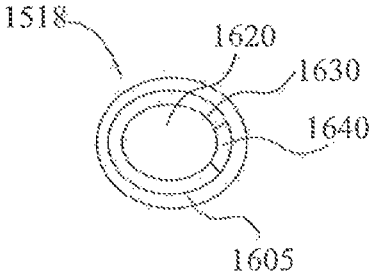

Seals 1518 and 1519 may constitute frangible seals designed to break upon interaction with a capillary of a sampler inserted into channel 1516 and/or channel 1517. FIG. 16A provides a diagrammatic cross-sectional representation of a seal 1518 according to an exemplary disclosed embodiment. FIG. 16B provides a top view representation of seal 1518. As shown in FIG. 16A, seal 1518 may optionally include a wall 1605 surrounding an opening 1610 sized to receive a capillary 1401 of a fluid sampler. Seal 1518 may also include a cover 1620 (e.g., a flap portion in some embodiments) that extends across the opening formed by wall 1605.

Seal 1518 may also include various structures for providing a seal around capillary 1401 once capillary 1401 has been inserted into or through seal 1518. Such seals may reduce or eliminate a flow of fluid from out of opening 1610 once capillary 1401 has been introduced into seal 1518. In some embodiments, seal 1518 may include one or more O-rings 1650 to establish a seal about capillary 1401. Such O-rings may be disposed on wall 1605 at a position upstream from cover 1620, as shown in FIG. 16A. Alternatively or additionally, O-rings may be included downstream of cover 1620. Seal 1518, itself, may serve to provide a seal about capillary 1401. For example, once cover 1620 opens in response to a force applied by capillary 1401 (e.g., an axial force), as will be discussed further below, the material of seal 1518 originally surrounding cover 1620 may contact a sidewall of capillary 1401 to create a seal.

Cover 1620 may be attached to wall 1605 in any suitable manner. In some embodiments, cover 1620 may be attached to wall 1605 via the same material used to form cover 1620 (e.g., a polymer). The attachment structure may be formed with a thickness different from a thickness associated with cover 1620. For example, in some embodiments the attachment structure joining cover 1620 to wall 1605 (or alternatively to an interior wall of channel 1516) may be thinner than a thickness associated with cover 1620. Further, a thickness of the attachment structure may be non-uniform about a perimeter of cover 1620. For example, as shown in FIGS. 16A and 16B, a region 1630 of the attachment structure may be thinner than a region 1640 of the attachment structure. Moreover, region 1630 may extend around a greater portion of cover 1620 than region 1640. In some embodiments, region 1630 may extend around 80%, 90%, or more of a perimeter of cover 1620. Further, a thickness of region 1630 may be 90%, 70%, 50%, or less of the thickness of associated with region 1640.

Such a structure may facilitate breaking of seal 1518 by capillary 1401. For example, upon insertion into channel 1516, capillary 1401 may come into contact with seal 1518 in an area near cover 1620. Pressure exerted on seal 1518 may cause cover 1620 to tear from wall 1605, thereby opening seal 1518. Inclusion of regions 1630 and 1640 may encourage tearing in a predictable manner and with less force. For example, because region 1630 is thinner than region 1640 and thinner than cover 1620, cover 1620 may tend to separate from wall 1605 beginning in an area of region 1630 and extending around most or all of the length of region 1630. Tearing of region 1630 may allow cover 1620 to open into channel 1516 as a flap of material. Because region 1640 is thicker than region 1630 and, indeed, may have a thickness comparable to or even greater than cover 1620, the material at region 1640 may remain untorn when capillary 1401 impinges upon seal 1518. Accordingly, cover 1620 may be retained as a flap attached to wall 1605 (or an interior wall of channel 1516) via the material of region 1640. And, because region 1630 has a thickness less than cover 1620, a lower amount of force may be required to open seal 1518 as compared to a configuration where cover 1620 was joined to wall 1605 with a material having a similar thickness to cover 1620.

Other structural features of seal 1518 may also facilitate opening of the seal. For example, in some embodiments, cover 1620 may be oriented relative to wall 1605 such that a plane associated with cover 1620 intersects wall 1605 at an angle. In some embodiments, the angle of intersection relative to a longitudinal axis 1611 of wall 1605 may be approximately 90 degrees. In other embodiments, however, the angle of intersection between a plane associated with cover 1620 and the longitudinal axis 1611 may be other than perpendicular (e.g., ±5 degrees, ±10 degrees, ±20 degrees, ±30 degrees or more). Angling the cover in this way may facilitate opening of seal 1518 because insertion of capillary 1401 into channel 1516 will cause the capillary to contact only a small portion of seal 1518. Therefore, all of the pushing force associated with insertion of the capillary will be concentrated on the small area of contact, which may increase the ease at which cover 1620 is caused to tear from wall 1605. In some embodiments, thin region 1630 may be located in a region that will experience first contact with an inserted capillary. Further still, in some embodiments, region 1630 may be substantially centered about a region that will experience first contact with an inserted capillary.

Figure 17:
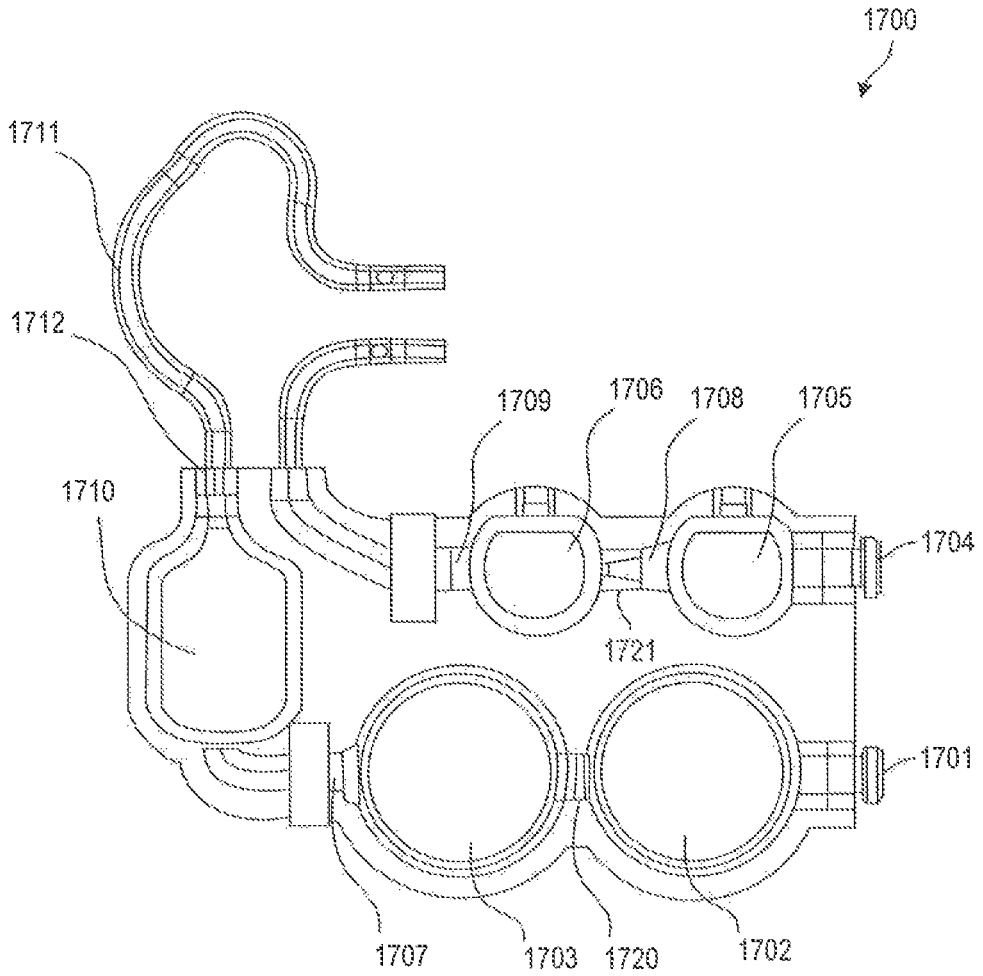
FIG. 17 diagrammatically illustrates a cartridge according to some embodiments of the disclosure.

FIG. 17 illustrates another example cartridge 1700, according to an exemplary disclosed embodiment. As shown in FIG. 17, the cartridge 1700 include a first inlet or opening 1701, a first reservoir 1702, a second reservoir 103, a second inlet or opening 1704, a third reservoir 1705, and a fourth reservoir 1706. Inlet 1701 is associated with the first reservoir 1702, and inlet 1704 is associated with the third reservoir 1705. The example cartridge further includes a first seal 1707, a second seal 1708, and a third seal 1709. Any or all of the seals may be fabricated as "peel seals," as described above. As shown in FIG. 17, a first flow path is formed across the first and second reservoirs 1702 and 1703, the fluid channel 1720, and the first seal 1707. A second flow path is formed across the third and fourth reservoirs 1705 and 1706, the fluid channel 1721, the second seal 1708, and the third seal 1709.

The first flow path may be configured to mix a blood or fluid sample with a first reagent, and the second flow path may be configured to mix the blood or fluid sample with a second reagent. The reagents may be preloaded and sealed in the reservoirs. Alternatively, the reagents may be injected into the reservoirs via inlets in the cartridge. The reagents may include at least one of a white blood cell stain (e.g., acidic stain and alkaline stain), a lysing agent, a biomarker, and at least one high molecular weight polymer in fluid form. Upon the pressing of one or more of the reservoirs, the corresponding seals may be caused to open to enable any fluid in the reservoirs to flow along the respective flow path.

Cartridge 1700 may also include a buffer compartment 1710. Buffer compartment 1710 may be included within a flow path between sample fluid preparation reservoirs (e.g., reservoirs 1702 and 1703) and a fluid outlet 1712 leading to an analysis segment. In some embodiments, a tube 1711 may be provided at outlet 1712 to carry sample fluid, or derivatives thereof, to one or more analysis segments. In some embodiments, buffer compartment 1710 may remain empty of fluid prior to placing cartridge 1700 into use. Upon receiving a sample fluid into cartridge 1700 (e.g., via inlets 1701 and/or 1704), the sample fluid may be provided to a preparation unit including reservoirs 1702 and 1703 and prepared for analysis according to any of the preparation processes described above.

In some embodiments, once the sample fluid (or a derivative thereof) has been prepared and is ready for analysis, the sample fluid/sample fluid derivative may be provided to buffer compartment 1710 prior to analysis. Buffer compartment 1710 may include a reservoir and may serve as a temporary holding location within cartridge 1700 prior to analysis of the fluid. In some embodiments, fluid gathers in buffer compartment 1710 as a flow rate into buffer compartment 1710 may exceed a flow rate out of buffer compartment 1710. In other embodiments, buffer compartment 1710 may serve as a pass-through chamber for fluid where a fluid flow rate out of buffer compartment equals or, in some cases, exceeds a flow rate into buffer compartment 1710.

The amount of fluid provided to buffer compartment 1710 may be controlled by any suitable technique. In some embodiments, the prepared sample fluid from reservoirs 1702/1703 may be provided to buffer compartment 1710 by opening seal 1707 (e.g., via a super-threshold pressure applied to the seal, releasing or removing a physical obstacle associated with seal 1707, or by any other opening technique) and metering into buffer compartment 1710 a desired amount of prepared fluid. One or more stepper motors may be employed, for example, to depress portions of reservoirs 1702 and/or 1703 by a predetermined amount and/or at a predetermined rate in order to provide a predetermined amount of prepared fluid to buffer compartment 1710.

Fluid provided to buffer compartment 1710 may be drawn out of buffer compartment 1710 for analysis using any suitable technique. For example, in some embodiments, a vacuum may be applied to outlet 1712 via tube 1711 in order to cause fluid to flow from buffer compartment 1710. Metering techniques (e.g., including stepper motors, plungers, flow control seals, etc.) may be used to draw out of buffer compartment 1710 a predetermined amount of fluid for analysis.

Buffer compartment 1710 may offer certain performance characteristics dependent upon the structures of a particular configuration or based upon a particular operating scheme. For example, during operation buffer compartment 1710 may function as a fluid analog to an electrical capacitor and may buffer fluid flow prior to analysis of the fluid. Buffer compartment 1710 may aid in reducing an amount of bubbles present in the fluid to be analyzed. In some embodiments, the fluid drawn from buffer compartment 1710 for analysis may be drawn from a region of buffer compartment 1710 residing below a fluid level line in buffer compartment 1710. Bubbles in the fluid provided to buffer compartment 1710, resulting, e.g., from flow of the prepared fluid through one or more components of the preparation unit, may tend to accumulate on a surface of the fluid in buffer compartment 1710. By drawing fluid from buffer compartment 1710 from below a fluid level line, such bubbles may remain in buffer compartment 1710, and the fluid drawn out of buffer compartment 1710 for analysis may be bubble free or may at least include fewer bubbles per unit volume than the totality of fluid residing in buffer compartment 1710. Further, buffer compartment 1710 may avoid complexities associated with controlling of operational characteristics of seal 1707 in order to provide a desired flow of fluid for analysis. In some embodiments, an amount of fluid provided to buffer compartment 1710 may exceed an amount of fluid.

Figure 18:
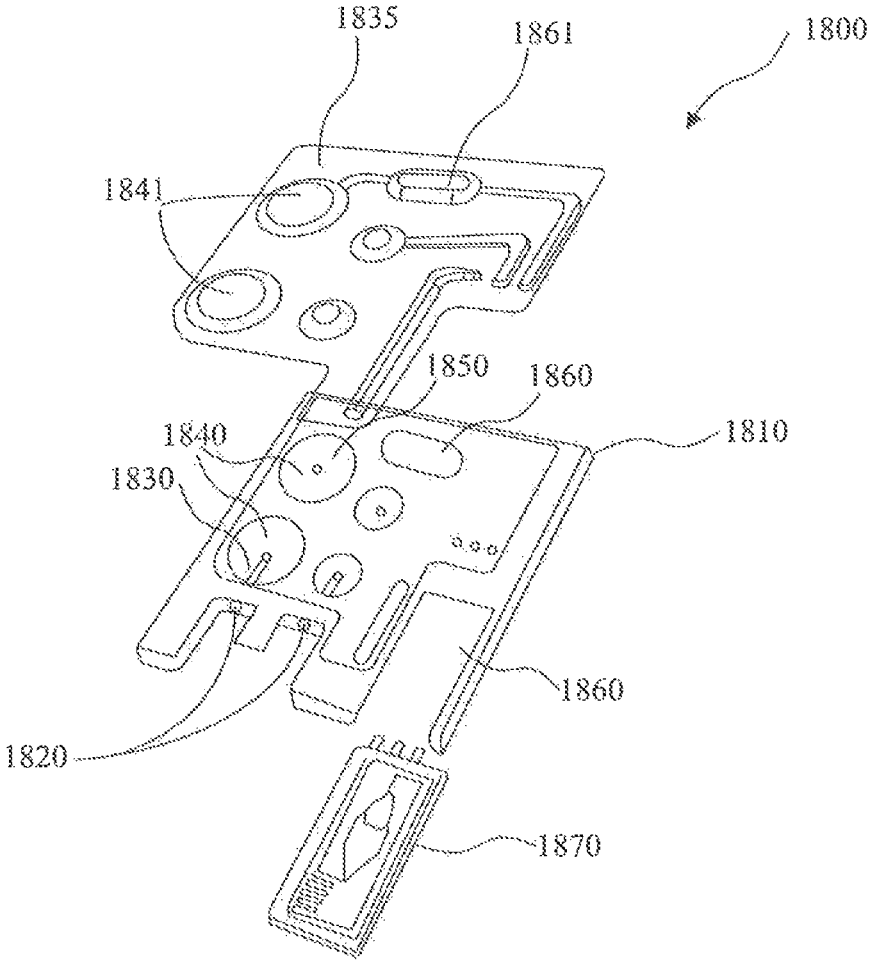
FIG. 18 diagrammatically illustrates a cartridge according to some embodiments of the disclosure.

FIG. 18 provides a perspective view illustration of a cartridge 1800, according to an exemplary disclosed embodiment. As shown in FIG. 18, cartridge 1800 may include a rigid frame or rigid portion 1810. Rigid portion 1810 may be fabricated (e.g., by molding or any other suitable technique) to include various structures relating to fluid processing components of cartridge 1800. For example, in some embodiments, rigid portion 1810 may include one or more inlets 1820, which may each be configured to receive, support, and/or align a fluid sampler, such as a capillary tube containing a quantity of sample fluid. Rigid portion 1810 may also include one or more depressions 1840 (or other features such as walled structures, etc.) that each may be associated with a fluid reservoir of the assembled cartridge 1800. Various flow paths may be fabricated into or on rigid portion 1810 to establish fluid flow paths within cartridge 1800. For example, as shown in FIG. 18, a flow path 1830 may connect an inlet 1820 to a depression 1840, which may serve as a base of a fluid preparation reservoir (or reagent storage portion) associated with cartridge 1800. Rigid portion may also include various fluid inlets, such as fluid inlet 1850, which may be configured for enabling the filling of a fluid reservoir of cartridge 1800 either during manufacture of cartridge 1800 or after such manufacturing has been completed.

As described above relative to FIG. 15, cartridge 1800 may be fabricated as a two-layer structure including a sheet, layer 1835 disposed over rigid portion 1810. In some embodiments, sheet layer 1835 may include a flexible material (e.g., a polymer or any other suitable elastic material) and may be bonded to rigid portion 1810, e.g., in the manner discussed above relative to the structures shown in FIG. 15. Once bonded in place, caps 1841 may reside over depressions 1840 to provide fluid preparation reservoirs of cartridge 1800. In some embodiments, at least a portion of caps 1841 may be flexible and, therefore, deformable in response to pressing (i.e., "pressable"). Similarly, a cap 1861 may reside over a depression 1860 to form a buffer compartment similar to buffer compartment 1710 of FIG. 17. Caps 1841, 1861 may be configured to protrude upward relative to a surface of sheet layer 1835. Alternatively, caps 1841, 1861 may be configured as flat portions of sheet layer 1835 with substantially no protrusion above a surface of sheet layer 1835. That is sheet layer 1835 may constitute a substantially flat sheet formed without raised portions.

Cartridge 1800 may also include a docking port 1860 or other structures configured to align, receive, and/or retain an analysis compartment 1870 where sample fluid analysis may be performed. Cartridge 1800, like cartridge 1700 of FIG. 17, may include one or more seals (e.g., frangible seals) disposed in any of the flow paths included in cartridge 1800.

Figure 19A:
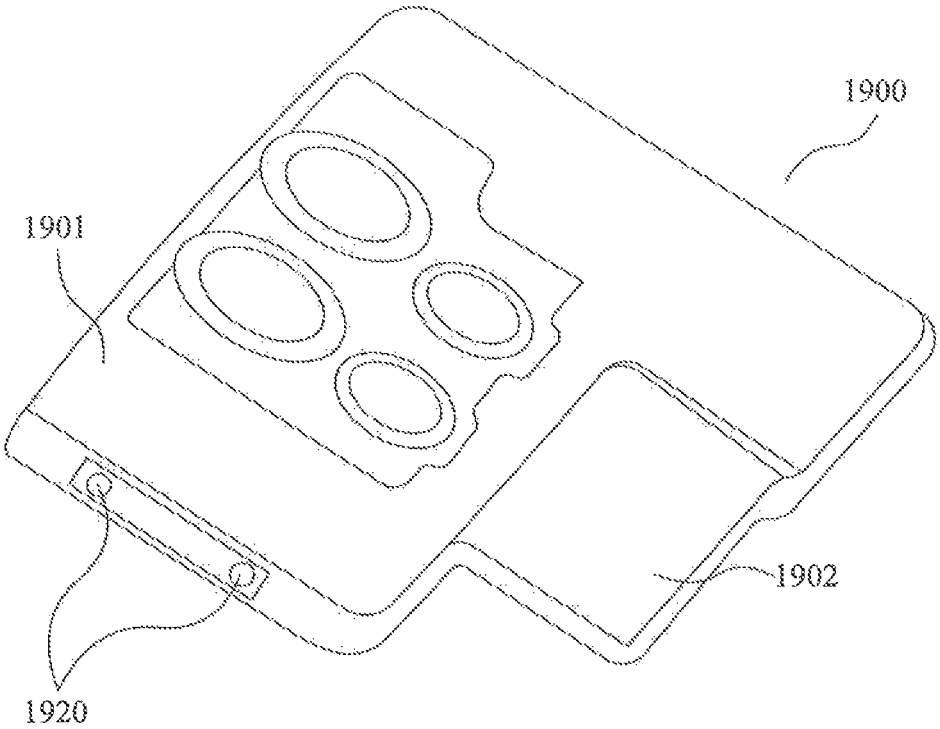
FIGS. 19A and 19B diagrammatically illustrate a cartridge according to some embodiments of the disclosure.
Figure 19B:
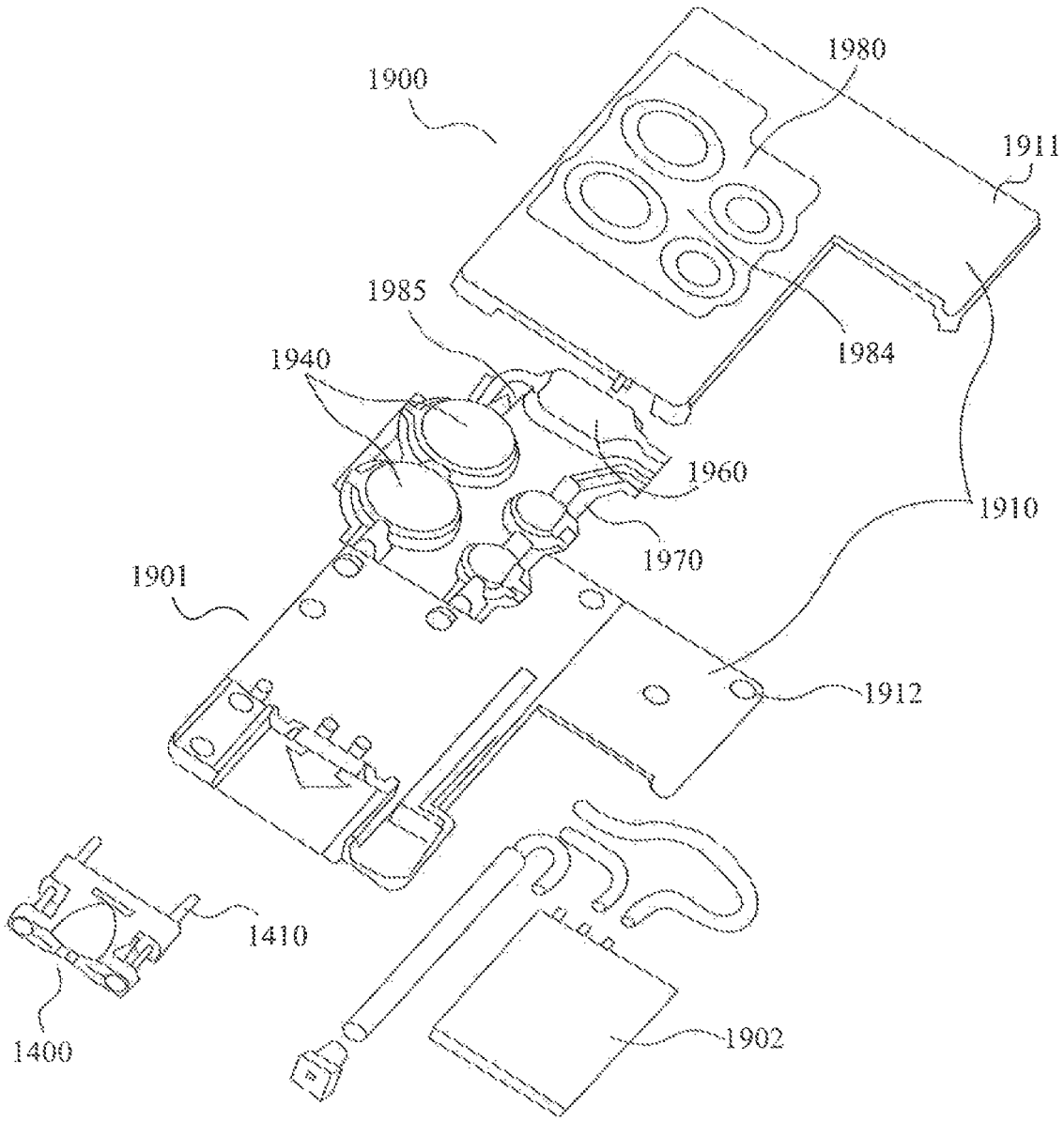

FIGS. 19A and 19B provide perspective views of a cartridge 1900, according to an exemplary disclosed embodiment. FIG. 19A shows an assembled view of cartridge 1900, and FIG. 19B shows an exploded view of cartridge 1900. Cartridge 1900 may include a preparation portion 1901 as well as an analysis portion 1902. As shown in FIG. 19B, cartridge 1900 may include a rigid frame or rigid portion 1910. Rigid portion 1910 may be fabricated (e.g., by molding or any other suitable technique) as a two-part structure. As shown, rigid frame 1910 may include a top portion 1910 configured to mate with and attach to a bottom portion 1912.

In some embodiments, rigid portion 1910 may include one or more inlets 1920, which may each be configured to receive, support, and/or align a fluid sampler, such as a capillary tube containing a quantity of sample fluid. Various flow paths may be fabricated into or on rigid portion 1910 to establish fluid flow paths within cartridge 1900. For example, any or all of the flow paths described above with respect to the cartridge of FIG. 18 may also be included in the two part rigid frame 1910 of FIG. 19B.

Cartridge 1900 may be fabricated not only with a two part rigid frame 1910, as shown in FIG. 19B, but also with two or more flexible sheets of material. For example, cartridge 1900 may include a first sheet 1970 and a second sheet 1980. In some embodiments, sheet layers 1970 and 1980 may include a flexible material (e.g., polymer or any other suitable elastic material) and may be bonded together during fabrication of cartridge 1900. Any suitable techniques for bonding flexible materials together may be used. In some embodiments, different regions of layers 1970 and 1980 may be bonded together with varying bond strengths. Such configurations may be useful, for example, to permanently or semi-permanently bond together certain regions and more temporarily bond together other regions. For example, in some regions, a frangible seal may be formed by forming a temporary bond between layer 1970 and layer 1980 that can be peeled apart to open the seal.

Various mechanisms may be used to bond layers 1970 and 1980 together. For example, adhesives may be used. In some regions, such as region 1984, where permanent or semi-permanent bonds are desired, suitable adhesives may be used to permanently or semi-permanently bond together layers 1970 and 1980 in those regions. Similarly, other adhesives, e.g., those that provide only a temporary, peelable bond, may be used in other regions, such as region 1985 where a temporary bond may be desired in order to create a frangible seal.

Such bonding may also be accomplished through welding. For example, in some embodiments, an electrode may be used to create spot welds between layers 1970 and 1980. In such embodiments, a bond-strength between the two layers may depend on the density and/or shape of spot welds in a particular region. Thus, regions such as region 1984, where a high bond-strength may be desired, a higher density of spot welds may be used as compared to regions, such as region 1985, where a lower density of spot welds may be used in order to provide a temporary, peelable bond.

Layers 1970 and 1980 may also be bonded together via other mechanisms. For example, each of layers 1970 and 1980 may include two sub-films, such as a first sub-film having a lower melting or bonding temperature as compared to a second sub-film that has a higher melting or bonding temperature. Layers 1970 and 1980 may be formed such that during bonding, they are oriented such that the first sub-film from layer 1970 forms an interface with the first sub-film of layer 1980 and the second sub-films of each of layers 1970 and 1980 do not contact one another. To form a temporary, peelable bond, in a particular region, such as region 1985 at a frangible seal location, a low temperature may be applied (e.g., in the range of about 100 C to about 130 C) such that the first sub-films bond together. The bonded structure in this region may be later peeled apart by separation of the bonded first sub-films or by tearing a structure formed by the bonded, first sub-films. To create a permanent or semi-permanent bond, such as in region 1984, a higher temperature (e.g., in the range of about 140 C to about 180 C) may be applied. Such a temperature may cause the first sub-films to melt and/or flow away from the region to be bonded enabling the second sub-films of layers 1970 and 1980 to come in contact and form a permanent or semi-permanent bond. Such bonding techniques, including adhesives, spot welding, and/or multi-layered, temperature-dependent bonding structures may also be used in conjunction with the structures of FIG. 15, FIG. 18, or any other cartridge described herein.

Layers 1970 and 1980 may be prefabricated or formed to include various structures for providing flow paths, reservoirs, seals, etc. upon bonding of layers 1970 and 1980 together. For example, layers 1970 and 1980 once bonded together may form reservoirs 1940. These reservoirs may be flexible and, therefore, deformable in response to pressing (i.e., "pressable"). Similarly, layers 1970 and 1980 together may form frangible seals, e.g., in flow paths between reservoirs, compartments, etc. Such a frangible seal may include a seal in region 1985, as shown in FIG. 19B. Bonded layers 1970 and 1980 may form other structures, such as a buffer compartment 1960.

Figure 20:
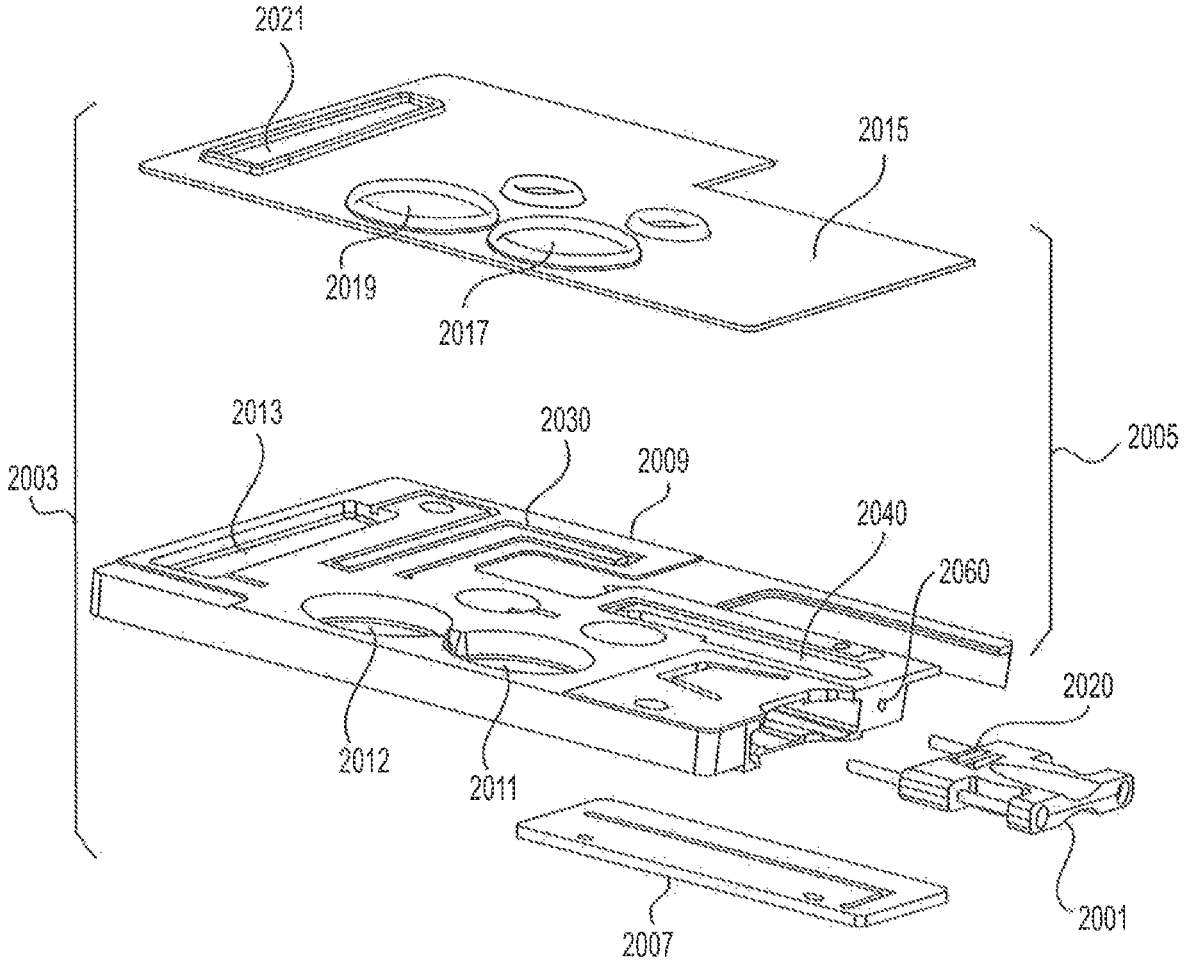
FIG. 20 provides a diagrammatic exploded view of a sample holder and a cartridge, including a preparation unit and a fluid analysis chip, according to presently disclosed embodiments.

FIG. 20 provides a diagrammatic exploded view of a sample holder 2001 and a disposable fluid analysis cartridge 2003. Cartridge 2003 may include a preparation unit 2005 and a fluid analysis chip 2007 attached to the preparation unit.

Preparation unit 2005 may include any suitable structures for receiving a fluid to be analyzed, preparing the received fluid for analysis, and providing the prepared fluid to the fluid analysis chip 2007. For example, in some embodiments, preparation unit 2005 may have a two-part construction, including, for example, a rigid base portion 2009 and a flexible film 2015. Rigid base portion 2009 and flexible film 2015 may be similar to rigid frame 1501 and film 1530, respectively, described above with respect to FIG. 15.

Rigid base portion 2009 may comprise any rigid or semi-rigid material. For example, in some embodiments, rigid frame 1501 may be fabricated from any of PMMA, COP (cyclic olefin copolymer), polyethylene, polycarbonate, polypropylene, polythene, etc., or combinations thereof. Rigid base portion 2009 may also be fabricated to include one or more structures associated with any of the preparation units described above. For example, in some embodiments, rigid base portion 2009 may be made by injection molding and may include various flow paths, channels, inlets, outlets, and/or reservoir elements (e.g., depressions formed in a surface of the rigid frame that provide reservoirs when covered with a cap or cover layer). Rigid base portion 2009 may be provided as a substantially monolithic substrate, as shown in FIG. 20, for example. In other embodiments, rigid base portion 2009 may include more than one component. In some embodiments, rigid base portion 2009 may include one or more depressions, such as depressions 2011, 2012, and 2013 formed in a top surface of rigid base portion 2009.

Preparation unit 2005 may be formed by joining flexible film 2015 with rigid base portion 2009. Film 2015 may be formed of from any suitable material. In some embodiments, film 2015 may be formed from PVC, PET, polypropylene, polyethylene, polyurethane and laminates containing aluminum and PE, or combinations thereof.

Figure 22:
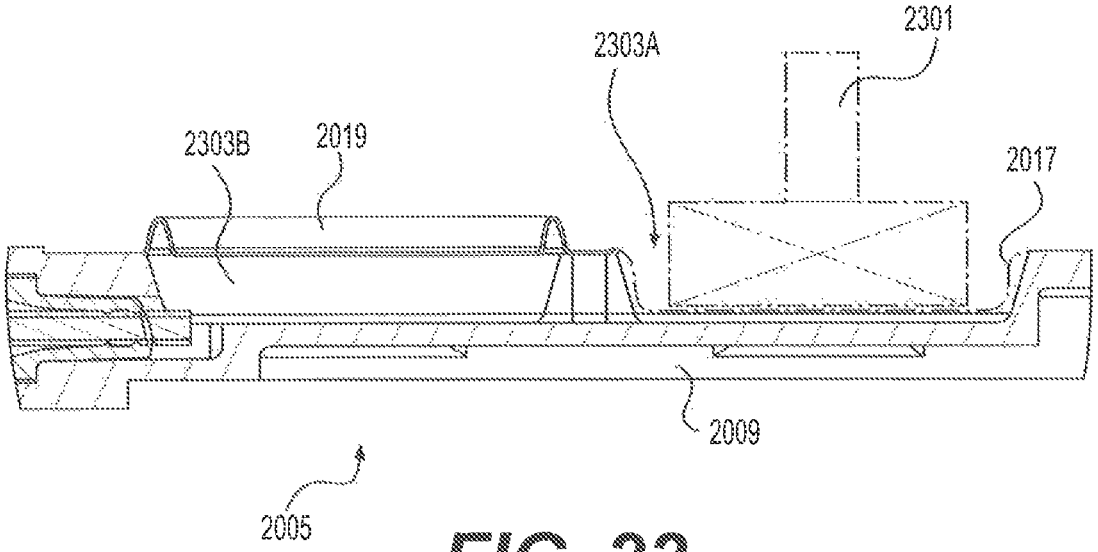
FIG. 22 provides a diagrammatic cross sectional illustration of a preparation unit and a plunger used in mixing a sample fluid, according to presently disclosed embodiments.

In some embodiments film 2015 may be flexible and when attached to rigid base portion 2009 may extend over a top surface of rigid base portion 2009. Film 2015 may include a flat sheet of material. In other embodiments, however, film 2015 may include preformed shapes or structures that form either raised or sunken areas in film 2015. These raised or sunken areas may be formed in certain areas of film 2015 such that when film 2015 is joined to rigid base portion 2009, the raised or sunken areas overlap with or otherwise correspond to corresponding structures formed in rigid base portion 2009. For example, in some embodiments, a raised portion of film 2015 (e.g., a cap) may be formed in a location that overlaps with any of depressions 2011, 2012, or 2013. Such overlapping caps and depressions may form fluid reservoirs when film 2015 is joined together with rigid base portion 2009. Likewise, in some embodiments, sunken portions of film 2015 may be formed in locations that overlap with any of depressions 2011, 2012, or 2013. FIG. 20 provides diagrammatic illustrations of raised caps 2017 and 2019, which overlap with depressions 2011 and 2012, respectively. Also shown is a sunken portion 2021 of film 2015, which overlaps depression 2013. In some embodiments, flexible film 2015 covering the rigid base 2009 may be pre-formed to a geometry having redundant area to enable stretching, which may facilitate a selective increase and/or decrease of a volume of a reservoir (as will be described further with respect to FIG. 22).

Figure 23:
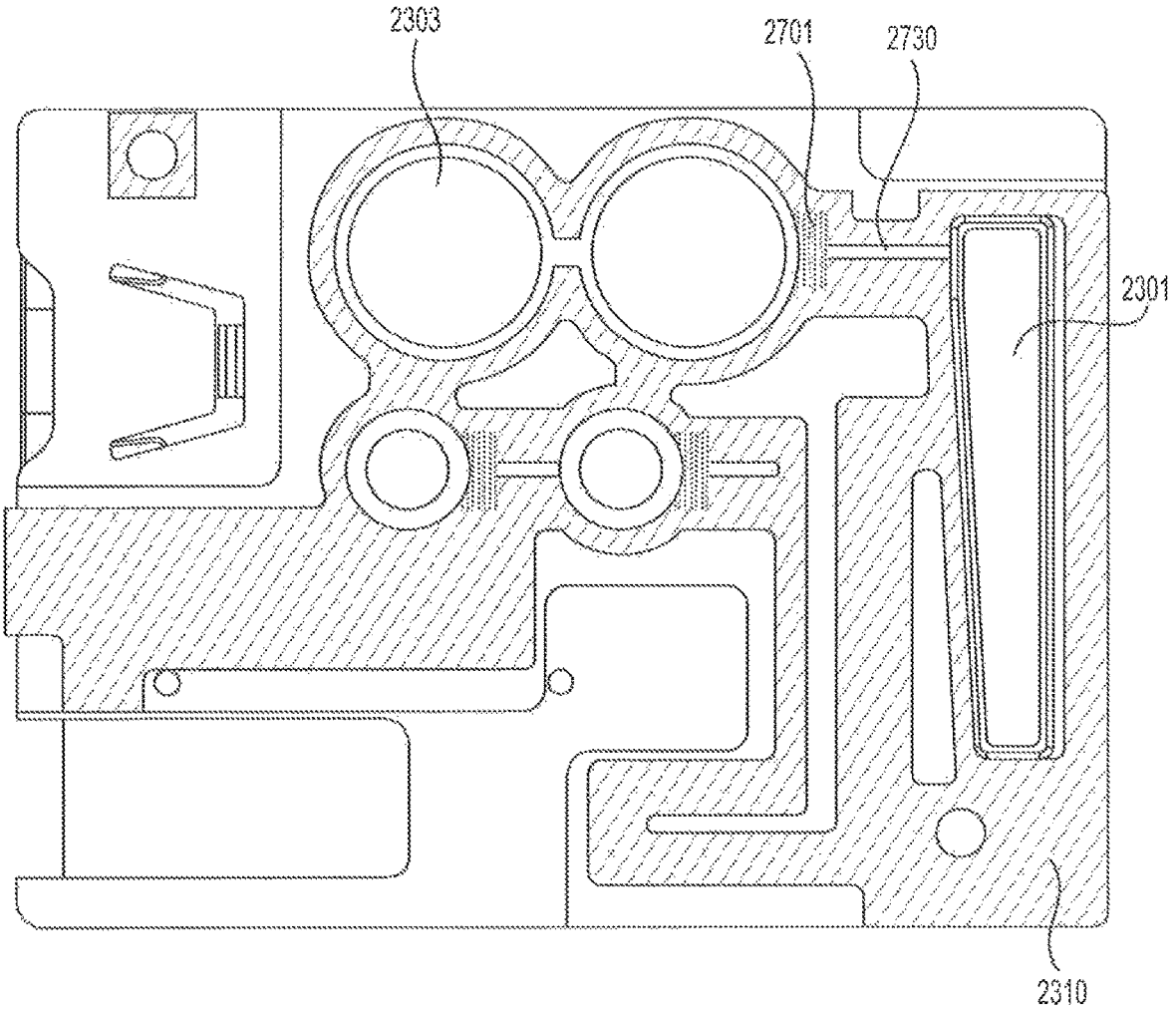
FIG. 23 provides a diagrammatic top view illustration of a disposable cartridge showing areas in which a cover film has been welded to a rigid base portion, according to presently disclosed embodiments.

Notably, a reservoir may be formed by a single depression in rigid base portion 2009 when covered by film 2015. For example, reservoir 2301, as shown in FIG. 23, may be formed by sunken portion 2021 overlapping depression 2013. In other embodiments, however, reservoirs may be formed to include more than one depression. For example, in the embodiment shown in FIG. 20, depression 2011 is connected to depression 2012 via a groove formed in the top surface of rigid base portion 2009. This groove establishes fluid communication between depression 2011 and depression 2012, such that when film 2015 is joined to rigid base portion 2009, a single fluid reservoir 2303 (FIG. 23) is formed by depressions 2011 and 2012, as covered by caps 2017 and 2019.

Figure 21:
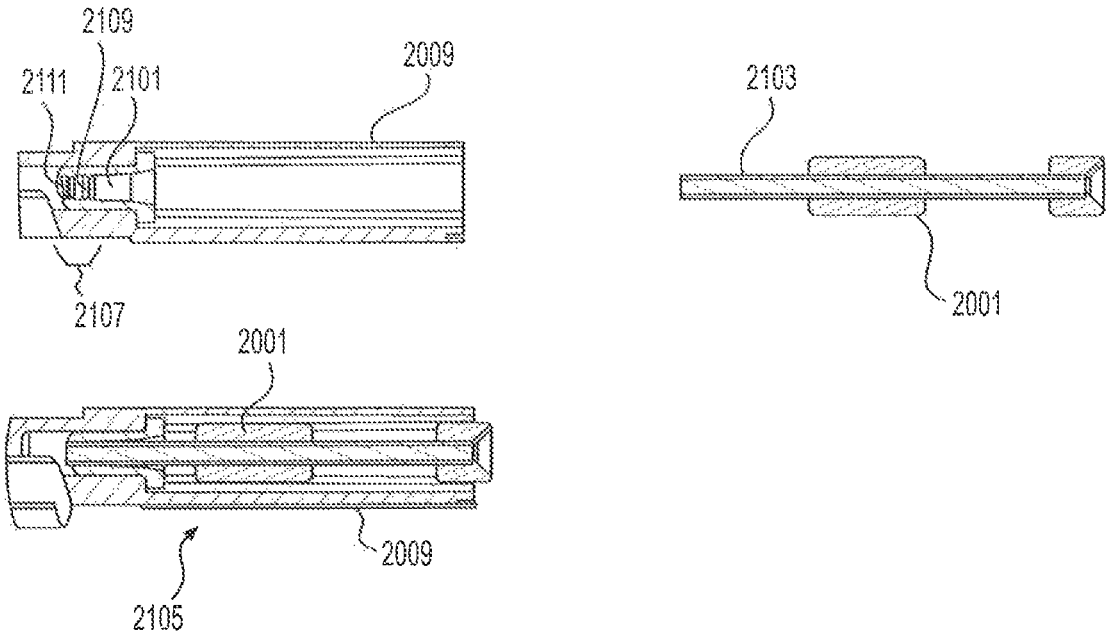
FIG. 21 provides diagrammatic cross sectional views of a sample holder and sample bolder receiver in a cartridge, according to presently disclosed embodiments.

Preparation unit 2005 may also include a reservoir inlet 2101 (FIG. 21) that is configured to receive into the reservoir a fluid to be analyzed. FIG. 21 provides a diagrammatic cross sectional view of a portion of rigid base portion 2009 configured to accept sample holder 2001. FIG. 21 also show an assembly 2105 including sample holder 2001, as inserted into rigid base portion 2009.

Rigid base portion 2009 may include one or more structures for receiving a structure associated with sample holder 2001. For example, in some embodiments, rigid base portion 2009 may include reservoir inlet 2101. Reservoir inlet 2101 may be configured with a size and shape suitable to receive, align, and stabilize a capillary tube 2103 associated with sample holder 2001. In some embodiments, sample holder 2001 may include one or more structures for enabling the sample holder 2001 to be locked into place once introduced into preparation unit 2005. For example, as shown in FIG. 20, sample holder 2001 may include a deflection tab 2020. When sample holder 2001 is introduced into preparation unit 2005, deflection tab 2020 may cause deflection of a locking tab (not shown) on preparation unit 2005. Continued movement of sample holder 2001 into preparation unit 2005 may release the locking tab from its deflected position allowing the locking tab to snap into place behind the advancing deflection tab 2020. The deflection tab and the locking tab may be shaped such that the deflection tab 2020 can pass the locking tab only in one direction. Thus, once sample holder 2001 is introduced fully into preparation unit 2005, interference between the locking tab and deflection tab 2020 may prevent sample holder 2001 from being removed from the preparation unit.

In some embodiments, capillary tube 2103 may include an amount of a fluid to be analyzed. This fluid to be analyzed may be introduced to preparation unit 2005 using the plunger technique described above, for example, to force the fluid to be analyzed through reservoir inlet 2101 and into reservoir 2303.

In some embodiments, reservoirs associated with preparation unit 2005 (e.g., reservoir 2303) may be pre-loaded with a sample fluid preparation material. For example, reservoir 2303 may be loaded with an aqueous solution of a high molecular weight polymer, including any of the types of high molecular weight polymers discussed above.

Reservoir inlet 2101 may include a seal 2107, which may be similar to seals 1518 and 1519 discussed above with respect to FIGS. 16A and 16B. For example, seal 2107 may be a frangible seal designed to break upon interaction with capillary tube 2103 of sample holder 2001 and may include any of the structures described relative to FIGS. 16A and 16B. In some embodiments, seal 2107 may include a components for preventing the flow of materials pre-loaded into reservoirs of the preparation unit (e.g., high molecular weight polymer liquid pre-loaded into reservoir 2303) through reservoir inlet 2101 both before and after introduction of sample holder 2001 into reservoir inlet 2101. For example, in some embodiments, seal 2107 may include a cover 2111 similar to cover 1620 and/or an O-ring 2109 similar to O-ring 1650. Upon insertion of capillary tube 2103 into seal 2107, capillary tube 2103 may encounter O-ring 2109 before breaching seal 2107 through cover 2111. In this way, O-ring 2109 may prevent fluid from either capillary 2103 or reservoir 2303 from leaking out of preparation unit 2005.

Seal 2107 may be formed as a breachable plug disposed in reservoir inlet 2101. This breachable plug may be bonded, welded, adhered or over-molded to the rigid base portion 2009. In some embodiments, however, the breachable plug may be formed as part of the base portion itself. The reservoir inlets, prior to accepting the plugs could serve as filling ports for the liquids. In other embodiments, additional ports could be provided.

Figure 27:
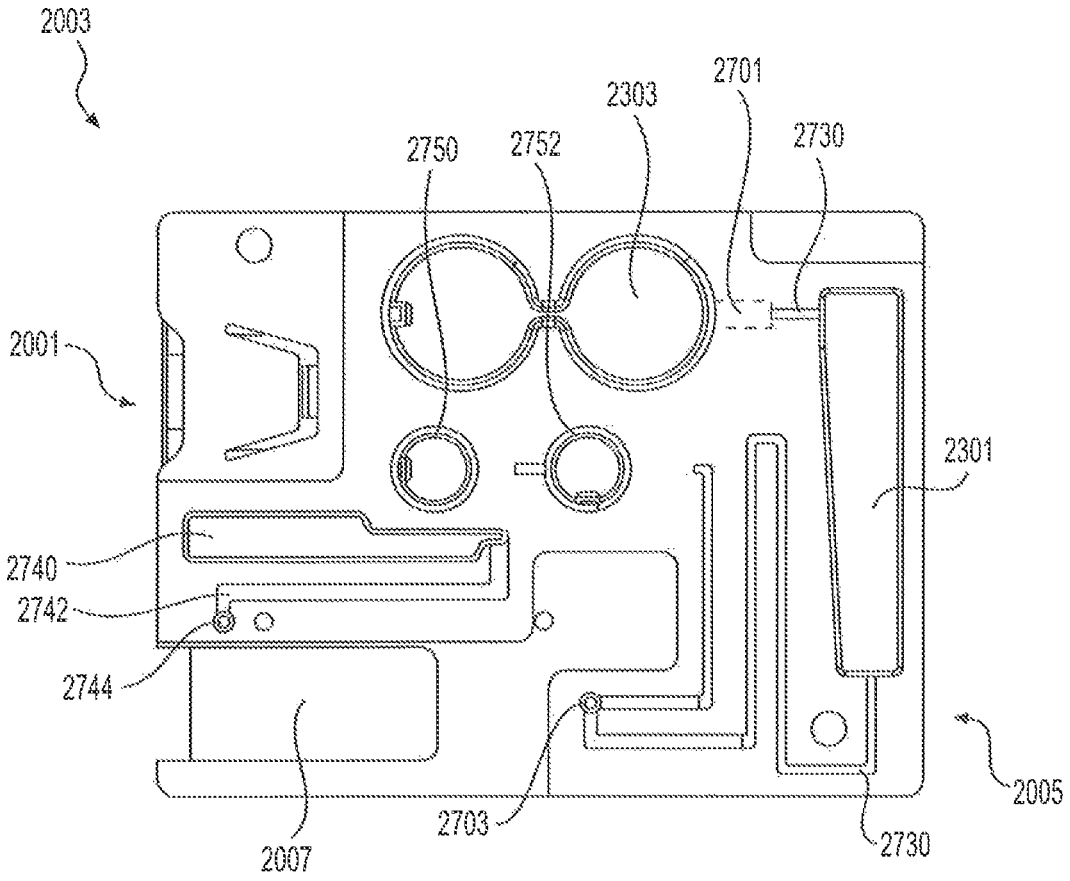
FIG. 27 provides a diagrammatic top view illustration of a cartridge, including a preparation unit and a fluid analysis chip, according to presently disclosed embodiments.

Turning to FIG. 27, preparation unit 2005 may include a first flow path including at least one fluid conduit 2730. This fluid conduit 2730 may be formed, for example, by the flexible film 2015 extending over one or more grooves 2030 (FIG. 20) formed in the top surface of the rigid base portion 2009. In some embodiments, this first fluid flow path may be configured to carry a sample fluid including at least the fluid to be analyzed from a reservoir on the preparation unit to a preparation unit fluid outlet 2703 enabling the sample fluid to exit preparation unit 2005 and enter, for example, fluid analysis chip 2007. It should be noted that the sample fluid may include only the fluid to be analyzed as introduced into preparation unit 2005 from capillary 2103. In some embodiments, however, the sample fluid carried by the first fluid flow path may include a suspension including the fluid to be analyzed (introduced from capillary 2103) mixed together with one or more fluids included in a reservoir associated with preparation unit 2005. For example, the sample fluid may include a suspension of the fluid to be analyzed mixed together with the high molecular weight polymer solution pre-loaded into reservoir 2303.

The first flow path may include structures other than fluid conduit 2730. For example, the first fluid flow path may include a buffer chamber 2301 formed, for example, by depression 2013 in the rigid base 2009 and sunken portion 2021 in the film 2015 (FIG. 20). The fluid flow path may also include one or more seals, such as frangible seal 2701. Frangible seal 2701 may be similar to any of the frangible seals discussed above (e.g., those seals formed by forming a temporary bond between layers 1970 and 1980, as shown in FIG. 19).

Preparation unit 2005 may also include a waste chamber 2740 for accumulating the sample fluid after the sample fluid passes through fluid analysis chip 2007. For example, sample fluid returning to the preparation unit 2005 from fluid analysis chip 2007 may re-enter the preparation unit 2005 via a preparation unit fluid inlet 2744. From inlet 2744, the sample fluid may flow to waste chamber 2740 via a second flow path, the second flow path including at least one fluid conduit 2742. The fluid conduit 2742 may be formed where the flexible film 2015 extends over one or more grooves formed in the top surface of the rigid base portion 2009. The fluid conduit 2742 may carry to waster chamber 2740 the sample fluid entering preparation unit 2005 via the inlet 2744. Fluid flow through the fluid conduit 2730, the fluid analysis chip 2007, and fluid conduit 2742 may be accomplished by drawing a vacuum at waste chamber 2740, as discussed above.

Returning to FIG. 22, a diagrammatic cross sectional illustration of a portion of preparation unit 2005 is provided. Also shown is a plunger 2301, which may be associated with a reader system (not shown) that may automatically receive cartridge 2003, interact with one or more sections of preparation unit 2005, and perform optical analysis of a sample fluid flowing through fluid analysis chip 2007. The interaction between the reader system and preparation unit 2005 may occur, for example, using plunger 2301. In some embodiments, plunger 2301 may be caused to selectively press down upon flexible film 2015 in an area of a first portion 2303A of reservoir 2303. This causes any fluid to be analyzed along with any fluid pre-loaded into first portion 2303A (e.g., a high molecular weight polymer, as discussed above) to transfer together to a second portion 2303B of reservoir 2303. In doing so, the fluid to be analyzed (e.g., blood or any other fluid of interest) may be mixed together with the pre-loaded fluid. Next, another plunger (not shown) may be caused to selectively press down upon flexible film 2015 in an area of the second portion 2303B at the same time or after plunger 2301 is released from film 2015 over first portion 2303A. Pressing on film 2015 over second portion 2303B will cause fluid in second portion, including the fluid to be analyzed and any pre-loaded fluid present, to transfer to first portion 2303A. In doing so, the fluid to be analyzed is further mixed with the pre-loaded fluid. As a result of one or more cycles of pressing on the film 2015 over first portion 2303A and second portion 2303B, a suspension may be formed that includes the fluid to be analyzed mixed together with the pre-loaded fluid (e.g., a high molecular weight polymer or any desireable reagent).

As noted above, in some embodiments, film 2015 may extend across depression in base portion 2009 without any raised or sunken portions pre-formed into film 2015. In other embodiments, however, raised portions 2017, 2019, and/or sunken portions, such as sunken portion 2021 may be pre-formed in film 2015 to facilitate a desired operation. For example, in the process illustrated in FIG. 22, fluid transfer to second portion 2303B caused by pressing on film 2015 over first portion 2303A may require film 2015 to stretch in the area over second portion 2303 to accept the extra fluid originally present in first portion 2303A. Stretching film 2015, however, may lead to undesirable results (e.g., pressure increases beyond the peel strength of one or more frangible seals designed to retain fluid in reservoir 2303). To avoid such effects, film 2015 may be pre-formed (e.g., by thermoforming) with raised portions 2017 and 2019 to provide redundant area in the film 2015. These pre-formed portions may then enable transfer of fluid back and forth between portions of the reservoir without requiring stretching of the film.

As noted above, preparation unit 2005 may be formed by joining film 2015 to rigid base 2009. Such joining may be accomplished, for example, by any of the joining or welding technique s discussed above to provide the structure shown in FIG. 15, for example. FIG. 23 provides a diagrammatic top view illustration of one embodiment of a disposable cartridge formed by patterned thermo welding of film 2015 to a rigid base portion 2009. Areas that have been welded are shown either with a dotted pattern or a cross-hatched pattern. In the embodiment of FIG. 23, the areas of dotted patterning represent temporary, frangible seals, and the areas shown in cross-hatching represent permanent seals.

In some embodiments, one or more of the rigid base 2009 and the film 2015 may be formed of materials that may bond together when exposed to heat. During construction of the two-part structure of preparation unit 2005 (FIG. 20), varying levels of heat may be applied to achieve desired results. For example, where high temperatures (e.g., 140 C-180 C) are applied, film 2015 may be caused to permanently weld to the material of rigid base 2009 (cross-hatched pattern of FIG. 23). In other areas, where little or no heat is applied, film 2015 may remain unbonded to the underlying rigid frame. And, in areas where heat is provided at a level below a welding threshold for the materials (e.g., 100 C-130 C), the material of film 2015 may bond together with the material of rigid base 2009, but the bond may be non-permanent (dotted pattern of FIG. 23). That is, in these areas, the bonded materials may be later pulled apart from one another.

In some embodiments, the selective bonding described above may be achieved, for example, using a film 2015 having a multi-layer structure. A first sub-film of the multi-layer structure (e.g., the lowest layer that first contacts rigid base 2009) may include a material that forms a relatively weak bond with the material of rigid base 2009. Thus, subsequent force on an area where the first sub-film has been bonded to rigid base 2009 may result in separation (e.g., peeling) of the sub-film and, therefore, the entire film 2015 away from rigid base 2009.

In some embodiments, a multi-layer structure of film 2015 may include a second sub-film disposed above the first sub-film. The second sub-film may form a more permanent bond with the material of rigid base 2009 through the application of a higher temperature. For example, in some embodiments, the higher temperature may cause the first sub-film to melt, and flow away from the bonding area, which may enable the second sub-film to bond directly to the rigid frame material (either permanently or semi-permanently).

This type of bonding may facilitate construction of components associated with preparation unit 2005. For example, in areas such as region 2310, a high temperature may be applied to permanently weld the material of film 2015 to rigid base 2009. In areas associated with reservoirs 2301, 2303, etc. and fluid conduit 2730, heat application may be avoided such that film 2015 remains free of rigid base 2015 in these regions. In regions associated with seals (e.g., frangible seal 2701), a sub-welding heating level may be used such that film 2015 is tacked or temporarily bonded to rigid base 2009. These seals may be referred to as "peel seals," as pressure placed on the seal, for example by a fluid within reservoir 2303 pressing on seal 1507, may cause film 2015 to peel away from rigid base 2009. Under such circumstances, fluid may be allowed to flow through the seal. While these peel seals may be frangible, fluid flow through a broken seal may be halted by, for example, applying pressure to film 2015 in the regions of the seals in order to close the fluid pathway at the seals. The peel layers of film 2015 may be designed to yield or tear at a specific stress level influenced by polymer composition of film 2015 and geometry of the frangible seals.

In addition to layers used in creating frangible seals and/or bonds with rigid base 2009, film 2015 may also include other layers. For example, film 2015 may include one or more layers that serve as barriers for gas and/or moisture permeation. Examples for water vapor barriers include films containing aluminum, aluminum-oxide, or PCTFE. Many of these materials, while being flexible, may exhibit low stretch. Thus, the use of pre-formed raised or sunken structures in film 2015 may facilitate fluid movement without reliance upon a need for stretching film 2015.

Figure 24:
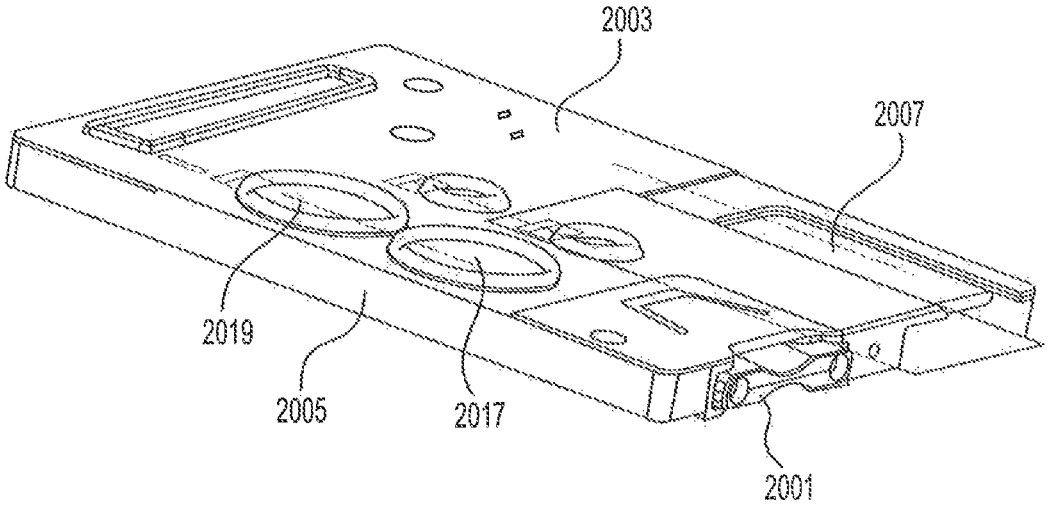
FIG. 24 provides a diagrammatic illustration of a sample holder introduced into a cartridge, including a preparation unit and a fluid analysis chip, according to presently disclosed embodiments.

FIG. 24 provides a diagrammatic illustration of a sample holder 2001 introduced into a cartridge 2003, including a preparation unit 2005 and a fluid analysis chip 2007, according to presently disclosed embodiments. Visible are the raised portions 2017 and 2019 of film 2015 that are used to form reservoir 2303. Also visible is the sunken portion 2021 of film 2015 used to form buffer chamber 2301. In the embodiment shown in FIG. 24, fluid analysis chip 2007 is attached (e.g., bonded) to an underside of preparation unit 2005.

Figure 25A:
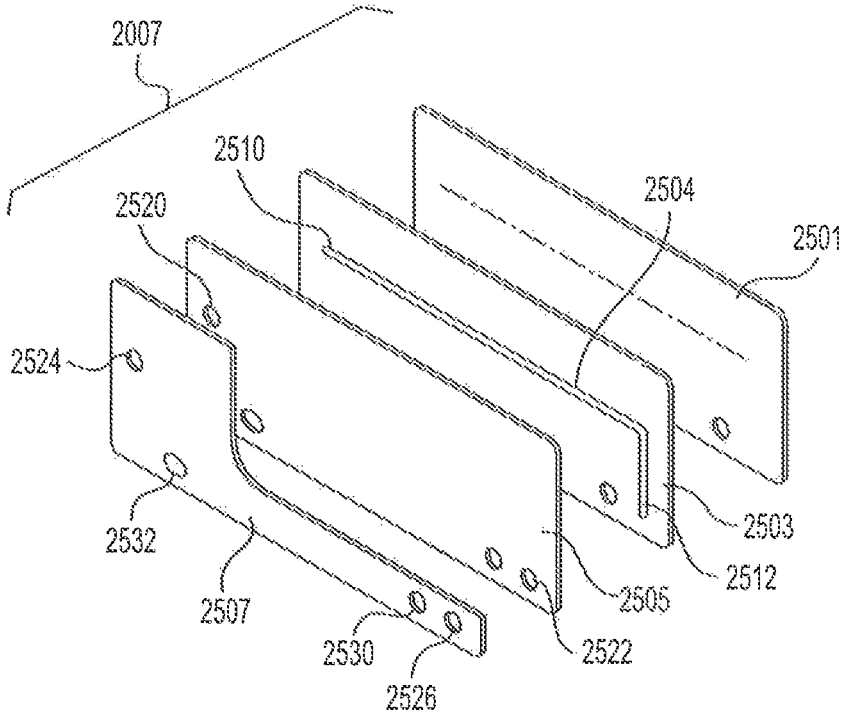
FIGS. 25A and 25B provide diagrammatic illustrations of a fluid analysis chip, according to presently disclosed embodiments.
Figure 25B:
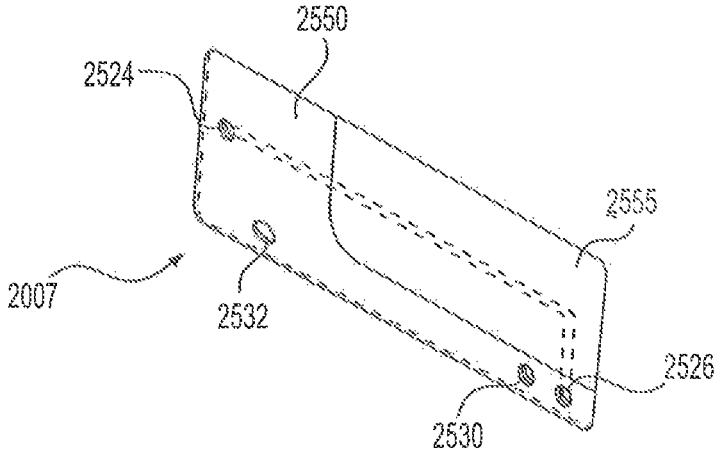

FIGS. 25A and 25B provide diagrammatic illustrations of a fluid analysis chip 2007, according to presently disclosed embodiments. FIG. 25A provides an exploded view showing components of chip 2007. While any number of layers may be included in chip 2007, in some embodiments, chip 2007 may include four layers. For example, chip 2007 may include a base layer 2501, a spacer layer 2503, a cap layer 2505, and an interface layer 2507.

Base layer 2501 may be fabricated from any suitable material. For example, in some embodiments, base layer 2501 may be formed of an optical polymer. Suitable polymer materials may include, for example, PMMA Poly(methyl methacrylate) (PMMA); acrylic, cyclic olefin copolymer (COC, Topas), cyclic olefin polymer (COP, Zeonor), polycarbonate, polystyrene, or any other polymer material of suitable clarity and optical properties. Such polymers may be referred to herein as optical polymers and may be transparent, or at least translucent, to certain wavelengths of light (e.g., visible light). In some cases, non-polymer materials may also be used.

Spacer layer 2503 may be disposed over base layer 2501. Spacer layer 2503 may include a microchannel 2504 formed therein. Microchannel 2504 is configured to guide a flow of the sample fluid within the fluid analysis chip 2007. For example, in some embodiments, the sample fluid may flow within microchannel 2504 from a location proximate to a first end 2510 to a location proximate to a second end 2512.

The microchannel 2504 formed in spacer layer 2503 may be configured with any size and/or shape suitable for facilitating viscoelastic focusing of particles present in the sample fluid made to flow through the microchannel. For example, in some embodiments, microchannel 2504 may include a width of at least five times greater than a depth of the microchannel. In some embodiments, the microchannel has at least one cross sectional dimension (e.g., either height or width) between 5 microns and 100 microns. In some embodiments, the microchannel has a width of between 0.5 and 2.0 mm, a length of at least 10 mm, and a depth of between 10 microns and 100 microns. In other embodiments, the microchannel may have a width of between 0.75 and 1.25 mm, a length of at least 20 mm, and a depth of between 20 microns and 50 microns. In one particular example, the microchannel may include a length of about 25 mm, a width of about 1 mm, and a depth of about 27 microns. Base layer 2501 may form the bottom of microchannel 2504, and the depth of the microchannel may be defined by the thickness of spacer layer 2503.

Spacer layer 2503 may include any suitable material. In some embodiments, spacer layer 2503 may include a pressure sensitive adhesive.

Cap layer 2505 may be disposed over spacer layer 2503 and may form a cover over microchannel 2504. Cap layer 2505 may be fabricated from any suitable material. For example, in some embodiments, cap layer 2505 may be formed of an optical polymer. Suitable polymer materials may include, for example, PMMA Poly(methyl methacrylate) (PMMA); acrylic, cyclic olefin copolymer (COC, Topas), cyclic olefin polymer (COP, Zeonor), polycarbonate, polystyrene, or any other polymer material of suitable clarity and optical properties. In some cases, non-polymer materials may also be used.

Cap layer 2505 may include a cap layer inlet 2520 and a cap layer outlet 2522 for establishing fluid communication between the preparation unit 2005 and the microchannel 2504 included in the spacer layer. For example, cap layer inlet 2520 may be configured to receive the sample fluid from preparation unit fluid outlet 2703 (FIG. 27) and provide the sample fluid to the location proximate the first end 2510 of the microchannel 2504. Similarly, the sample fluid flowing through the microchannel 2504 may exit the microchannel from a location proximate the second end 2512 of the microchannel 2504 and travel through a cap layer outlet 2522 and into the preparation unit fluid inlet 2744 of preparation unit 2005. From there, as noted above, the sample fluid may travel to waste chamber 2740 via fluid conduit 2742. Both the cap layer inlet 2505 and the cap layer outlet may be configured as through holes that extend through cap layer 2505. Cap layer inlet 2520 and a cap layer outlet 2522 may have any suitable size. In some embodiments, cap layer inlet 2520 and a cap layer outlet 2522 may have a diameter of about 1 mm.

An interface layer 2507 may be disposed over cap layer 2505. Interface layer 2507 may be formed from any suitable material. In some embodiments, interface layer 2507 may be formed of a pressure sensitive adhesive, such as 3M® 300LSE transfer tape or ARcare 92712. Interface layer 2507 may also attach (e.g., bond) fluid analysis chip 2007 to preparation unit 2005.

Interface layer 2507 may also include openings 2524 and 2526 positioned on interface layer 2507 at locations aligned with cap layer inlet 2520 and cap layer outlet 2522, respectively. As a result, sample fluid passing from the preparation fluid outlet 2703 of the preparation unit 2005 may travel to the cap layer inlet 2520 through opening 2524 in the interface layer 2507. Similarly, sample fluid passing from the microchannel 2504 into the cap layer outlet 2522 and on to the preparation unit fluid inlet 2744 of the preparation unit 2005 may pass through opening 2526 in the interface layer 2507. Openings 2524 and 2526 may have any suitable size. In some embodiments, openings 2524 and 2526 may have a diameter of about 1 mm.

Optionally, interface layer 2507 may include openings 2530 and 2532 that align with corresponding openings in each of cap layer 2505, spacer layer 2503, and base layer 2501. These openings may be used, for example, as alignment holes or references for facilitating assembly of the constituents of fluid analysis chip 2007 and/or for facilitating attachment of the assembled fluid analysis chip 2007 to preparation unit 2005 (e.g., through use of alignment pins, etc.).

Interface layer 2507 may also be configured with any suitable shape and need not have a shape similar to other layers of the fluid analysis chip 2007. For example, interface layer 2507 may have a flag shape, as shown in FIG. 25A. When assembled over cap layer 2505, interface layer 2507 may overlap a first portion 2550 of a top surface of the cap layer 2505. Interface layer 2507 may not extend, however, of an entirety of the top surface of cap layer 2505. For example, a second portion 2555 of the top surface of cap layer 2505 may be left uncovered by interface layer 2507. As a result, at least a portion of the microchannel 2504 may extend under the second portion of the top surface of the cap layer not overlapped by the interface layer. This portion of the microchannel not covered by interface layer 2507 may be the portion from which the reader unit analyzes the sample fluid flowing in the microchannel (e.g., by counting particles viscoelastically focused into a single plane orthogonal to an optical axis of a camera in the reader used to capture images of the passing particles).

FIG. 25B shows an assembled version of the fluid analysis chip 2007. As shown in FIGS. 25A and 25B, fluid analysis chip 2007 may include a sandwich structure in which the base layer directly contacts the spacer layer, the spacer layer directly contacts the cap layer, and the cap layer directly contacts the interface layer, in other embodiments, however, one or more intervening layers may be disposed between the interface layer and the cap layer, between the cap layer and the spacer layer, and/or between the spacer layer and the base layer.

The fluid analysis chip 2007 may be fabricated using any suitable fabrication technique. In some embodiments, the chip may be assembled by hand. In other embodiments, the chip may be fabricated using an automated laminating process. For example, tapes of material used in each of base layer 2501, spacer layer 2503, cap layer 2505, and interface layer 2507 may be supplied to an automated patterning and laminating machine. In some embodiments, this machine may include a web-based inline die/laser cutting and laminating machine. Patterns providing, for example, the shape of the interface layer, the inlet and outlet of the cap layer, the microchannel of the spacer layer, and the optional alignment holes may be used to form each of the layers. The automated machine may then align and bond the patterned layers together. An output of the machine may include a stream of laminated fluid analysis chips 2007 each of which may be bonded (either by hand or automatically by machine) to a preparation unit 2005 to form disposable cartridge 2003.

Figure 26A:
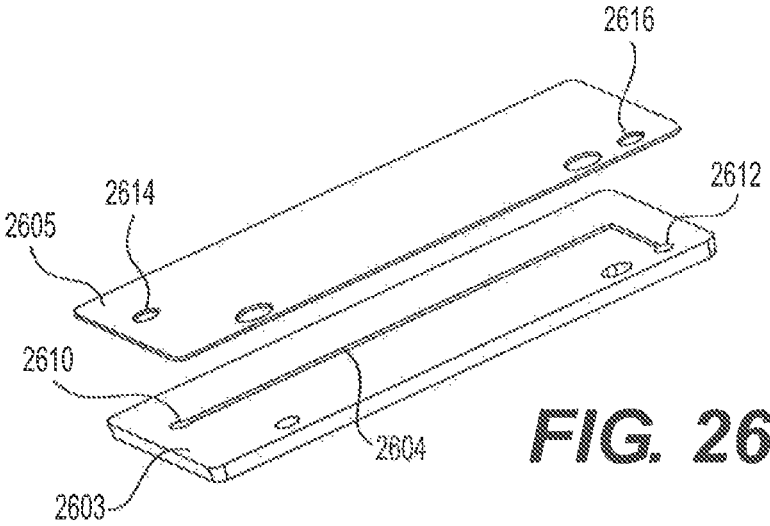
FIGS. 26A and 26B provide diagrammatic illustrations of a fluid analysis chip, according to presently disclosed embodiments.
Figure 26B:
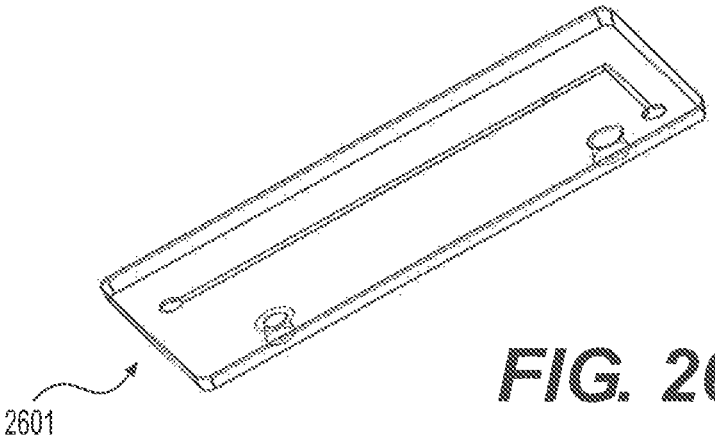

FIGS. 26A and 26B provide diagrammatic illustrations of a fluid analysis chip 2601, according to another disclosed embodiment. FIG. 26A provides an exploded view of chip 2601 and FIG. 26B provides an assembly view of chip 2601. The embodiment of FIGS. 26A and 26B is similar to the embodiment of FIGS. 25A and 25B, with the exception that the spacer layer and base layer of the FIG. 25A/25B embodiment have been replaced by a single, molded substrate 2603.

Substrate 2603 may be molded, e.g., by an injection molding process and may include a microchannel 2604 molded therein. Microchannel 2604 may have similar characteristics as microchannel 2504 described above. Substrate 2603 may be fabricated from any suitable material. For example, in some embodiments, substrate 2603 may be formed of an optical polymer (e.g., an optical polymer film). Suitable polymer materials may include, for example, PMMA Poly(methyl methacrylate) (PMMA); acrylic, cyclic olefin copolymer (COC, Topas), cyclic olefin polymer (COP, Zeonor), polycarbonate, polystyrene, or any other polymer material of suitable clarity and optical properties.

A cap layer 2605 may be disposed over substrate 2603. Cap layer 2605 may form a cover over microchannel 2604. Cap layer 2605 may be fabricated from any suitable material. For example, in some embodiments, cap layer 2605 may be formed of an optical polymer. Suitable polymer materials may include, for example PMMA Poly(methyl methacrylate) (PMMA); acrylic, cyclic olefin copolymer (COC, Topas), cyclic olefin polymer (COP, Zeonor), polycarbonate, polystyrene, or any other polymer material of suitable clarity and optical properties.

Cap layer 2605 may include holes 2614 and 2616 that align with microchannel 2604, for example, at ends 2610 and 2612, respectively, of microchannel 2604. These holes may enable sample fluid to flow from preparation unit 2005 and to preparation unit 2005 in the manner described above relative to the embodiment of FIGS. 25A and 25B.

Cap layer 2605 may be joined to substrate 2603 by any suitable technique. In some embodiments, thermal bonding may be used to join cap layer 2605 to substrate 2603. An interface layer (not shown) similar to interface layer 2507 may be used to attach fluid analysis chip 2601 to preparation unit 2005.

FIG. 27 provides a diagrammatic top view illustration of a cartridge 2003, including a preparation unit 2005 and a fluid analysis chip 2007, according to presently disclosed embodiments. In one operational path, a fluid to be analyzed may be provided by sample holder 2001 after insertion into preparation unit 2005. The fluid to be analyzed may be provided to reservoir 2303 where it can be mixed with a pre-loaded fluid, such as an aqueous solution of a high molecular weight polymer to form a sample fluid, including a suspension including the fluid to be analyzed mixed with the pre-loaded fluid. Once mixed, a sufficient pressure may be applied to the film covering reservoir 2303 to burst frangible seal 2701. Upon opening of frangible seal 2701, the sample fluid can flow into buffer compartment 2301 and then into fluid conduit 2730. The sample fluid travels along fluid conduit 2730 and exits the preparation unit 2005 at preparation unit fluid outlet 2703. The sample fluid then travels through fluid analysis chip 2007 and re-enters the preparation unit 2005 at the preparation unit fluid inlet 2744. The sample fluid then travels through fluid conduit 2742 and into waste chamber 2740.

Figure 28:
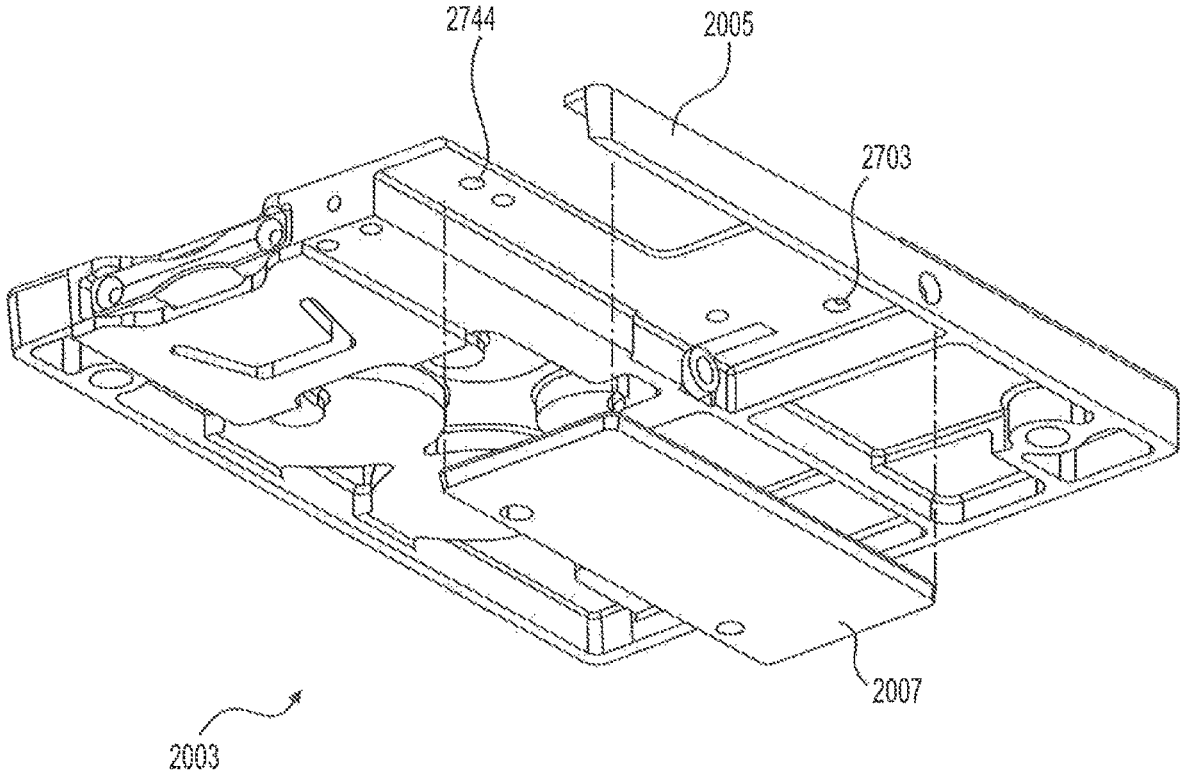
FIG. 28 provides a diagrammatic exploded view illustration of a cartridge, including a preparation unit and a fluid analysis chip, according to presently disclosed embodiments.

FIG. 28 provides a diagrammatic exploded view illustration of a cartridge 2003, including a preparation unit 2005 and a fluid analysis chip 2007, according to presently disclosed embodiments. Particularly, FIG. 28 shows an underside of the preparation unit 2005 and shows where on the preparation unit the fluid analysis chip 2007 is bonded when assembled. FIG. 28 also shows the preparation unit fluid outlet 2703 where the sample fluid from fluid conduit 2730 exits the preparation chamber 2005 and enters the fluid analysis chip 2007. FIG. 28 also shows the preparation unit fluid inlet 2744, where fluid exiting the fluid analysis chip 2007 re-enters the preparation unit 2005.

Figure 29:
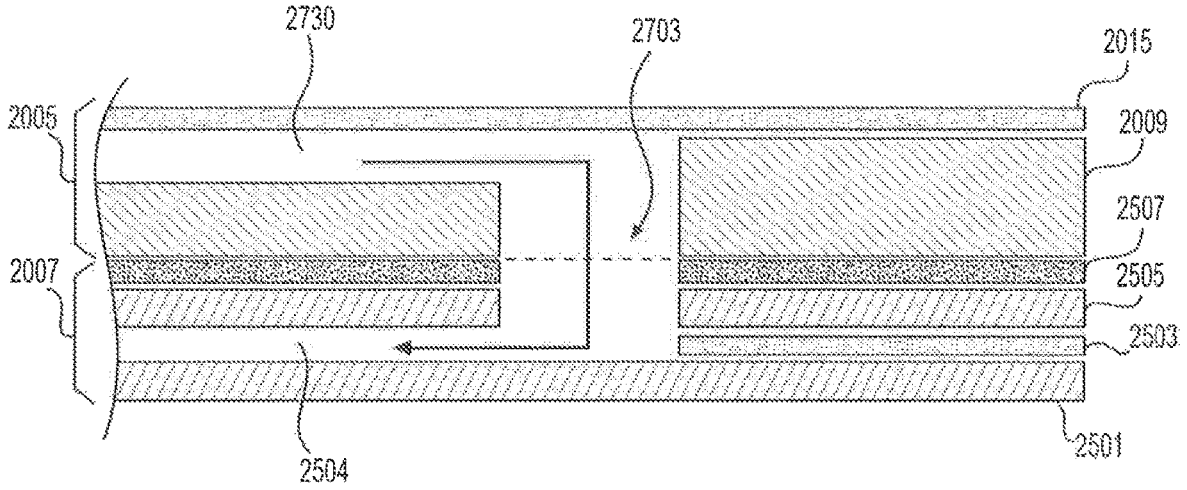
FIG. 29 provides a diagrammatic cross sectional illustration of a portion of a fluid analysis chip and preparation unit, according to presently disclosed embodiments.

FIG. 29 provides a diagrammatic cross sectional illustration of a portion of a fluid analysis chip 2007 and preparation unit 2005, according to presently disclosed embodiments. FIG. 29 also represents the fluid flow direction from the preparation unit 2005 and through the fluid analysis chip 2007. Particularly, as shown in FIG. 29, the sample fluid flows through fluid conduit 2730 of preparation unit 2005 and down into fluid analysis chip 2007 through preparation unit fluid outlet 2703. The sample fluid then flows through interface layer 2507, cap layer 2505, and into the microchannel 2504 formed in spacer layer 2503.

As noted above, a reader can analyze particles (e.g., cells) flowing in the sample fluid along microchannel 2504. In some embodiments, the sample fluid contains cells that become focused to the center of flow in the microchannel based on the viscoelastic properties of the sample fluid (provided by the high molecular weight polymer) in conjunction with the geometry of the microchannel. This focusing facilitates optical detection of the flowing particles or cells. In this case the particles or cells are counted and differentiated, and their concentration in the original fluid to be analyzed is calculated. In order to be able to deduce the concentration, the depth of the microchannel must be taken into account according to the following expression:

$$C=N/(A*h)*R$$

Where

C—concentration of cells in the original fluid to be analyzed

N—number of cells counted in the field of view of the reader camera

A—area of the field of view h—height/depth of the microchannel

R—dilution ratio of the fluid to be analyzed in liquid reagents

According to this expression, a variation in height (h) of the microchannel 2504 can directly affect the concentration accuracy. While the laminated structure of the fluid analysis chip 2007 may facilitate manufacturing, as the design is simple and easily mass-produced (and, therefore, less expensive than other designs), tolerances of the layer thicknesses, in some cases, may be greater than tolerances associated with some molded parts. Thus, strategies for accounting for variation in the thickness of the spacer layer 2503 and, therefore, the depth of microchannel 2504 may be needed. For example, in some embodiments, materials having small tolerances (e.g., those similar to or below what may be achieved with molding parts) may be procured and used. In such embodiments, no further accounting for thickness variation in the spacer layer may be required.

In other embodiments, variation in spacer layer thickness may be addressed using micro-beads as a calibration tool. For example, micro-beads may be provided at a known concentration in one or more of the liquid reagents preloaded onto preparation unit 2005. During measurement/analysis of the sample fluid in the microchannel 2504, the beads may be counted and the thickness, h, of the spacer layer 2503 can be calculated according to the experssion: $h=n/(C*A)$ where n is the number of beads per area measured, A is the area measured, C is the known concentration of beads.

In other embodiments, the thickness of the spacer layer may be measured directly for each fluid analysis chip 2007. For example, during manufacturing of the chip 2007, the thickness of the spacer layer/depth of the microchannel at the measurement area may be determined using light interferometry, for example. The thickness/depth value can be coded into barcode and printed on a label for the reader to read and used in finding the concentration of particles or cells in the fluid to be analyzed.

The described embodiments may provide certain advantages. For example, the design of the preparation unit may simplify manufacturing complexity by reducing the number of parts required and reducing manufacturing steps. The design of the fluid analysis chip may also enable the use of lower cost materials and simple manufacturing processes. Instead of using tubes or other fluid communication elements, channels in the preparation unit may be engraved in the rigid base 2009 and may be sealed by the film 2015, which may be welded to the base in a single process. In contrast to other designs, where the reservoirs are made of two flexible films adjoined together such that a reservoir is formed there between, the rigid base/flexible film design of the preparation unit 2005 may offer the advantage of enabling well defined filling ports. A filling nozzle may be aligned to the filling ports and may allow for the exit of air, as the air is replaced by fluid. Sealing of the ports can be achieved using a plug, sticker or other methods. Additionally, having most of the chambers' volume defined by a molded rigid part may increase the accuracy of final reagent volume and may also reduce an amount of trapped air in the reservoirs.

Returning to FIG. 27, a method of using disposable cartridge 2003 will be described. In some embodiments, cartridge 2003 may be used in a Complete Blood Count (CBC) where blood cells are differentiated and counted and the hemoglobin content is measured. The CBC test is one of the most common tests performed and having it performed at the Point Of Care, which the use of cartridge 2003 may allow, has great value.

In cartridge 2003, reservoir 2303 may be used to store liquid reagents suitable RBC, platelets and Leukocytes counting, while the other two smaller chambers 2750 and 2752 may contain reagents for lysing of RBC and staining Leukocytes, enabling their differentiation. Some of the reagents may include high molecular weight polymers to facilitate viscoelastic focusing of cells. Thus, reservoir 2303 and, separately, chambers 2750 and 2752 represent two different preparation paths within preparation unit 2005. Blood is automatically injected from the capillaries of sample holder 2001 into reservoir 2303 and/or chamber 2750 during the insertion of the cartridge into the reader unit. This is achieved by a plunger (FIG. 14B, 1406) which pushes the plug to the end of the capillary dispelling the blood into the respective reservoir or chamber. During the insertion the capillaries of the sample holder 2001 slide through O-rings that seals around the capillaries prior to breaching of the seal in the respective reservoir inlets.

The liquid reagents have viscoelastic properties to promote viscoelastic focusing during the flow of cells through the microchannel. The blood is mixed with the reagents in the respective reservoir or chamber, and once the suspension of the fluid to be analyzed and the pre-loaded reagents has been mixed, a pressure is applied on the reservoir/chambers in order to open corresponding frangible seals and enable the sample fluids from either of the preparation paths to pass out of the reservoir/chamber. In one preparation path, the sample fluid flows through the breached seal, into a fluid conduit, and into the buffer chamber 2301. This buffer chamber may be important to the operation of the cartridge, as in some embodiments, it may enable the sample fluid to stabilize and aggregate so that it can properly flow into the fluid analysis chip. The film 2015 covering the buffer chamber may be formed with a geometry that enables expansion and shrinkage in volume, allowing the fluid to fill the buffer chamber and also to be evacuated. For example, once a vacuum is applied to the system (e.g., via a port 2060 connected to the waste chamber 2040 (FIG. 20) the sample fluid flows through the fluid analysis chip 2007 and enters the waste chamber. The waste chamber may include an outlet including a self-sealing plug that enables air to be sucked out, but blocks fluid from exiting the chamber and contaminating the reader unit. The film 2015 covering the waste chamber 2040 may be flat in order to avoid collapse such that vacuum may be maintained and the waste chamber may be filled.

It should be further understood that arrangements described herein are for purposes of example only. The present disclosure is not to be limited in terms of the particular embodiments described in this application, which are intended as illustrations of various aspects. Many modifications and variations can be made without departing from its spirit and scope, as will be apparent to those skilled in the art. Functionally equivalent methods and apparatuses within the scope of the disclosure, in addition to those enumerated herein, will be apparent to those skilled in the art from the foregoing descriptions. Such modifications and variations are intended to fall within the scope of the appended claims.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A disposable fluid analysis cartridge comprising:

a preparation unit and a fluid analysis chip attached to the preparation unit, the fluid analysis chip being configured to receive a fluid to be analyzed from the fluid preparation unit, wherein the preparation unit includes:

a rigid base portion including at least one depression formed in a top surface of the rigid base portion;

a flexible film fixed to the rigid base portion and extending over the at least one depression to form a reservoir;

a reservoir inlet configured to receive into the reservoir a fluid to be analyzed; and a first flow path including at least a first fluid conduit, the first fluid conduit of the first flow path being formed by the flexible film extending over one or more grooves formed in the top surface of the rigid base portion, and wherein the first flow path is configured to carry a sample fluid including at least the fluid to be analyzed from the reservoir to a preparation unit fluid outlet;

a waste chamber;

a second flow path including at least a second fluid conduit, wherein the second flow path is configured to carry the sample fluid from a preparation unit fluid inlet to the waste chamber; and a port connected to the waste chamber, the port being configured to enable application of a vacuum to cause the sample fluid to flow toward the waste chamber and collect in the waste chamber;

and wherein the fluid analysis chip includes:

a chip inlet port and a chip outlet port, both being formed through a top surface of the fluid analysis chip; wherein the chip inlet port is configured to receive the sample fluid from the preparation unit fluid outlet, and wherein the chip outlet port is configured to return the sample fluid to the preparation unit via the preparation unit fluid inlet;

a microchannel formed in the fluid analysis chip and being configured to flow the sample fluid at least partially between the chip inlet port and the chip outlet port; and an interface layer disposed over at least a portion of the top surface of the fluid analysis chip, the interface layer being configured to attach the fluid analysis chip to the fluid preparation unit of the disposable cartridge.

2. The disposable fluid analysis cartridge of claim 1, wherein the microchannel has a width of between 0.5 mm and 2 mm.

3. The disposable fluid analysis cartridge of claim 1, wherein the microchannel has a length of at least 10 mm.

4. The disposable fluid analysis cartridge of claim 1, wherein the microchannel has a depth of between 10 microns and 100 microns.

5. The disposable fluid analysis cartridge of claim 1, wherein the interface layer is made from a pressure sensitive adhesive.

6. The disposable fluid analysis cartridge of claim 1, wherein the interface layer overlaps a first portion of the top surface of the fluid analysis chip and wherein at least a portion of the microchannel extends under a second portion of the top surface of the fluid analysis chip not overlapped by the interface layer.

7. The disposable fluid analysis cartridge of claim 1, further including a frangible seal disposed in the first fluid conduit.

8. The disposable fluid analysis cartridge of claim 1, wherein the interface layer provides a sealed passage from the preparation unit fluid outlet to the chip inlet port, and wherein the interface layer also provides a sealed passage from the chip outlet port to the preparation unit fluid inlet.

9. The disposable fluid analysis cartridge of claim 1, wherein the fluid analysis chip is oriented relative to the preparation unit such that the sample fluid is, provided from the preparation unit to the fluid analysis chip by flowing the sample fluid along a planar direction of the rigid base portion toward the preparation unit fluid outlet, where the sample fluid flows through a thickness direction of the rigid base portion, through a bottom surface of the rigid base portion, through the interface layer, and into the fluid analysis chip via the chip inlet port through the top surface of the fluid analysis chip.

10. The disposable fluid analysis cartridge of claim 1, wherein the preparation unit fluid outlet extends from a top surface of the rigid base portion to a bottom surface of the rigid base portion, and wherein at least one boundary of the preparation unit fluid outlet is provided by the flexible film fixed to the rigid base portion.

11. The disposable fluid analysis cartridge of claim 1, wherein the preparation unit fluid inlet extends from a bottom surface of the rigid base portion to a top surface of the rigid base portion, and wherein at least one boundary of the preparation unit fluid inlet is provided by the flexible film fixed to the rigid base portion.

12. A disposable fluid analysis cartridge, comprising:

a preparation unit and a fluid analysis chip attached to the preparation unit, wherein the preparation unit includes:

a rigid base portion including at least one depression formed in a top surface of the rigid base portion;

a flexible film fixed to the rigid base portion and extending over the at least one depression to form a reservoir;

a reservoir inlet configured to receive into the reservoir a fluid to be analyzed; and a first flow path including at least one fluid conduit, the at least one fluid conduit of the first flow path being formed by the flexible film extending over one or more grooves formed in the top surface of the rigid base portion, and wherein the first flow path is configured to carry a sample fluid including at least the fluid to be analyzed from the reservoir to a preparation unit fluid outlet;

and wherein the fluid analysis chip includes:

a molded substrate, the molded substrate including a microchannel formed therein, the microchannel being configured to guide a flow of the sample fluid within the fluid analysis chip;

a cap layer disposed over the molded substrate, the cap layer including a cap layer inlet and a cap layer outlet for establishing fluid communication with the microchannel included in the molded substrate; and an interface layer disposed over the cap layer, the interface layer attaching the fluid analysis chip to the preparation unit;

wherein the cap layer inlet is configured to receive the sample fluid from the preparation unit fluid outlet.

13. The disposable fluid analysis cartridge of claim 12, wherein the cap layer inlet is positioned in the cap layer such that the sample fluid can pass from the preparation fluid outlet to the cap layer inlet through an opening in the interface layer.

14. The disposable fluid analysis cartridge of claim 12, wherein the preparation unit further includes a preparation unit fluid inlet and wherein the cap layer outlet is positioned in the cap layer such that the sample fluid can pass from the microchannel into the cap layer outlet and on to the preparation unit fluid inlet through an opening in the interface layer.

15. The disposable fluid analysis cartridge of claim 12, wherein the first flow path also includes a buffer chamber.

16. The disposable fluid analysis cartridge of claim 12, wherein the reservoir inlet is configured to receive, align, and stabilize a capillary tube containing the fluid to be analyzed.

17. The disposable fluid analysis cartridge of claim 12, wherein the reservoir is pre-loaded with a high molecular weight polymer, and the sample fluid includes a suspension including the fluid to be analyzed mixed with the high molecular weight polymer.

18. The disposable fluid analysis cartridge of claim 17, wherein at least one seal is associated with the reservoir inlet, the at least one seal being configured to prevent a flow of the high molecular weight polymer through the reservoir inlet.

19. The disposable fluid analysis cartridge of claim 12, wherein the preparation unit includes a waste chamber and a second flow path including at least one fluid conduit, wherein the at least one fluid conduit of the second flow path being formed by the flexible film extending over one or more grooves formed in the top surface of the rigid base portion, wherein the second flow path is configured to carry the sample fluid from the preparation unit fluid inlet to the waste chamber.

20. The disposable fluid analysis cartridge of claim 12, wherein the first flow path includes at least one frangible seal.

21. The disposable fluid analysis cartridge of claim 12, wherein the microchannel has a width of between 0.5 mm and 2.0 mm, a length of at least 10 mm, and a depth of between 10 microns and 100 microns.

22. The disposable fluid analysis cartridge of claim 12, wherein the cap layer includes at least one of PMMA, COP, COC, acrylic, polycarbonate, or polystyrene.

23. The disposable fluid analysis cartridge of claim 12, wherein the interface layer is made from a pressure sensitive adhesive.

24. The disposable fluid analysis cartridge of claim 12, wherein the interface layer overlaps a first portion of a top surface of the cap layer and wherein at least a portion of the microchannel extends under a second portion of the top surface of the cap layer not overlapped by the interface layer.

* * * * *